US009132310B2

(12) United States Patent
Masterson et al.

(10) Patent No.: US 9,132,310 B2
(45) Date of Patent: Sep. 15, 2015

(54) REFORMER EXERCISE APPARATUS ARM CORD RETRACTION ASSEMBLY

(71) Applicant: BALANCED BODY, INC., Sacramento, CA (US)

(72) Inventors: Brian Masterson, Placerville, CA (US); Christopher J. Savarino, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 13 days.

(21) Appl. No.: 14/187,563

(22) Filed: Feb. 24, 2014

(65) Prior Publication Data

US 2014/0171274 A1 Jun. 19, 2014

Related U.S. Application Data

(62) Division of application No. 13/181,707, filed on Jul. 13, 2011, now Pat. No. 8,721,511.

(51) Int. Cl.

| | |
|---|---|
| ***A63B 21/068*** | (2006.01) |
| ***A63B 21/02*** | (2006.01) |
| ***A63B 21/055*** | (2006.01) |
| ***A63B 21/00*** | (2006.01) |
| ***A63B 22/00*** | (2006.01) |
| ***A63B 21/04*** | (2006.01) |
| ***A63B 21/05*** | (2006.01) |
| *A63B 5/00* | (2006.01) |

(52) U.S. Cl.

CPC ..... *A63B 21/068* (2013.01); *A63B 21/0001* (2013.07); *A63B 21/00065* (2013.01); *A63B 21/00069* (2013.01); *A63B 21/023* (2013.01); *A63B 21/0428* (2013.01); *A63B 21/055* (2013.01); *A63B 21/1469* (2013.01); *A63B 21/154* (2013.01); *A63B 22/0089* (2013.01); *A63B 5/00* (2013.01); *A63B 21/0552* (2013.01); *A63B 2208/0247* (2013.01); *A63B 2210/50* (2013.01)

(58) Field of Classification Search

CPC ..... A63B 22/0087–22/0089; A63B 21/00018–21/00025; A63B 21/154–21/156; A63B 21/02; A63B 21/023; A63B 21/04; A63B 21/0442; A63B 21/055; A63B 21/0552; A63B 21/1457; A63B 21/1461; A63B 21/1465; A63B 21/1488; A63B 222/20–22/203

USPC ..... 242/394, 545

See application file for complete search history.

(56) References Cited

U.S. PATENT DOCUMENTS 7,857,736 B2 * 12/2010 Merrithew et al. ..... 482/121
2008/0217457 A1 * 9/2008 Clute et al. ..... 242/383.2

* cited by examiner

*Primary Examiner* — Oren Ginsberg
*Assistant Examiner* — Jennifer M Deichl
(74) *Attorney, Agent, or Firm* — Greenberg Traurig, LLP

(57) ABSTRACT

A reformer exercise apparatus is disclosed that has a generally rectangular frame. The rail portions of the frame each have an upright outer wall and a hidden outwardly open slot therein. A foot bar support assembly movably carried by each of the outwardly open slots supports the foot bar. Each foot bar support assembly has an elongated slide plate movably supported within the slot, a hook plate fastened to the slide plate, and a foot bar support arm rotatably and slidably fastened to the hook plate. A pair of tubular risers each having a lower and upper roller therein at the head end of the frame direct arm cord ends to a cord retraction assembly mounted on the carriage. The retraction assembly mounted to the carriage releases the cords by pivoting either one of the shoulder stops toward the foot end of the frame.

20 Claims, 43 Drawing Sheets

REFORMER EXERCISE APPARATUS ARM CORD RETRACTION ASSEMBLY

CROSS REFERENCE TO RELATED APPLICATIONS

This application is a divisional of U.S. patent application Ser. No. 13/181,707 filed Jul. 13, 2011, entitled Reformer Exercise Apparatus, the disclosure of which is hereby incorporated by reference in its entirety.

BACKGROUND OF THE DISCLOSURE

1. Field of the Disclosure

The present disclosure relates to an exercise apparatus. In particular, it relates to a reformer exercise apparatus of a new and contemporary design that has a number of unique innovations.

2. State of the Art

Exercise machines utilized in the performance of physical exercises originated by Joseph Pilates typically are performed on a stationary apparatus called a reformer. A traditional reformer has a rectangular wood or metal frame supporting two parallel rails or tracks. A wheeled carriage rides on these tracks and is resiliently biased toward a foot end of the frame by one or more elastic members, typically coil springs. A user sits or lies on the carriage and pushes against a foot support bar at the foot end to move the carriage away from and toward the foot end. Alternatively, the user may grasp ends of a pair of ropes or straps that pass through pulleys at the head end of the frame and are attached to the carriage to similarly pull the carriage away from and toward the foot end of the frame.

One emphasis in Pilates training is on core musculature stabilization. The exercises being performed on the reformer ideally are conducted carefully by the user concentrating on body symmetry and symmetrical body movement and proper torso alignment during exercise. It is often somewhat difficult for a user to sense when he or she is properly centered on the reformer, and exerting equal forces with both arms or both legs during movements required. Also, either the user must get off of the reformer or an assistant must change positions of the foot support bar as may be required for different exercises. This, is at least an inconvenience to the user. Furthermore, the user must then reposition his or her body on the carriage to regain proper alignment.

The ends of the arm cords are typically stuffed through holes in the carriage platform to get them out of the way of the user or draped over the sides of the carriage. Thus they can drag on the floor beneath the carriage. The user also has difficulty in adjusting arm cord length while reclining on the reformer carriage. The user generally has to sit upright, adjust the arm cord length in the stop cleats, and then reposition herself on the carriage surface.

The rails upon which the carriage rides typically are horizontal surfaces which collect dust and dirt over time and thus the rollers and tracks must often be cleaned. Furthermore, the user must be careful not to let his or her clothing drape onto the rails to prevent such clothing interfering with operation of the carriage rollers.

There is therefore a need for a reformer apparatus that is simple and straightforward to use, easy for the user to adjust without getting off of the reformer carriage, and overcomes the drawbacks mentioned above.

SUMMARY OF THE DISCLOSURE

A reformer exercise apparatus in accordance with one aspect of the present disclosure includes a generally rectangular frame having a pair of parallel spaced side rail portions, a head end portion, and a foot end portion. A movable carriage is provided that is supported by the side rail portions for movement of the carriage between the head and foot end portions. A bias member, such as one or more coil springs, is connected between the carriage and the foot end portion of the frame for biasing the carriage toward the foot end of the frame. A foot support member such as a foot bar is supported by the side rail portions of the frame.

Each of the side rail portions of the frame has an upright outer wall and an integral horizontal top wall merging into an inwardly and downwardly slanted inner wall. Each side rail portion has a downwardly extending mid wall between the outer wall and the inner wall for supporting the foot support member. The mid wall has a longitudinally extending upper boss and a longitudinally extending lower boss forming an outwardly open slot therebetween facing the outer wall. Each side rail portion includes a horizontal wall between the inner wall and the mid wall.

The mid wall has a lower end portion forming a horizontal track for supporting the carriage. Furthermore, this lower portion of the mid wall also provides lateral support for guide rollers on the carriage to guide its movement between the head and foot ends of the frame.

One end of each foot support member is movably supported in the outwardly open slot between the upper and lower bosses of the mid wall. Furthermore, the mid wall includes a plurality of features, preferably notches for discrete positioning of the foot support member along a length of the side rail members of the frame.

The foot support assembly preferably includes a foot bar. The foot bar is supported at each end by a foot bar support assembly movably carried by each of the outwardly open slots in the side rail portions of the frame. Each foot bar support assembly includes an elongated slide plate movably supported within the slot, a hook plate fastened to the slide plate, and a foot bar support arm having one end fastened to one foot bar end and a portion rotatably and slidably fastened to the hook plate.

The slide plate is an elongated member having opposite ends, each end carrying a roller for riding on a bottom surface of the outwardly open slot in the mid wall of the side rail portion of the reformer frame. The slide plate also preferably has at least one roller for riding against an upright surface of the mid wall within the slot.

The foot bar support arm has a bottom end portion fastened to one foot bar end. The upper end of the foot bar support arm has an engaging member for selectively engaging a discrete feature of the hook plate when the foot bar is slid upward for rotation about the hook plate. The hook plate has an upper edge, the upper edge having a plurality of discrete features at spaced locations for selectively engaging a portion of the foot bar support arm to position the foot bar at predetermined angles from the upper surface plane of the reformer frame.

Each discrete feature is preferably a notch that has a distinctive shape. Each notch corresponds to a particular angular position for the foot bar with respect to the frame. Each hook plate preferably also has an L shaped slot for receiving the engaging member on the foot bar support arm. This L shaped notch positions the foot bar at a level below the upper frame surface and provides a user with a convenient carry handle bar at the foot end of the frame. Preferably the foot bar support arm carries a generally cylindrical pin for removably engaging one of the discrete features, i.e., one of the notches in the hook plate.

In another aspect the present disclosure describes a foot bar assembly for use on a reformer exercise apparatus having a generally rectangular frame with parallel sides, a head end and a foot end, each side having an outwardly open slot extending along at least part of the side. The foot bar assembly includes a generally U shaped foot bar having a first end and a second end, an elongated slide plate movably supported within with each of the slots, a hook plate fastened to each slide plate, and a foot bar support arm rotatably and slidably fastened to each hook plate and fastened to one of the first and second ends of the foot bar.

In another aspect of the disclosure, a reformer exercise apparatus having a generally rectangular frame supporting a carriage for movement between a head end and a foot end of the frame on parallel spaced side rail portions of the frame, and a foot bar supported by the frame is disclosed wherein the head end of the frame has a pair of spaced vertical bores formed therein, and an arm cord support riser disposed in each bore. Each cord support riser includes a hollow cylindrical tube carrying a first roller therein near a bottom end of the tube, a second roller rotatably supported within an upper end of the tube, and a guide adjacent the second roller for directing an arm cord around the second roller.

Preferably in one embodiment the bottom end of the tube is open to receive the arm cord therethrough and the upper end includes a top that has a dome shape with an opening therethrough for passage of the arm cord out of the tube. The top of the tube preferably also has a pair of spaced guides adjacent the opening and the second roller, and may also have a horizontal guide between the spaced guides. In some embodiments these guides are rollers. The riser tube further may include an internal cord guide plate above the first roller for guiding the arm cord over the first roller. The riser top may be separable from and rotatably fastened to the riser tube. Furthermore, the top may include a pair of spaced guides adjacent the opening for smooth passage of the arm cord. In another embodiment, the arm cord may be routed through a side of the tube just below an upper roller or pulley wheel. A pair of guide rollers is preferably arranged adjacent the opening through which the arm cord exits the tube. The riser top again may be separable from the riser tube as a cartridge assembly.

In another aspect, the present disclosure is directed to a reformer exercise apparatus that includes an arm cord retraction assembly mounted to an underside surface of the carriage. The retraction assembly has a pair of cord retraction devices, each device having a stationary frame carrying a rotatable spring biased reel therein connected to a free end of one of the arm cords, with each reel having a toothed outer rim.

The retraction assembly also includes a pair of toothed latch members rotatably mounted to the underside of the carriage and connected mechanically together such that rotation of one of the latch members out of toothed engagement with one of the toothed outer rims causes the other of the latch members to rotate out of toothed engagement with the toothed outer rim of the other spring biased reel.

The retraction assembly further has an actuator connected to one of the latch members operable for rotating the latch members into and out of engagement with the toothed rims of the retraction reels. This actuator is preferably resiliently biased out of engagement with the latch members.

In one embodiment of a reformer exercise apparatus in accordance with the present disclosure the actuator is incorporated into a pair of spaced shoulder stops extending from an upper surface of the carriage. Each of the shoulder stops is rotatably mounted to the carriage preferably for rotation about a horizontal axis. The actuator may be an elongated pin member that extends downward from the shoulder stop, through an aperture in the carriage and projects therefrom so as to engage one of the latch members. Pivotal movement, i.e., rotation, by the user, of either shoulder stop about its axis toward the foot end of the frame engages the actuator with one of the latch members which in turn causes both of the latch members to disengage the toothed outer rims. Preferably a spring is connected to each latch member that biases each latch member into engagement with one of the retraction reels.

In another aspect of the present disclosure, there is provided an arm cord retraction kit for retrofitting a conventional reformer exercise apparatus. The components in the kit are designed to be attached to the reformer carriage. The kit includes a pair of cord retraction devices, each device having a stationary frame for mounting to an underside surface of a reformer carriage, each frame carrying a rotatable spring biased reel therein connectable to a free end of an arm cord, each reel having a toothed outer rim, a pair of toothed latch members for pivotal mounting to the underside surface of the carriage, wherein the latch members are connected mechanically together such that rotation of one of the latch members out of toothed engagement with one of the toothed outer rims causes the other of the latch members to rotate out of toothed engagement with the toothed outer rim of the other spring biased reel, and an actuator for engaging one of the latch members when the shoulder stops are mounted to the reformer carriage.

In another aspect of the reformer exercise apparatus of the present disclosure, the carriage includes an integral adjustable headrest. The carriage includes a generally rectangular frame, a generally rectangular plate body portion fastened to the frame, and a generally trapezoidal shaped head rest plate portion hinged to the body portion. A shaped upper pad is fastened to an upper surface of the body and headrest portions.

In a still further aspect of the reformer exercise apparatus of the present disclosure, the frame preferably includes replaceable legs positioned at the corners of the generally rectangular frame. Each leg has an outer surface shape complementary to the shape of the corner. Each leg has an upper end shape configured to fit within a complementary recess in the underside surface of the frame. Each leg is an extrusion secured to the frame with a single bolt passing vertically through the leg into a corresponding boss in the frame. The bottom end of each leg includes a foot pad that facilitates stacking of one apparatus on top of another through engagement of the outer corners of the head end of the reformer and outer corners of the standing platform at the foot end of the reformer into a foot pad recess in each foot pad.

In a still further aspect of the present disclosure, an elastic resistance member may be fastened between the foot bar assembly and the head end of the reformer frame. When the foot bar assembly is free to move along the side rails of the frame it is resiliently biased toward the head end of the reformer frame. In this configuration, the foot bar assembly may be grasped by a user's hands while sitting or reclining on the carriage, and the foot bar assembly pulled along the rails against the resistance toward the carriage in order to perform various upper body exercises separately or in conjunction with leg extensions against the foot end of the reformer frame. The elastic resistance member may alternatively be fastened between the foot bar assembly and the foot end of the frame to facilitate similar exercises from the foot end of the frame by pulling the foot bar assembly toward the carriage.

BRIEF DESCRIPTION OF THE DRAWINGS

The disclosure will be better understood and objects, other than those set forth above, will become apparent when consideration is given to the following detailed description. Such description makes reference to the accompanying drawings wherein.

DETAILED DESCRIPTION

In the following description, numerous specific details are set forth in order to provide a more thorough disclosure. It will be apparent, however, to one skilled in the art, that the art disclosed may be practiced without these specific details. In some instances, well-known features may have not been described in detail so as not to obscure the art disclosed.

Figure 1:
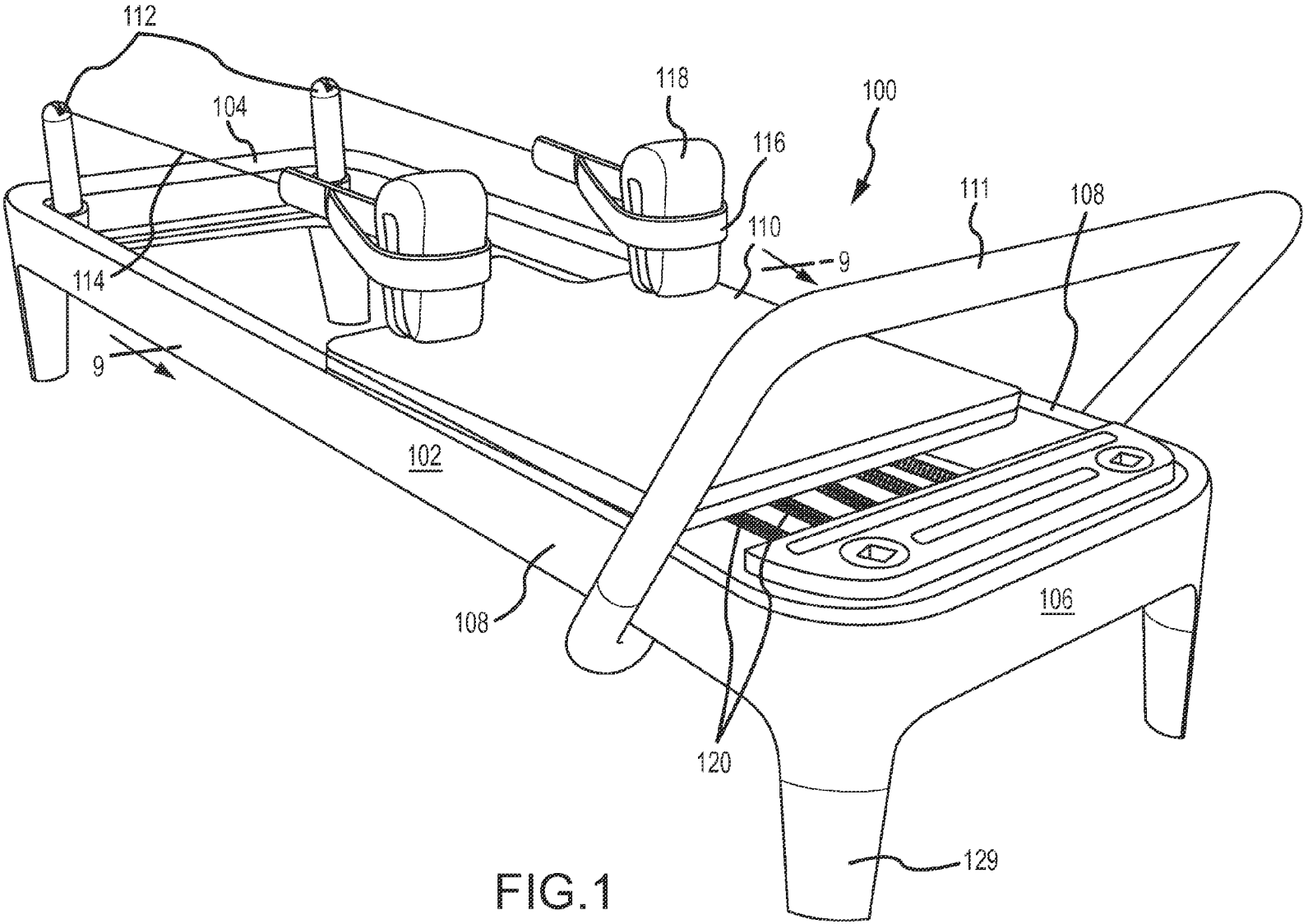
FIG. 1 is a perspective view of a reformer exercise apparatus in accordance with one embodiment of the present disclosure.

A perspective view of one embodiment of a reformer exercise apparatus 100 is shown in FIG. 1. The apparatus 100 has a generally rectangular frame 102 with a head end 104 and a foot end 106. The ends 104 and 106 are spaced apart by a pair of rail members 108. A carriage 110 is movably supported on the rail members 108 for movement back and forth between the ends 104 and 106 of the frame 102.

A foot bar 111 is positioned near the foot end 106 of the frame 102. This foot bar 111 is carried by the rail members 108 as will be described in detail below. The head end 104 of the frame 102 preferably supports a removable pair of spaced upright arm cord support risers 112. These risers 112 direct arm cords 114 from the carriage 110 to cord end loops 116 or grips for a user's hands for use in various exercises. When not in use, the end loops 116 may be conveniently positioned on the shoulder stops 118 as shown in FIG. 1. The carriage 110 is resiliently biased toward the foot end 116 of the frame 102 by one or more elastic members such as springs 120.

Figure 2:
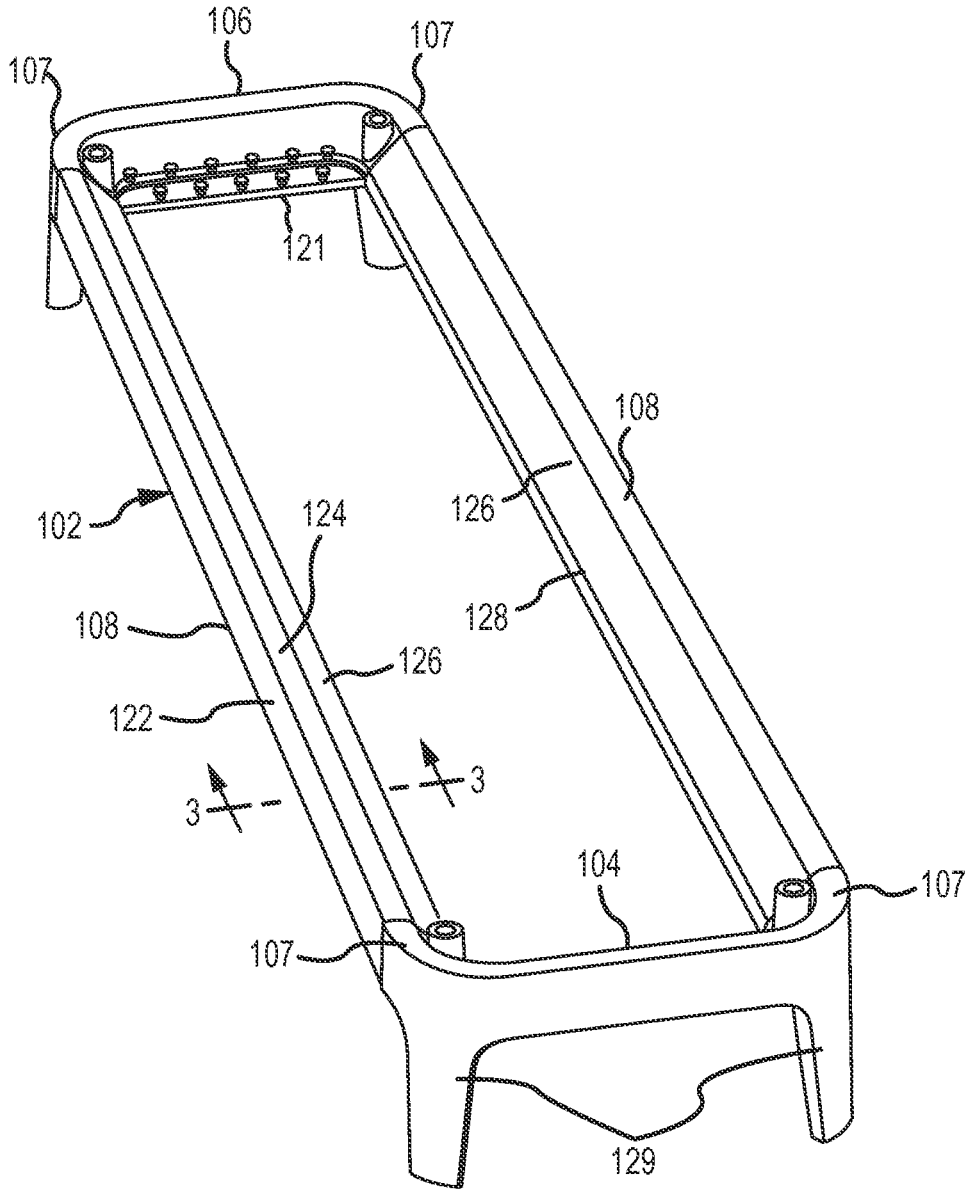
FIG. 2 is a separate perspective view of the frame of the reformer shown in FIG. 1 in accordance with the present disclosure.

A separate perspective view of the frame 102 is shown in FIG. 2. Each of the head end 104, the foot end 106 and the side rail members 108 has a similar outer surface shape that smoothly merge together. This shape includes an outer upright wall 122 merging with a horizontal top wall 124 which merges with a downwardly and inwardly slanted inner wall 126. The inner wall 126 merges into a vertical skirt portion 128. Thus the entire frame 102 includes an upright outer wall 122, a downwardly and inwardly slanted inner wall 126 and a vertical skirt portion 128.

The head and foot ends 104 and 106 have curved outer ends 107 that curve into and merge smoothly with the side rail members 108. The head end 104 further includes bosses for receiving the risers 112. The foot end 106 has an anchor support plate 121 spanning between the curved ends 107 for supporting ends of the bias members or springs 120 to bias the carriage 110 as mentioned above.

Extending downward from each curved end 107 is a complementary shaped upright support leg 129. These support legs 129 may be removed to place the ends 104 and 106 of the frame 102 on a planar surface such as a floor. The support legs 129 may be interchanged with longer or shorter support legs to change the height of the apparatus 100 above such a floor support surface.

Figure 3:
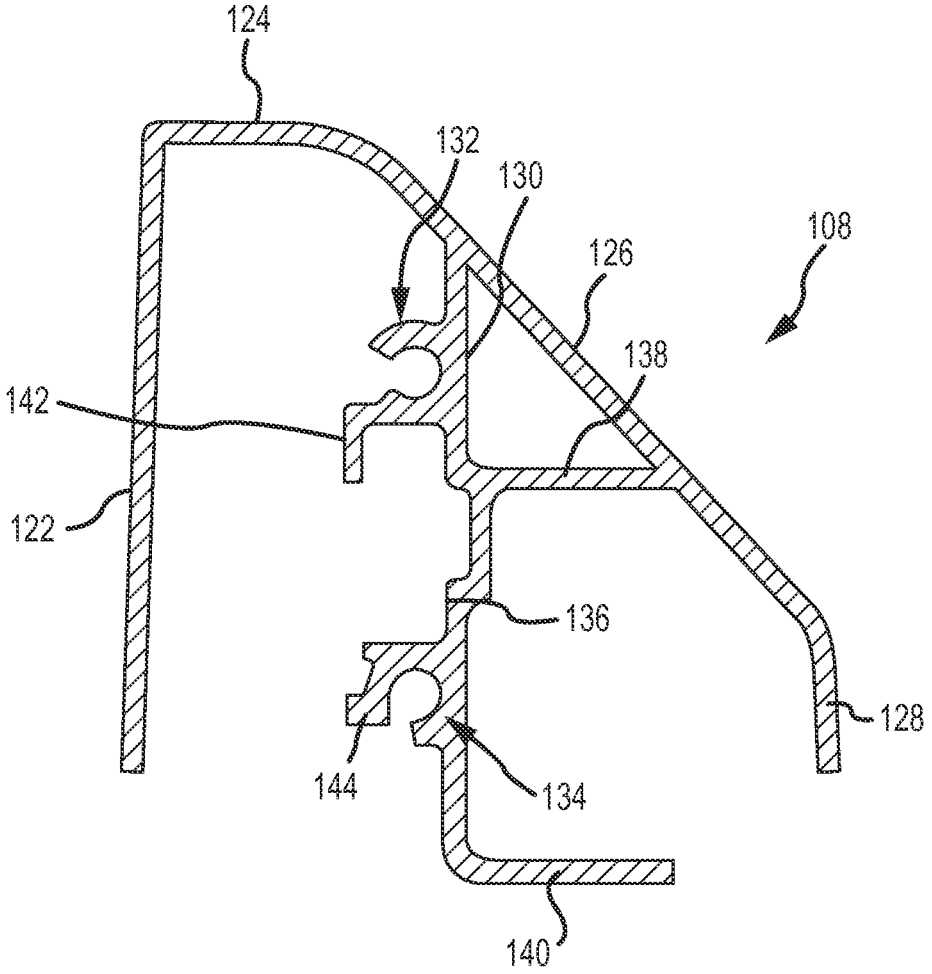
FIG. 3 is a cross sectional view of one side rail member of the frame taken along the line 3-3 in FIG. 2.

A sectional view of a side rail member 108 is shown in FIG. 3. Each rail member 108 is preferably an aluminum extrusion having an identical cross sectional shape. The rail member 108, as mentioned above, has an outer upright wall 122 that merges into a horizontal top wall 124 and then into a downwardly slanted inner wall 126 and then into a vertical skirt portion 128. The end members 104 and 106 have the same exterior shape, but differ internally from the side rail members 108.

As is shown in FIG. 3, each side rail member 108 has a vertical mid wall 130 between the slanted inner wall 126 and the upright outer wall 122. The mid wall 130 has an outwardly facing upper longitudinally extending boss 132 and a lower outwardly facing longitudinally extending boss 134 parallel to the upper boss 132. Together the mid wall 130, the upper boss 132 and lower boss 134 form an outwardly open slot 136 therebetween. This slot 136 receives and carries one of the foot bar support assemblies therein as will be described in detail below. Between the mid wall 130 and the slanted inner wall 126 is an upper horizontal support wall 138. The support wall 138 extends the length of the rail member 108 and provides tortional rigidity to the structure of the rail member 108. A horizontal bottom portion 140 of the mid wall 130 acts as a support for one set of wheels supporting the carriage 110. The upper wall 138 serves also as an upper guide for the carriage support wheels on the rail members 108. Furthermore, the mid wall 130 between upper and lower walls 138 and 140 and the skirt portion 128 serves as a lateral guide for the carriage 110.

The upper boss 132 preferably has a vertical portion 142 that extends downward parallel to the mid wall 130. This vertical portion 142 is used to provide lateral support for the foot support assembly described more fully below. Furthermore, the lower boss 134 may include a downwardly extending index rail 144. Alternatively, the indexing rail 144 may be installed along the length of the rail member 108 by a separate, replaceable metal indexing rail carried in the boss 134.

Figure 4:
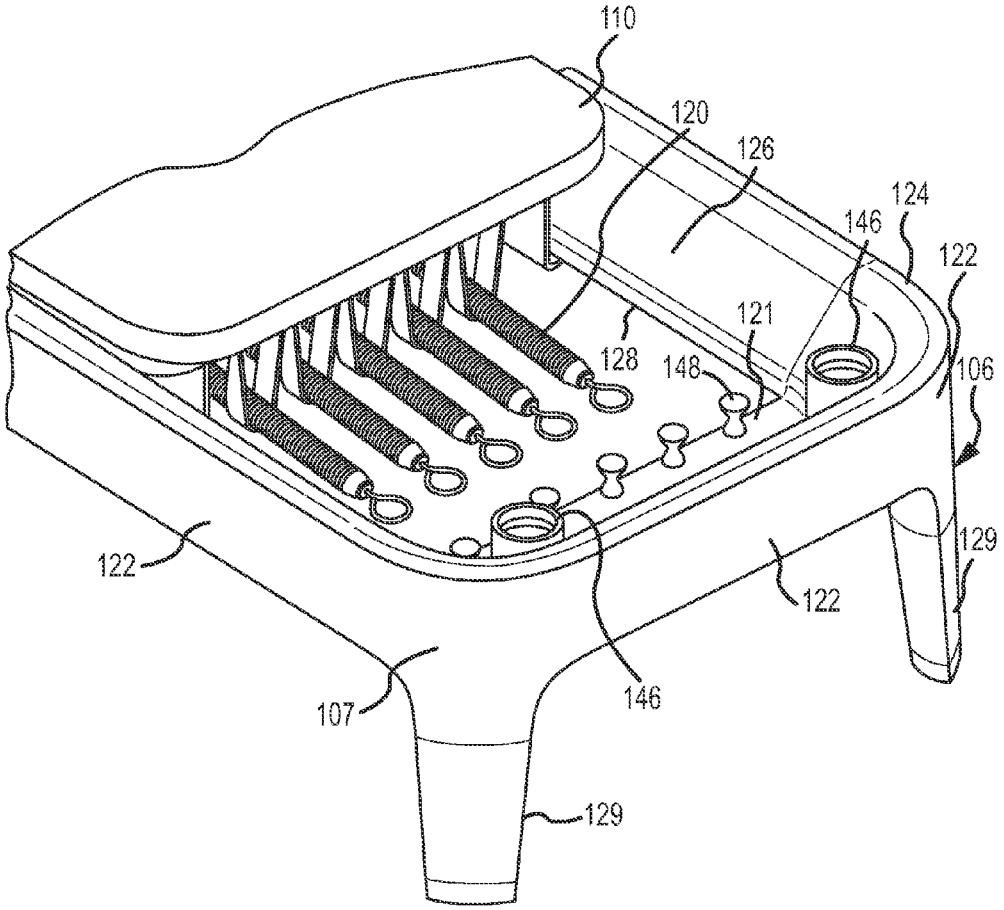
FIG. 4 is a partial perspective view of the foot end of a reformer in accordance with the present disclosure.

FIG. 4 is a perspective view of a foot end 106 of the frame 102. The foot end 106 carries the anchor plate 121 for receiving free ends of one or more of the springs 120. A plurality of spaced hourglass spool shaped pins 148 are each positioned to receive a loop on a spring 120 in order to fasten the spring 120 to the foot end 106 of the frame 102. Each of these pins 148 preferably tapers upward and inward from its base to a waist at a first angle from the pin's central axis and then outward at a second angle greater than the first angle so that the free end of a spring placed on the pin 148, when under tension, is securely held at the waist of the pin 148.

Each corner of the frame 102, formed by the ends 104 and 106, includes curved outer upright wall 122, top wall 124 and inwardly slanted inner wall 126. Preferably inner wall 126 terminates in an upright lower skirt portion 128. The foot end 106 also includes two spaced apart tubular foot support bosses 146 formed therein. These foot support bosses 146 are used to support a flat, generally rectangular foot platform (not shown) often called a "jump board". This jump board is a rectangular plate that has two spaced parallel support posts that removably fit into the foot support bosses 146.

The foot bar 111 shown in FIG. 1 will now be described specifically with reference to FIGS. 5, 6, 7, 8, and 9. The foot bar 111 is part of a foot support assembly that cannot be seen in FIG. 1. This foot bar 111 is separately shown in FIG. 5. The foot bar 111 has a central horizontal foot support portion 150 between two parallel leg portions 152. Each leg portion 152 terminates in a connection portion 154 that is fastened to one of two foot bar support assemblies 170.

Figure 7:
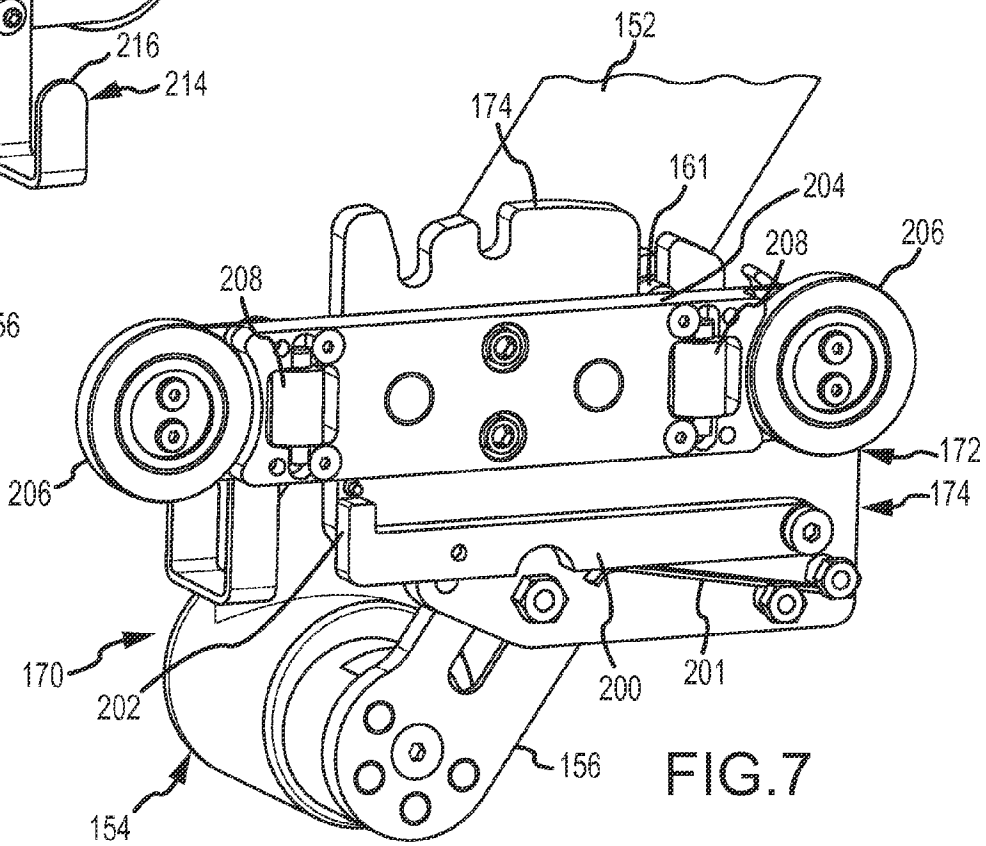
FIG. 7 is an inner perspective view of the right side rail member foot bar support assembly shown in FIG. 6.
Figure 6:
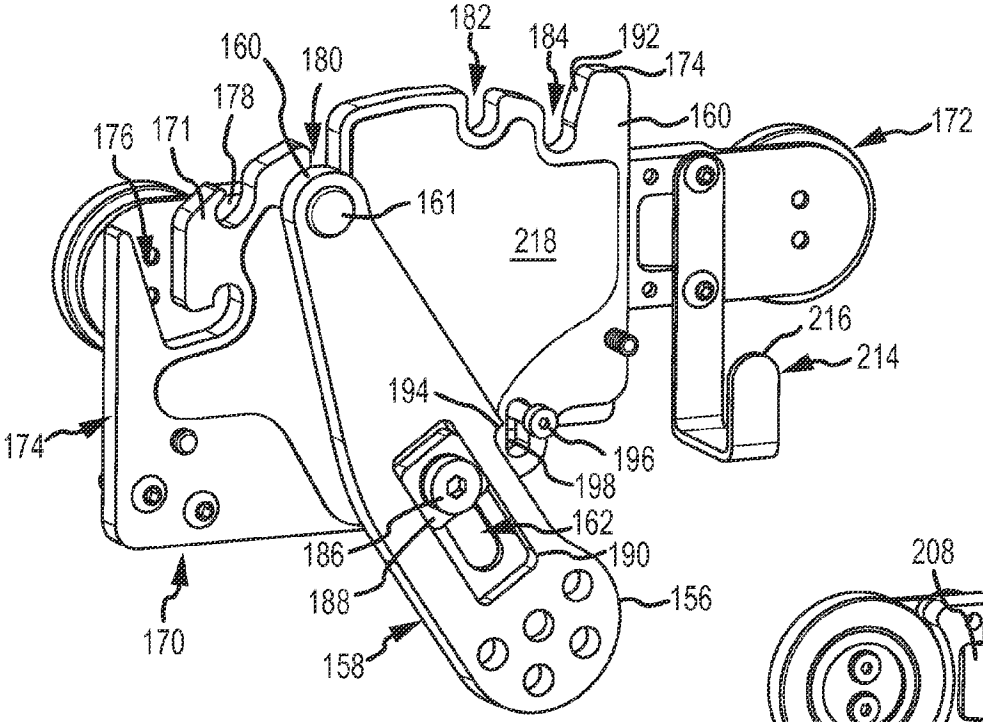
FIG. 6 is an outer perspective view of a right side rail member foot bar support assembly in accordance with the present disclosure.

Referring now to FIGS. 6 and 7, the connection portion 154 is bolted or otherwise fastened to a bottom end 156 of an elongated foot bar support arm 158. The arm 158, best shown in FIG. 6, is an elongated flat plate member that has an engaging pin 161 projecting outward from the upper end 160 of the arm 158. The arm 158 further has a closed pivot slot 162 radially extending parallel to the leg portion 152 of the foot bar 111 and spaced from where the connection portion 154 of the foot bar 111 is attached to the arm 158.

The foot support assembly of reformer 100 shown in FIG. 1 includes a left foot bar support assembly 170, the foot bar 111, and a right foot bar support assembly 170. FIGS. 6 and 7 are reverse perspective views of a right one of the foot bar support assemblies 170 in accordance with one embodiment of the present disclosure. Each leg 152 of the foot bar 111 is supported by one of the foot bar support assemblies 170. As is best shown in FIG. 6, the assembly 170 includes the foot bar support arm 158 to which the foot bar 111 is attached, a slide portion 172 that rides in the slot 136 in the side rail member 108, and a hook plate 174 which is rigidly fastened to the slide portion 172. This hook plate 174 has a series of features, preferably slots or notches 176, 178, 180, 182 and 184 spaced along the upper edge of the hook plate 174. The pin 161 projecting outward from the upper end 160 of the foot bar support arm 158 fits within one of these notches 176-184 to position the foot bar 111 at a particular desired angular position with respect to the frame 102 of the reformer 100.

The foot bar support arm 158 is slidably and pivotally attached to the hook plate 174 by a bolt 186 and square bushing 188. The bushing 188 rides between and along the parallel sides of a recess 190 in the arm 158 around the pivot slot 162. Since the foot bar 111 is fastened to the arm 158, when a user lifts the foot bar 111, the support arm 158 rides up or down along the slot 162. In turn, the pin 161 projecting outward from the upper end 160 of the support arm 158 is raised out of one of the slots along the upper edge of the hook plate 174. When lifted in this manner, a user can then rotate the foot bar 111 about the pivot bolt 186 to a different one of the slots 176, 178, 180, 182 or 184 to reposition the foot bar 111. When the foot bar 111 is lowered, the pin 161 slides down within one of the slots to fix the foot bar 111 in position.

The end slots or notches 176 and 184 have special significance in this embodiment 100. When the foot bar 111 has both its pins 161 positioned in slots 176, the foot bar 111 is rotationally positioned below the upper surface of the frame 102 and beyond the foot end of the frame 102. In this position, the foot bar 111 may be used as a handle to lift the foot end of the reformer 100. To ensure that the foot bar 111 does not disengage from the slot 176, the terminal end of the slot 176 is hooked upward, as can be seen in FIG. 6, to firmly engage with the pin 161 at the closed end of the slot 176. To disengage the foot bar 111 from this slot 176, the foot bar 111 must be pushed down and pulled rearward (away from the foot end) to align the pin 161 with the widened slot entrance. The foot bar 111 may then be rotated up and lifted out of the slot 176 and repositioned in a different one of the slots 178, 180, 182 and 184.

The forward most slot 184 in the hook plate 174 is used to position the foot support assembly comprising each of the assemblies 170 and the foot bar 111 together for translation along the rail members 108. As the foot bar 111 is raised and is rotated clockwise, as seen in FIG. 6, the arm 158 is rotated about the bolt 186 clockwise until the pin 161 engages a protruding surface 192 at the forward end (toward head end 104) of the hook plate 174. In this position, a shoulder 194 on the support arm 158 engages with a latch pin 196 that projects through a slot 198 in the hook plate 174. The latch pin 196 projects through the hook plate 174 from a latch arm 200 best seen in FIG. 7. When the foot bar 111 is then lowered, the shoulder 194 of the arm 158 pushes the latch pin 196 down.

Latch arm 200 is an elongated bar that has one end rotatably fastened to the inside face of the hook plate 174. The latch arm 200 can rotate in a plane parallel to the inside surface of the hook plate 174. The other end of the latch arm 200 has a latch portion 202 that engages a complementary shaped indexing feature in the rail member 108 in order to latch the assembly 170 at a selected position along the rail member 108. The latch arm 200 is spring biased upward via spring member 201 to maintain the latch portion 202 of the latch arm 200 engaged with the indexing feature of the index rail 144 in the rail member 108.

When the foot bar 111 is positioned with pins 161 in the slots 184, and the foot bar 111 is pushed downward to fully seat the pins 161 at the bottom of slots 184, the latch pins 196 are also pushed downward, rotating the latch arm 200 and moving latch portion 202 out of engagement with the indexing feature of the index rail 144 in the rail member 108. With the latch portions 202 disengaged with the rail members 108, the foot bar 111 may be moved toward or away from the foot end 106 of the frame 102 via the rollers 206. In fact, the foot bar 111 may be moved fully to the opposite end of the rail members 108 if desired.

The slide assembly 172 is best seen in the view of FIG. 7 which is a perspective inside view of the foot bar support assembly 170 shown in FIG. 6 that is carried in the right side rail member 108. The slide assembly 172 includes an elongated slide plate 204 that is preferably bolted or otherwise fixed to the hook plate 174. This slide plate 204 rides in the slot 136 in the rail member 108 with the hook plate 174 and adjacent foot bar support arm 158 disposed within the free/open space between the outer wall 122 and mid wall 130 of the rail member 108. It is to be understood that another, mirror image foot support assembly 170 is disposed in the other (left) rail member 108.

Figure 8:
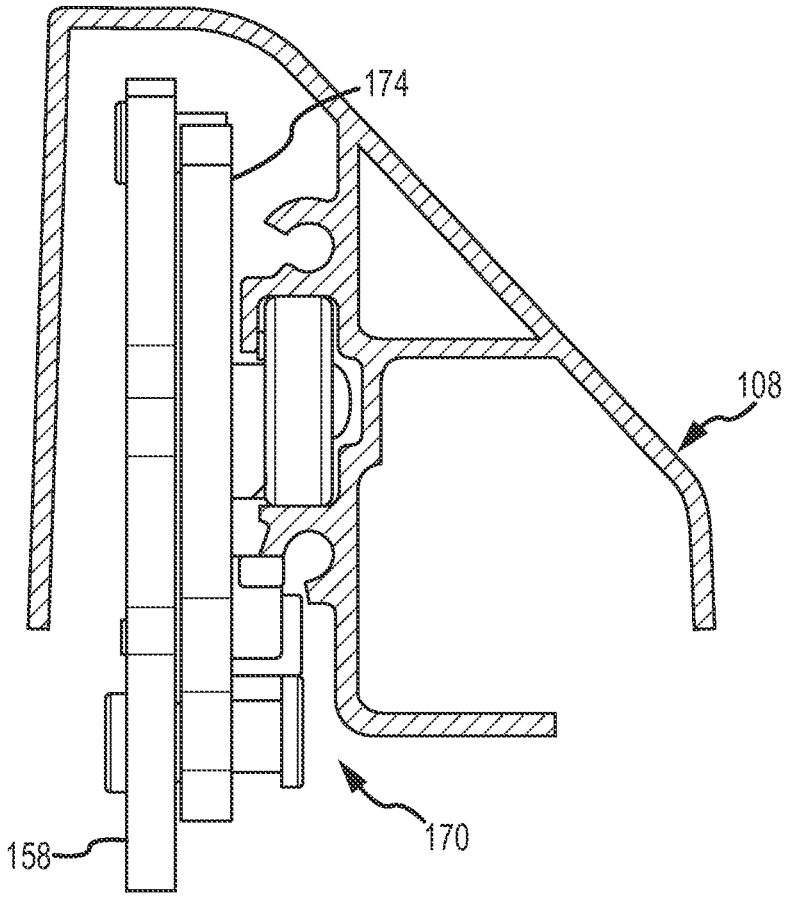
FIG. 8 is cross sectional view of a left rail member taken along the line 3-3 in FIG. 2 showing the arrangement of the foot bar support assembly carried therein.

A sectional view of a left rail member 108 as in FIG. 3 is shown in FIG. 8 with the left foot bar support assembly 170 riding in the slot 136. All of the component parts of the assembly 170 are disposed between the outer wall 122 and mid wall 130 of the rail 108. Thus the complete foot bar support assembly 170 is hidden from view by a user sitting on the carriage 110. It is to be understood that the right foot bar support assembly 170 in the right rail member 108 is constructed similarly. Thus the component parts of the assemblies 170 are either interchangeable or are mirror images. For example, the foot bar support arms 158 and hook plates 174 are mirrored. The remainder of the component parts of the assembly 170 may be interchangeable.

Turning back now to FIG. 7, the slide plate 204 is supported in the slot 136 by front and rear support rollers 206 that roll along the bottom surface of the slot 136. A guide roller 208 that rotates about a vertical axis through the slide plate 204 is mounted preferably adjacent to each support roller 206. The guide rollers 208 roll along inner side surfaces of the slot 136 in the rail member 108 to guide the support assembly 170, and thus the foot bar 111, as it is translated (i.e., rolled) fore and aft along the rail members 108.

The support rollers 206 are preferably bearing supported polymer wheels rotatably supported on horizontal axles. The polymer wheels are sized to fit and smoothly roll within the slot 136. The guide rollers 208 may be nylon or other polymer rollers supported by a vertical axle in the slide plate 204.

Figure 9:
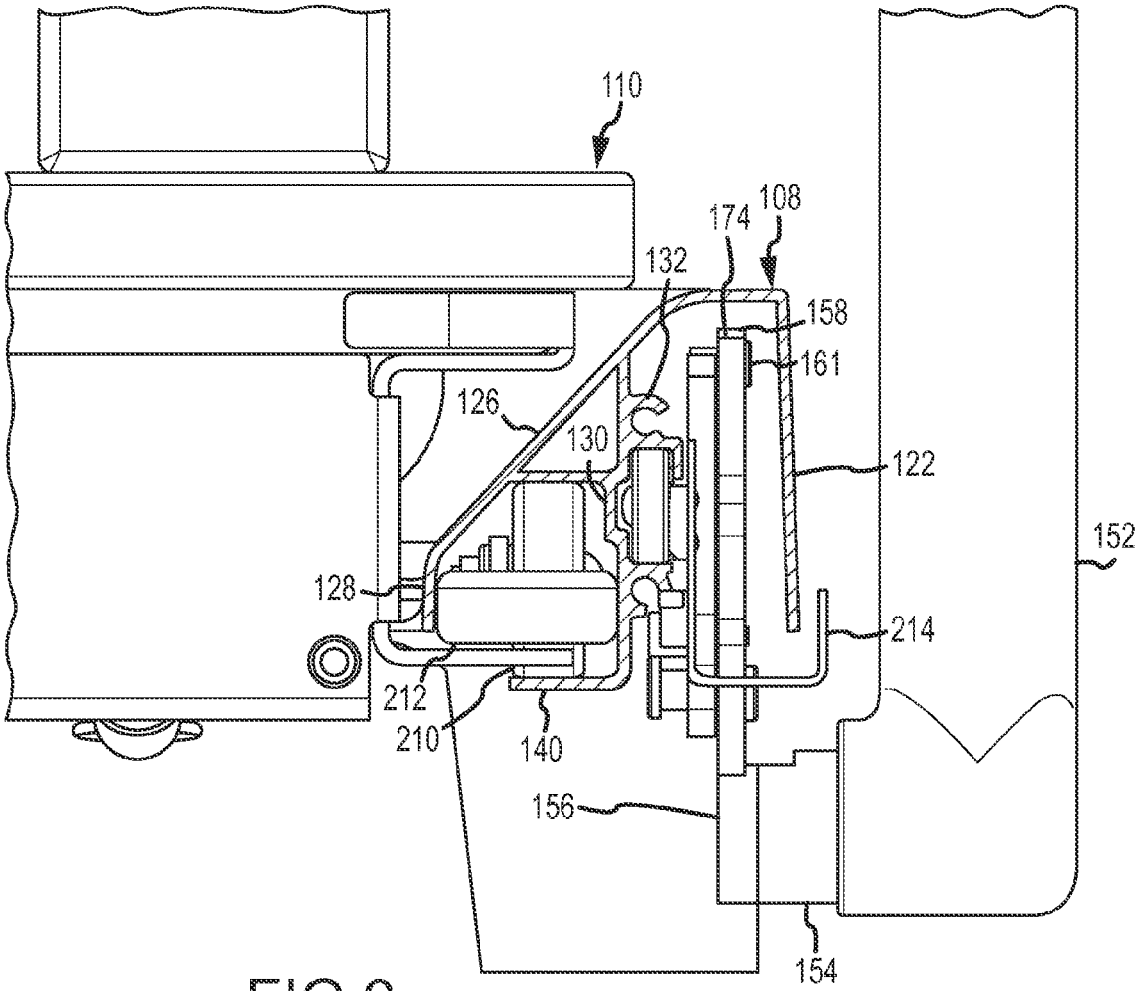
FIG. 9 is a cross sectional view of the reformer exercise apparatus shown in FIG. 1 taken along the line 9-9 in FIG. 1.

A further sectional view through the left rail member 108 of the apparatus 100 as in FIG. 1 is shown in FIG. 9 taken along the line 9-9 of FIG. 1. This view shows the foot support assembly 170 carried within the rail member 108 as well as the wheeled support arrangement for the carriage 110. Specifically, the generally rectangular carriage 110 has four support wheels 210, one adjacent each corner, and at least two carriage guide wheels 212 positioned preferably along one side of the carriage 110 that also ride in the space between the mid wall 130, the inner slanted wall 126, the skirt portion 128 and the bottom portion 140 of the mid wall 130 of the rail member 108. The support wheels 210 roll on the bottom portion 140.

The guide wheels 212 roll between the mid wall 130 and the skirt portion 128 of the inner wall 126 to maintain tracking of the carriage 110 as it moves between the foot end 106 and head end 104 of the frame 102. Because of the guide configuration of the rail member 108, only two guide wheels 212, both along only one side, are necessary to guide movement of the carriage 110. The guide wheels 212 are arranged in only one of the rail members 108. However, three or four guide wheels 212 may be provided in alternative configurations of the carriage 110.

Thus in the reformer 100 shown in FIG. 1, both support for the carriage 110 and the support for the foot bar 111 is provided by structures beneath and carried within the side rail members 108 and are thus hidden from external view. This arrangement presents a clean, uncluttered, appearance to the reformer apparatus 100 and minimizes the surface areas that can collect dust over time. Furthermore, in order to provide a direct foot bar position feedback to the user of the exercise apparatus 100, a "J" shaped indicator member 214 is fastened to one or both of the slide plates 172. A distal tip 216 of the indicator 214 extends around a bottom edge and upward outside of the wall 122 of the side rail member 108 to provide a user of the reformer 100 with an indication of the foot support assembly position. Corresponding markings (not illustrated) may be provided along the outer wall 122 for a user to utilize in positioning the foot bar 111 at preselected positions along the frame 102.

The notch 178 in the hook plate 174 is used to locate the foot bar 111 at a lowest position above the frame 102. The notch 180 places the foot bar 111 at a middle height position above the frame 102. The notch 182 corresponds to the foot bar 111 being substantially vertical, and thus its highest position above the frame 102. Additional notches may alternatively be provided to facilitate additional foot bar positions. However, a low, moderate, and high position are believed to be sufficient for most users of the apparatus 100.

A low friction layer 218 of polymer sheet material (shown in FIG. 6) is affixed to the outer surface of the hook plate 174 between the hook plate 174 and the support arm 158. This layer reduces any friction between the arm and the plate during rotation of the foot bar 111 between the notches 176, 178, 180 182 and 184. Alternatively, the low friction layer 218 may be applied to the inner surface of the arm 158. Further, a low friction layer 218 may optionally be applied to both of these facing surfaces.

The structure of the foot support assembly may be other than has been specifically illustrated and described. For example, the rollers 206 and 208 could be replaced by sheets of low friction material to permit the slide plate 204 to easily slide along the slot 136. The configuration of the support arm 158, the hook plate 174 and slide plate 172 may be different than that of the exemplary embodiment shown. Further other mechanisms may be used to engage and disengage the assembly 170 with features in the rail members 108 of the frame 102.

Figure 10:
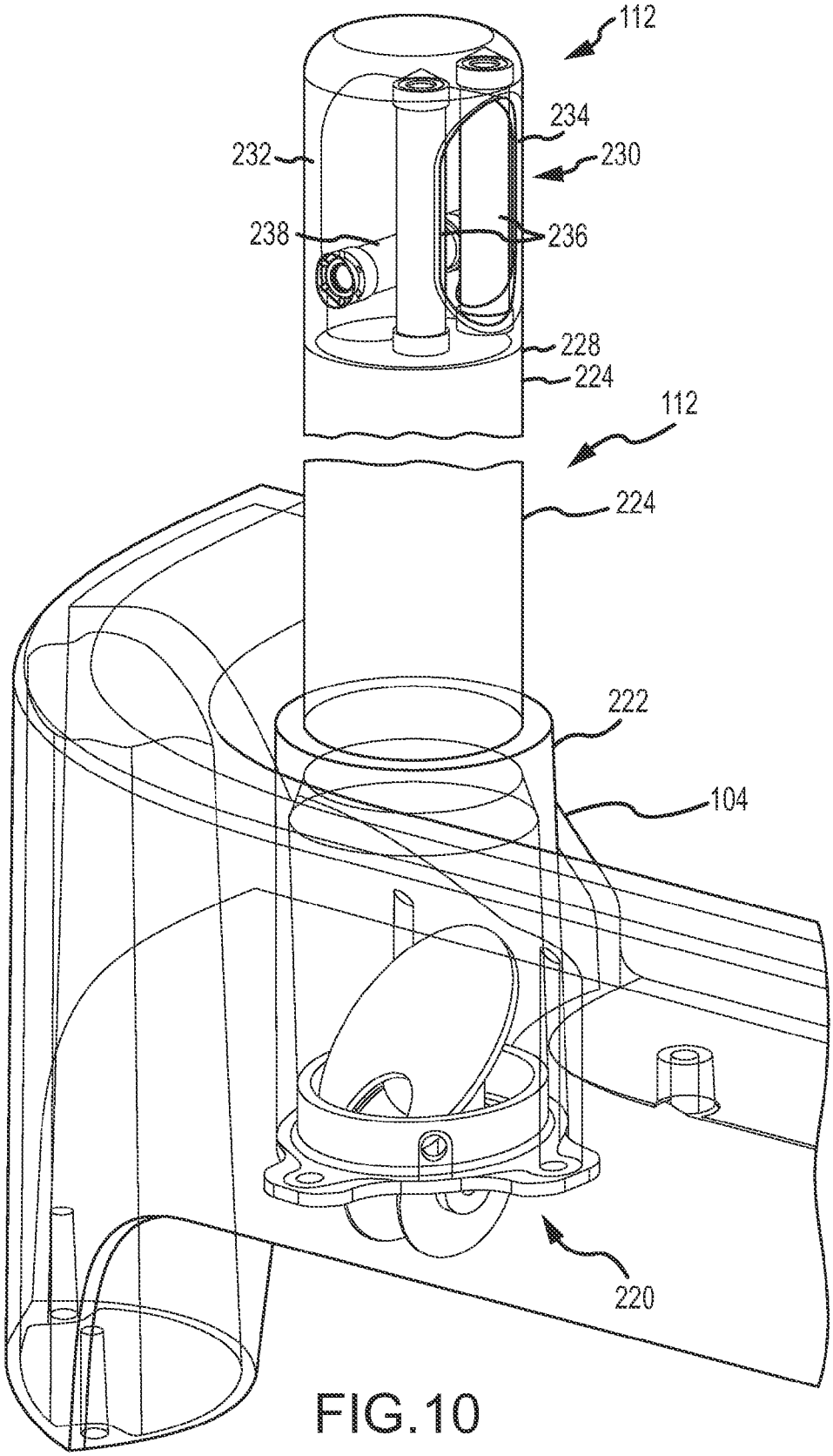
FIG. 10 is a partial perspective view of the head end of the reformer apparatus shown in FIG. 1.

Referring back to FIG. 1, at the head end 104 of the reformer apparatus 100 there are two spaced apart risers 112 for directing arm cords 114 from the carriage 110 to the head end 104 and then to the arm cord end loops 116. Referring now to the close perspective view of one of the risers 112 at the head end 104 shown in FIG. 10, each of these risers 112 includes a lower pulley wheel assembly 220 fastened into a tubular riser boss 222 formed adjacent each curved end 107 of the head end 104. Each riser 112 also includes a hollow tubular body 224 having its bottom end fitted within the tubular riser boss 222. The upper end 228 of the riser tubular body 224 carries a cylindrical roller head 230 This roller head 230 includes a tubular body 232 that fits into or is integrally formed with the body 224. The tubular body 232 has an elongated aperture 234 through its side. A pair of vertically aligned guide rollers 236 are mounted to the head 230 on both sides of the aperture 234. Mounted within and transversely across the tubular body 232 behind the aperture 234 is a horizontal cord pulley wheel or roller 238.

Figure 11:
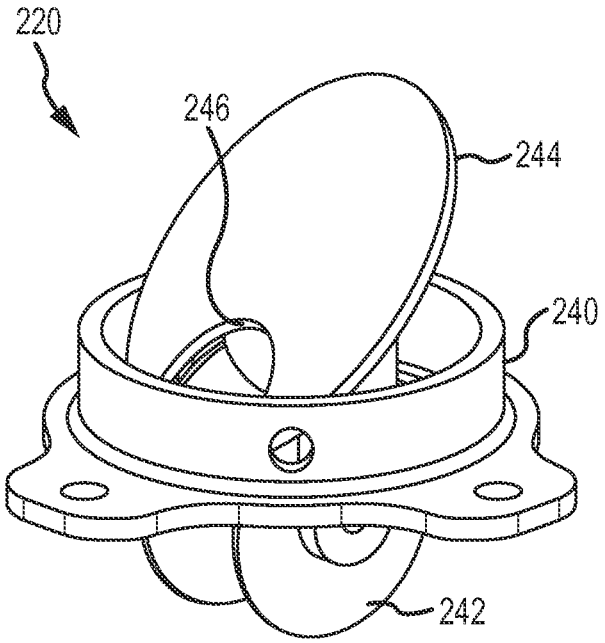
FIG. 11 is a separate perspective view of the lower pulley wheel assembly for the riser in the head end of the apparatus shown in FIG. 10.

The lower pulley wheel assembly 220 is separately shown in perspective view in FIG. 11. The lower pulley wheel assembly 220 has a flanged cylindrical body 240 that is fastened to the bottom of the boss 222. Carried within the body 240 is a horizontally journaled pulley wheel 242 and an angled cord guide disc 244. The guide disc 244 is positioned in the body 240 above the wheel 242 at an angle of about 45 degrees. An aperture 246 is provided in the disc 244 along its lower edge. This aperture 246 is oriented directly above the periphery of the pulley wheel 242 such that a free end of an arm cord 114 that is lowered into the riser 112 through the aperture 234 in the head assembly 230 is directed over the roller 238 and down through the tubular body 224 and through the aperture 246 and past the pulley wheel 242. A user can then grasp the free end of the cord 114 and fasten the cord to the carriage 110 as described in detail below.

The head assembly 230 may be fixed to the tubular body 224 or optionally may be bearing supported thereon such that it can rotate freely about a vertical axis through the riser 112. Each of the guide rollers adjacent the aperture 234 may be mounted on stationary vertical pins or otherwise bearing supported such that the cord 114 can be pulled through the aperture 234 with minimal resistance or friction. The bottom or lower pulley wheel 242 is oriented with its axis normal to the rail members 108 since movement of the carriage 110 is always either toward or away from the head end 104 of the frame 102.

Figure 12:
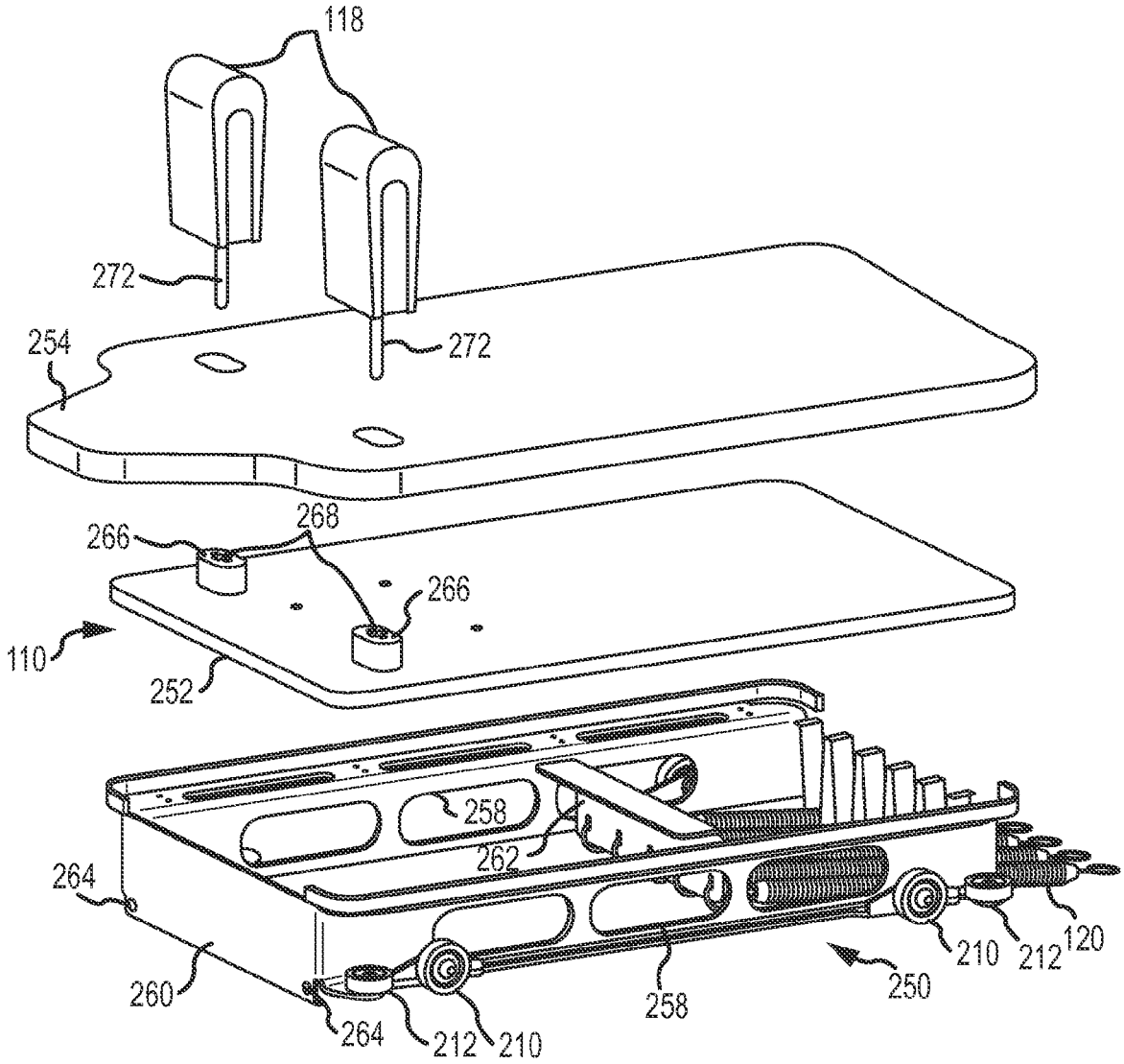
FIG. 12 is a separate exploded perspective view of the carriage in the reformer exercise apparatus shown in FIG. 1 in accordance with the present disclosure.

An exploded perspective view of the carriage 110 is separately shown in FIG. 12. The carriage 110 includes a generally rectangular frame 250, a rectangular support platform 252, a padded upper platform 254, and a pair of shoulder stops 118. The frame 250 has upright side support plates 258, a vertical head end plate 260 and a vertical spring support plate 262, both of which are fastened to the side support plates 258. All of these plates 258, 260 and 262 are also fastened to the underside of the support platform 252 to provide a rigid carriage structure. The spring support plate 262 carries one end of each of the biasing springs 120. The other end of each spring 120 may be removably fastened to the anchor pins 148 in order to vary the resilient bias, i.e. spring tension between the carriage 110 and the foot end 106 of the frame 102. The side support plates 258 each support the platforms 252 and 254 and provide mounting flanges for support wheels 210 and guide wheels 212. The head end plate 260 has a pair of spaced openings 264 therethrough which act as guides for the arm cords (not shown in FIG. 12).

The support platform 252 has a pair of shoulder stop supports 266 fastened to its upper surface. Each of these supports 266 has a vertical bore 268 therethrough and each supports a cross pin 270 (shown in FIG. 15) therein that fastens the stem 272 of the shoulder stop 118 to the carriage 110. The bore 268 extends through the support 266 and through the support platform 252.

Figure 15:
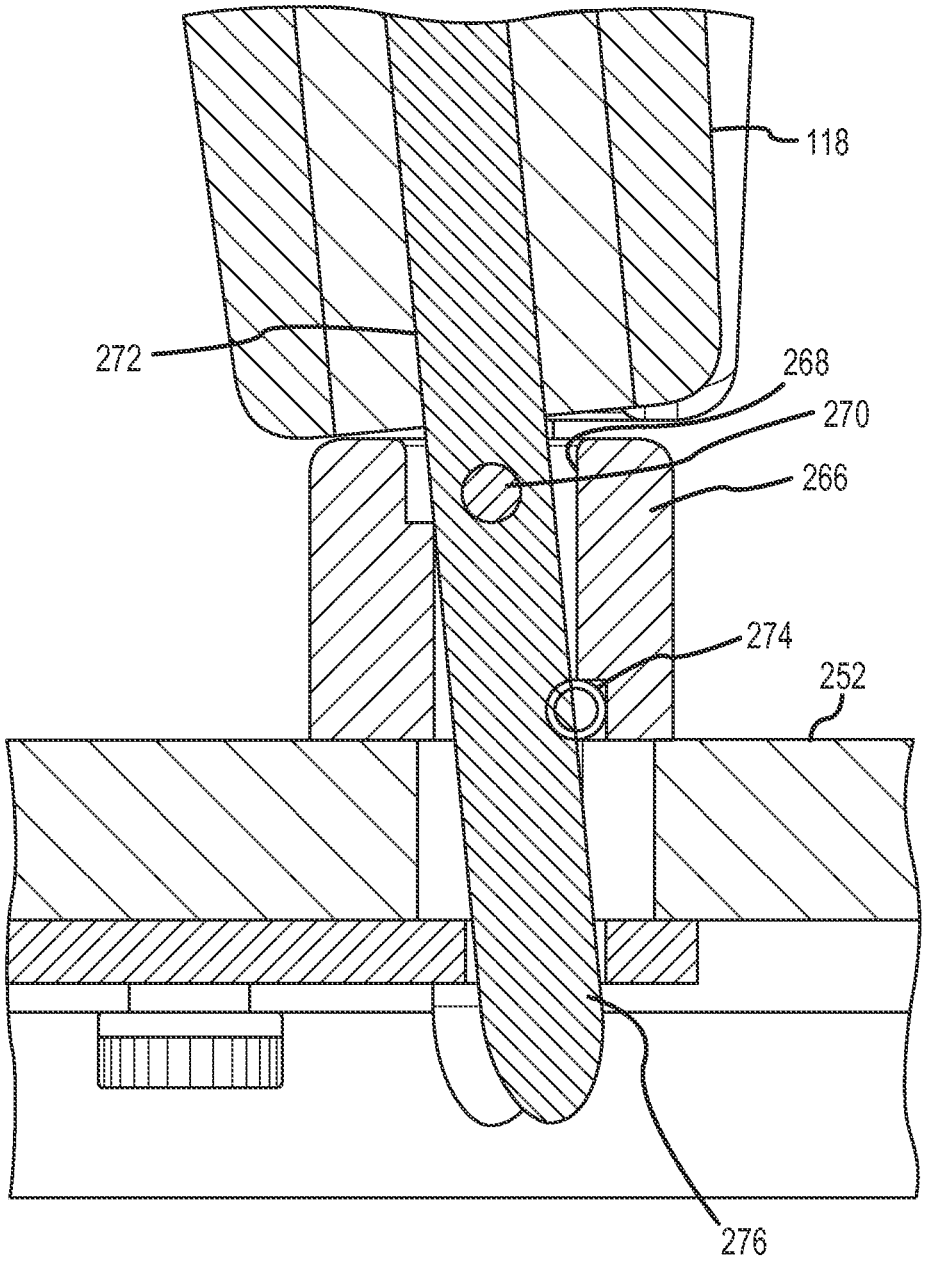
FIG. 15 is a sectional view through the carriage taken along the line 15-15 in FIG. 14.

FIG. 15 is a partial vertical sectional view through the carriage 110 with the padded upper platform 254 not shown. As can be seen in this view, the cross pin 270 acts as a pivot for the shoulder stop stem 272. A bias device 274 such as a flexible rubber tube positioned against the stem 272 provides a spring force against the stem 272 to maintain the stem 272 oriented vertical and flush with the left side of the bore 268. However, when a user pulls on the top of a shoulder stop 118 toward the foot end of the frame 102, (as is shown) the stop rotates about the cross pin 270, compressing the bias device 274, and pushing a bottom end 276 of the stem 272 toward the head end of the frame 102 (to the right in FIG. 15).

Figure 13:
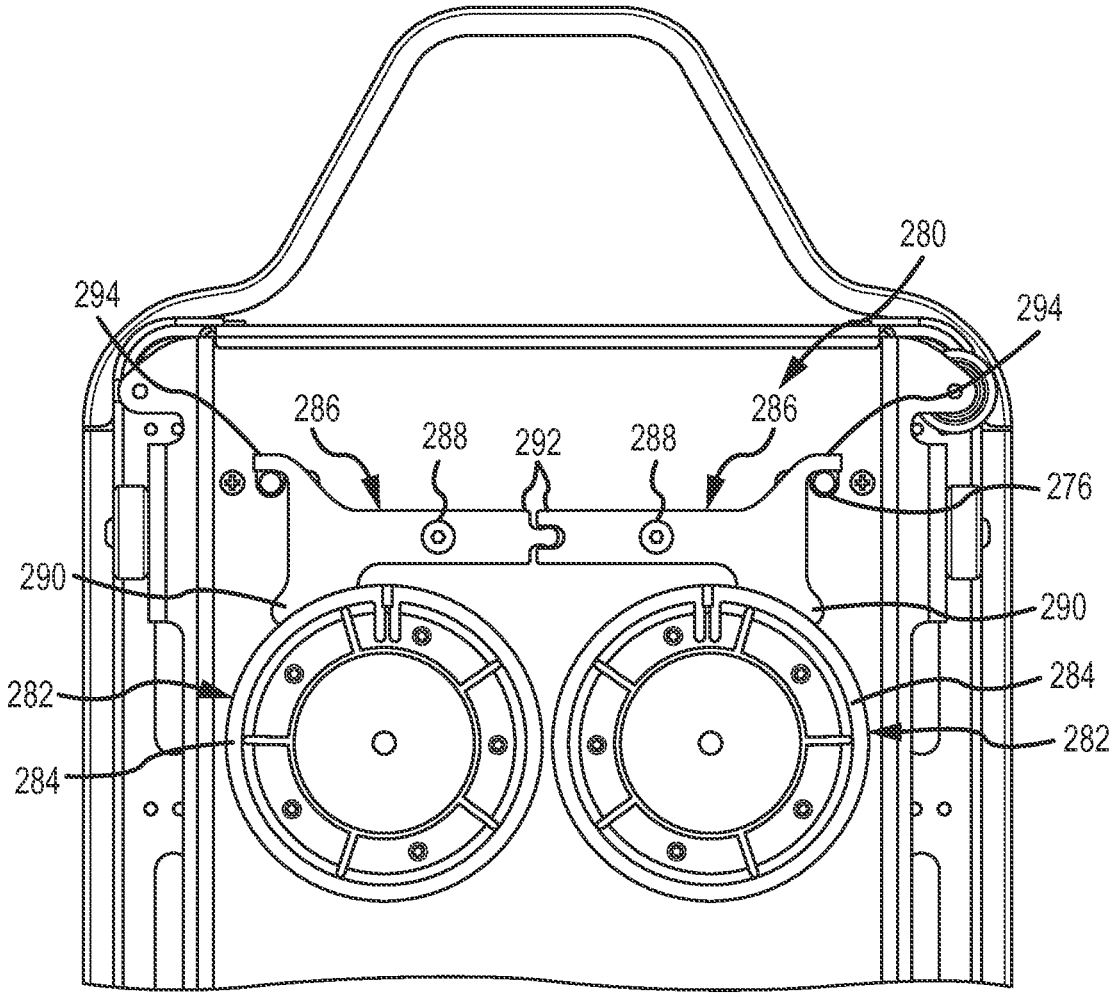
FIG. 13 is a bottom plan view of the head end portion of the carriage shown in FIG. 1 in accordance with the present disclosure showing the cord retraction mechanism latch members engaged with the cord retraction reels.
Figure 14:
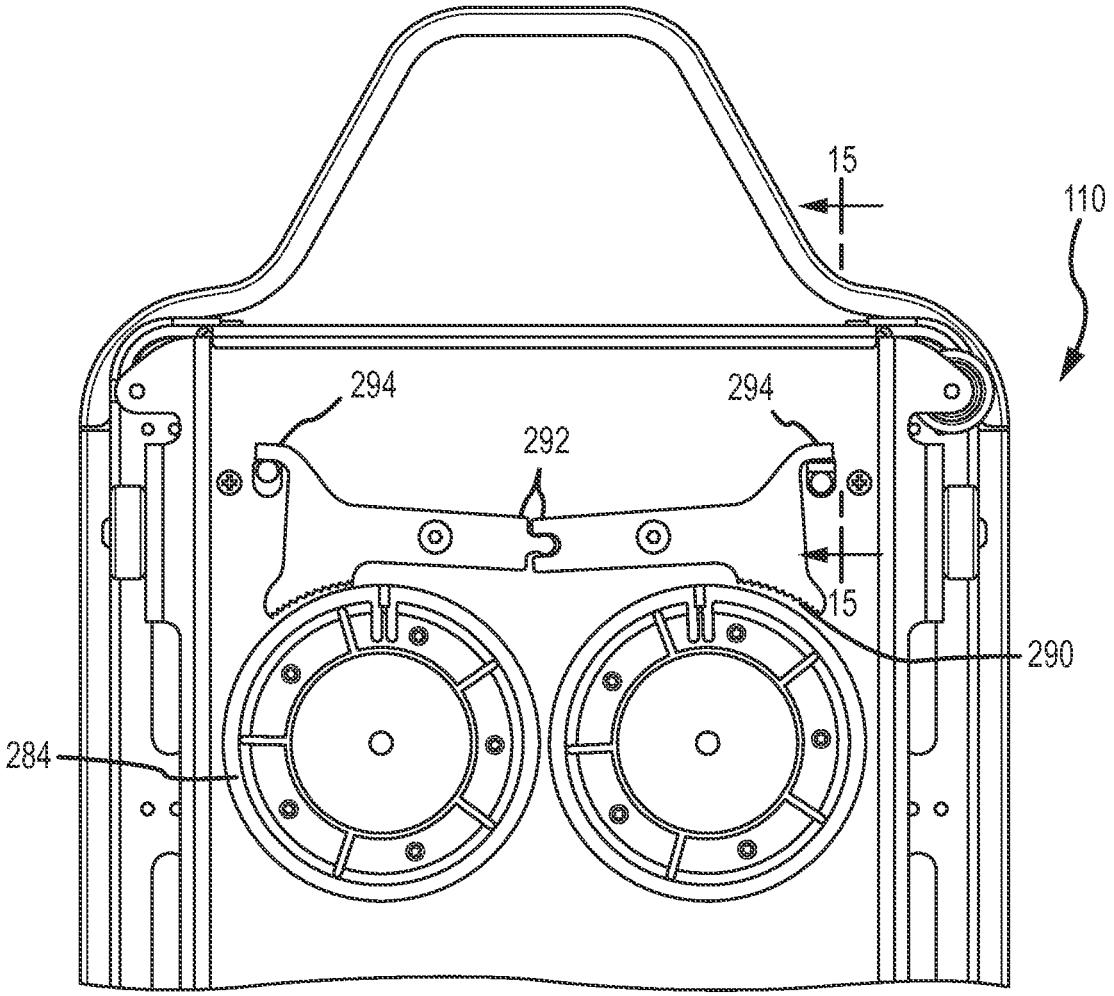
FIG. 14 is a bottom plan view of the head end portion of the carriage as in FIG. 13 with the latch members disengaged with the cord retraction reels.

A bottom plan view of a head end portion of the carriage 110 is shown in FIGS. 13 and 14. These two views illustrate the configuration of the cord retraction mechanism 280 in accordance with an embodiment of the present disclosure. The arm cords 114 are not shown in this view for clarity. The cord retraction mechanism 280 includes, for each cord 114, a spring biased reel housing 282 fastened to the support plate 252, a spring biased cord reel 284 rotatably carried in the housing 282, and a toothed plate latch arm 286 rotatably fastened to the underside surface of the support plate 252 adjacent to the reel housing 282.

As is shown in FIGS. 13 and 14, the two housings 282 of the cord retraction mechanism 280 are mounted side by side against the underside surface of the platform 252. The two latch arms 286 are preferably plate members fastened for rotation about pivot pins 288 adjacent the reel housings 282 so that they can rotate in the plane of the underside surface of support platform 252. Each latch arm 286 is preferably an elongated plate shaped body having a toothed end 290 and an opposite linkage end 292. The latch arms 286 are preferably mirror images of each other such that the opposite linkage ends 292 of each latch arm plate 286 movably engage each other to link the latch arms 286 together under the support platform 252.

The toothed end 290 of each latch arm 286 engages corresponding notches of features in a rim of the adjacent cord reel 284 in the adjacent reel housing 282. The toothed end 290 of each latch arm 286 also has a hook 294 that engages with the bottom end 276 of the stem 272 of the shoulder stop 118. FIG. 13 shows the shoulder stops 118 in a normal position, and thus the bottom ends 276 of the stems 272 are not engaged with the hooks 294 of either latch arm 286. One or more springs (not shown) are used to bias both latch arms 286 into engagement with the reels 284. With the arms 286 in this position, the arm cords 114 cannot be retracted or extended from the reels 284. They are locked.

FIG. 14 shows the configuration when the left bottom end 276 of stem 272 of the right shoulder stop 118 is engaged with the hook 294 on the left latch arm 286. This causes the latch arm 286 to rotate clockwise about pin 288, pulling the toothed end 290 out of engagement with the left reel 284 in FIG. 14. At the same time, clockwise rotation of the left latch arm 286 caused counterclockwise rotation of the right latch arm 286 through the linked linkage ends 292. This rotation similarly causes the toothed end 290 of the right latch arm 286 to rotate out of engagement with its adjacent reel 284. Thus a user pulling either shoulder stop 118 toward the foot end 106 of the frame 102 will cause both of the latch arms 286 to disengage from the reels 284, permitting a user to adjust either or both arm cord lengths as desired. Upon release of the shoulder stop 118, the latch arms 286 re-engage the reels 284 to lock the reels and thus the arm cords 114 to the carriage 110.

A retrofit arm cord retraction mechanism kit for a conventional reformer is also envisioned in accordance with the present disclosure. Such a kit would include appropriate installation instructions, two reel housings 282 with enclosed arm cord reels 284, a pair of latch arms 286, replacement shoulder stops 118, two shoulder stop supports 266, and a pair of pivot pins 288 for fastening the latch arms 286 to the carriage.

Figure 16:
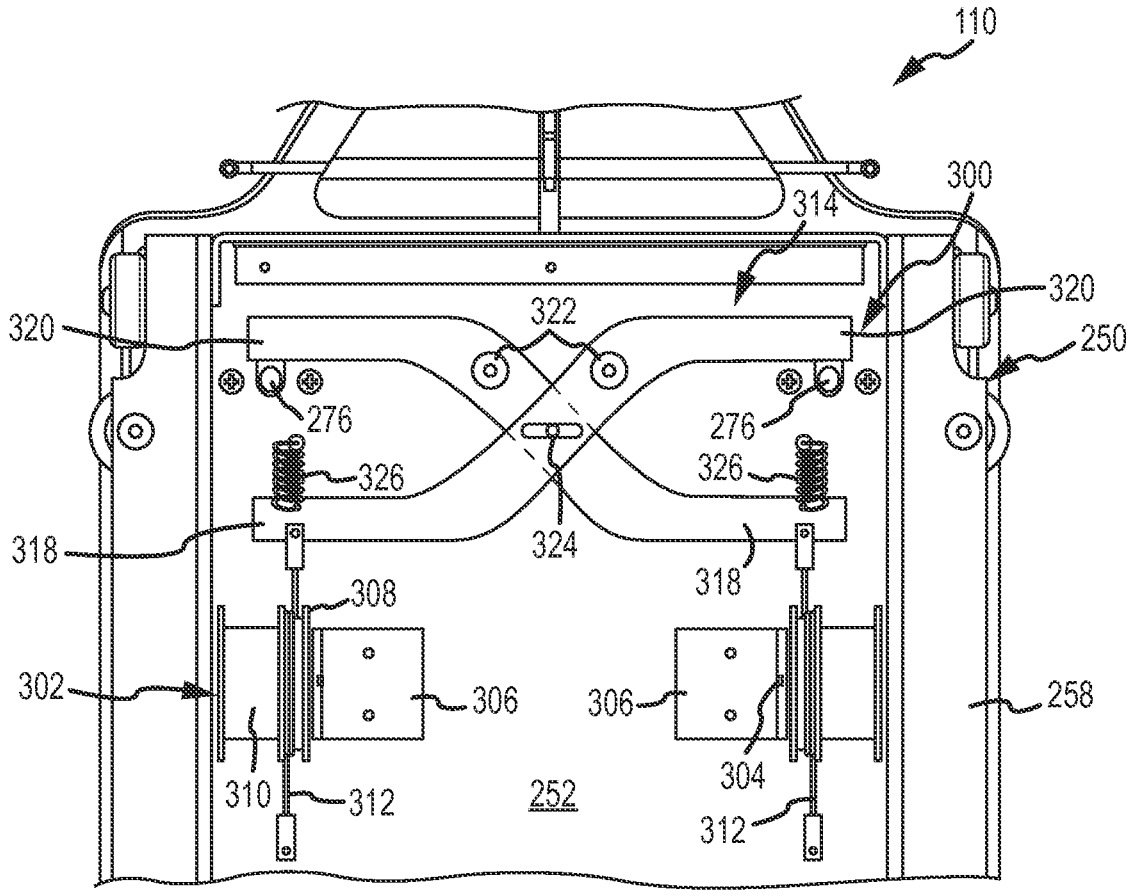
FIG. 16 is an underside perspective view of a carriage having a cord retraction system in accordance with an alternative embodiment of the present disclosure.
Figure 17:
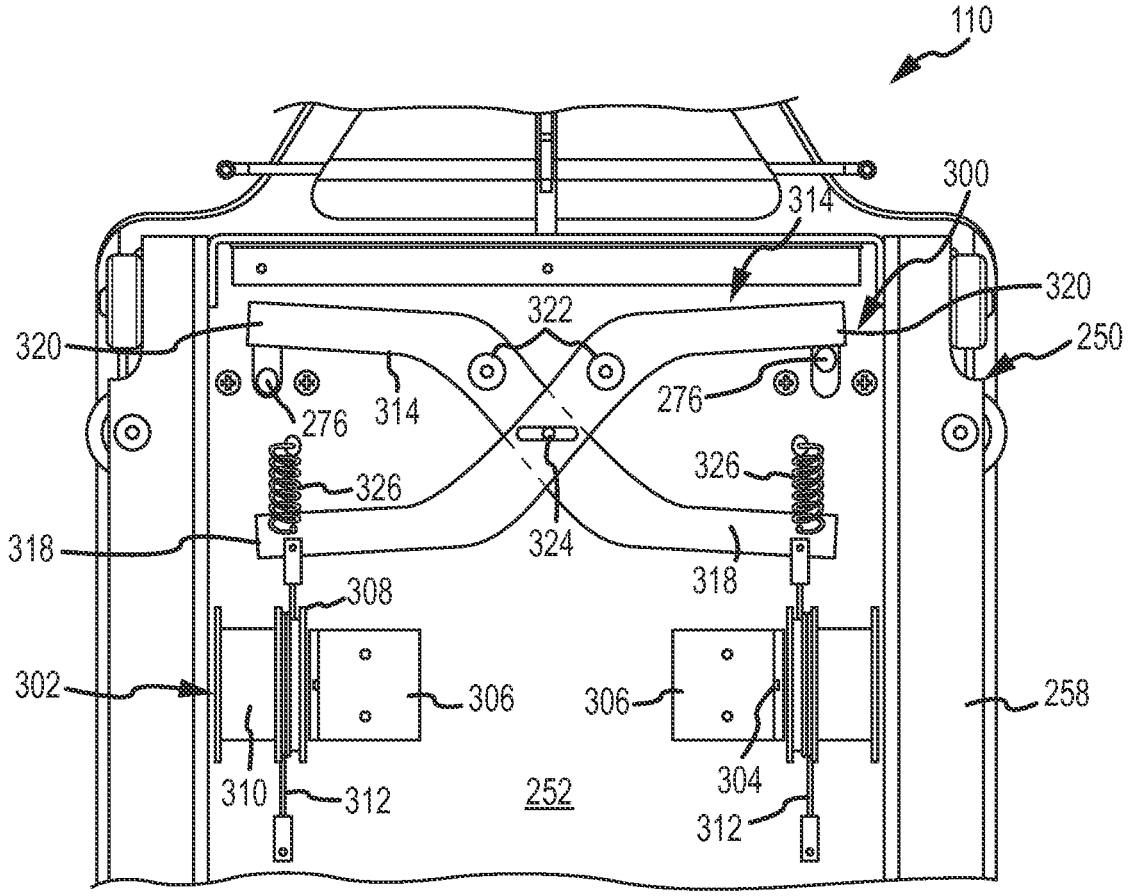
FIG. 17 is an underside view as in FIG. 17 showing the cord retraction system in a released position.
Figure 18:
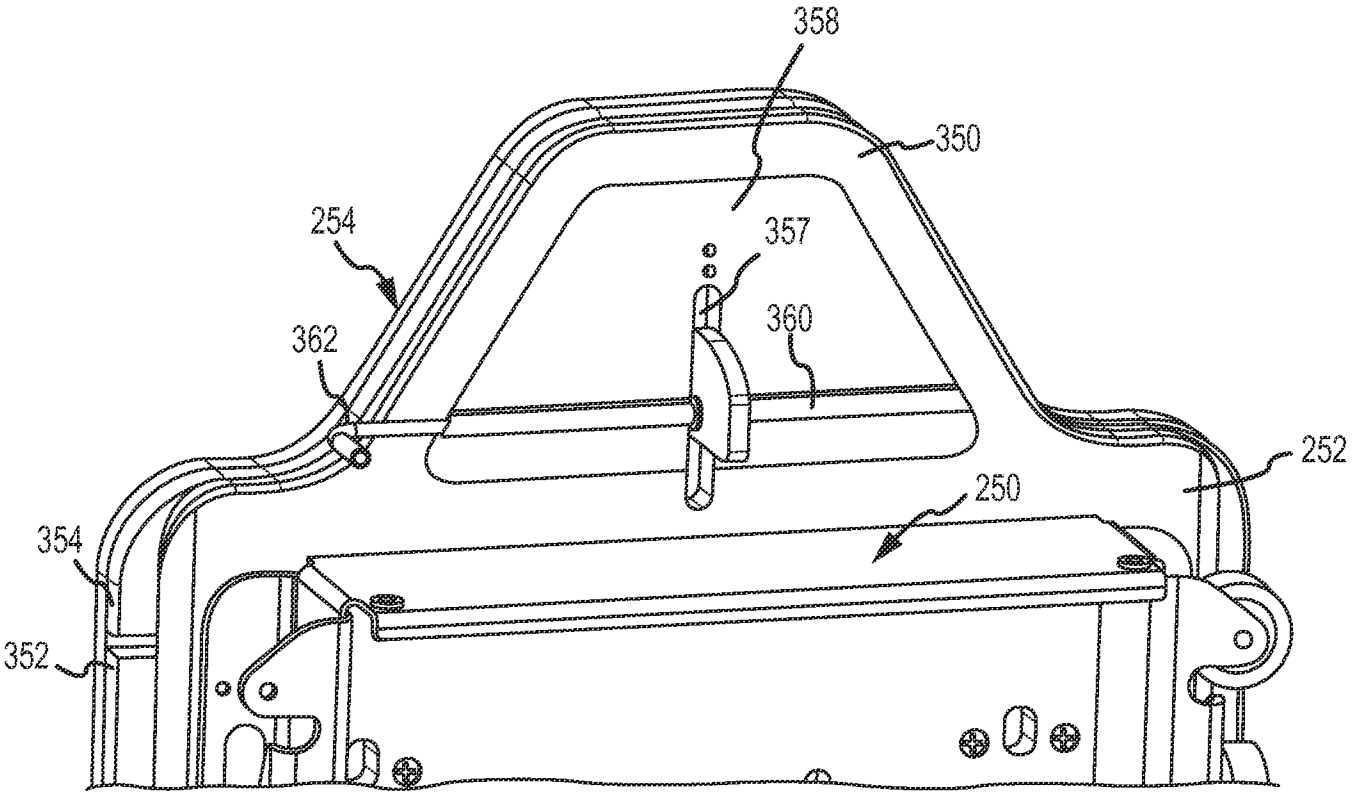
FIG. 18 is an underside perspective view of the head end of an alternative carriage in accordance with the present disclosure.

FIGS. 16 and 17 illustrate an alternative cord retraction mechanism 300 mounted beneath the carriage 110 in accordance with the present disclosure. The arm cords 114 again are not shown in this view for clarity. The cord retraction mechanism 300 includes, for each cord 114, a spring biased cord reel 302 that is mounted beneath the support plate 252 for rotation, in this embodiment, about a horizontal axle 304 supported from the support plate 252 between a bracket 306 and the carriage frame side support plate 258. The cord reel 302 has a band brake portion 308 and a cord support portion 310. One end of the cord 114 (not shown) is fastened to and wrapped around the cord support portion 310 of the reel 302. As is shown in FIGS. 16 and 17, the two reels 302 of the cord retraction mechanism 300 are rotatably mounted side by side beneath the underside surface of the platform 252.

Around the band brake portion 308 of each reel 302 is wrapped a cable 312 that has one end fastened to the support plate 252 and the other end fastened to one end 318 of a pair of crossed lever arms 314. The other end 320 of each lever arm 314 is positioned to engage the bottom end 276 of the stem 272 of one of the shoulder stops 118 as in the previously described embodiment.

Similar to the previously described embodiment of the retraction mechanism 280, the two lever arms 314 are preferably separate members each fastened for rotation about a separate pivot pin 322 and are crossed and rotatably fastened together in scissor fashion at a common pin 324 so that they can rotate about the pins 322 and 324 in a plane parallel to the underside surface of support platform 252.

During normal reformer operation the end 318 of each lever arm 314 is under tension by as spring 326. This spring 326 pulls the lever arm 314 toward the head end of the carriage 110 and thus pulls the cable 312 so as to tighten the cable 312 around the band brake portion 308 of its reel 302 to prevent rotation of the reel 302. When a user on the reformer 100 pulls (tilts) one of the shoulder stops 118 toward the foot end 106 of the reformer frame 102, both of the lever arms 314 rotate in opposite directions about the pivot pins 322 and 324 so as to release tension on the brake cables 312 as is shown in FIG. 17. When the brakes are thus released, a user can withdraw more cord 114 or permit an internal spring in the reel 302 to rotate the reel 302 and take up slack in the cord 114. When the user releases the shoulder stop 118, the springs 326 again pull on the cables 312 to stop rotation of the reels 302 and thus secure the cords 114 to the carriage 110.

Again, a retrofit arm cord retraction mechanism kit for a conventional reformer is also envisioned in accordance with the present disclosure for this alternative retraction system 300. Such a kit would include two retraction reels 302, axles 304 and brackets 306, band brake cables 312, a pair of crossed lever arms 314, springs 326, replacement shoulder stops 118, two shoulder stop supports 266, and a pair of pivot pins 322 for fastening the lever arms 314 to the carriage 110, and appropriate installation instructions.

In an optional configuration of the reformer carriage 110 in accordance with the present disclosure, an adjustable headrest may be integrated into the structure. A partial bottom view of the head end of this alternative embodiment of the carriage 110 is shown in FIGS. 18, 19, 20 and 21. In this embodiment, on top of the carriage frame 250, the support plate 252 has a trapezoidal shaped extension portion 350 that extends toward the head end of the frame 102. The padded upper plate 254 has the same overall shape as in the first embodiment shown in FIG. 12, but is separated into a rectangular portion 352 and a head rest portion 354 by a transverse hinge 356 beneath the padding near the shoulder stops 118.

Figure 19:
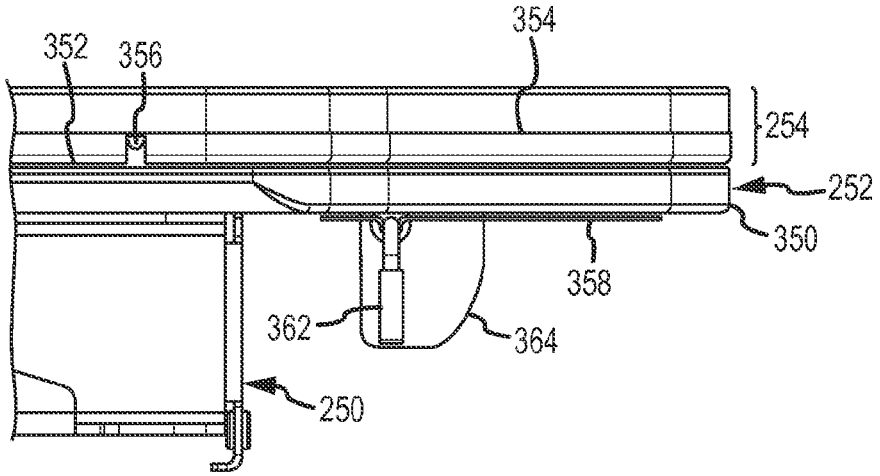
FIG. 19 is a side view of the head end of the carriage shown in FIG. 18.
Figure 20:
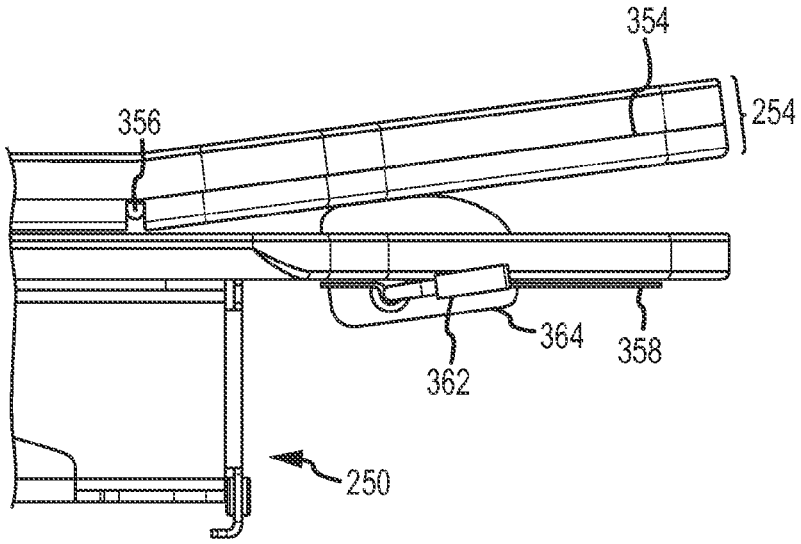
FIG. 20 is a side view of the head end of the carriage shown in FIG. 18 with the headrest in a first raised position.
Figure 21:
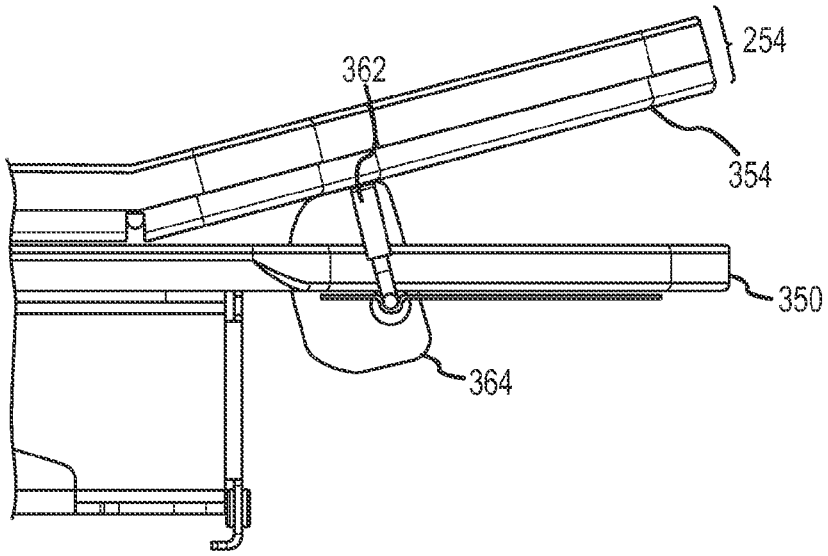
FIG. 21 is a side view of the head end of the carriage shown in FIG. 18 with the headrest in a second raised position.

An adjustable headrest support plate 358 is fastened to the support plate 252 under the head rest portion 354. The extension portion 350 has an elongated vertical slot 357 therethrough preferably centered between the sides of the extension portion 350. The support plate 358 has a transverse channel 360 therein that carries an L shaped headrest adjustment rod 362 sandwiched between the channel 360 and the extension portion 350. Attached to the rod 362 is a cam block 364 that extends through the slot 357. Rotation of handle portion of the rod 362 forces the cam block 364 to rotate against the hinged head rest portion 354. As the cam block 364 is rotated by rotation of the rod 362, the head rest portion 354 is moved between the positions shown in FIGS. 19-21. In particular, FIG. 19 shows the headrest portion 354 in a down position. FIG. 20 shows the headrest portion 354 in a first raised position, with the rod 362 rotated about 90 degrees counterclockwise. FIG. 21 shows the headrest portion in a second raised position with the rod 362 rotated an additional 90 degrees counterclockwise. In this embodiment, cam block 364 provides three stable positions. Also, note that in FIGS. 16 and 17, the head rest adjustment rod (not numbered) is shown with two handle ends rather than only one as in FIGS. 18-21. Other configurations also are well within the scope of this disclosure. For example, the cam block 364 may be smoothly curved without flat portions for specific headrest elevations and the rod 362 may be configured to provide a frictional hold such that the headrest portion 354 may be held at any desired elevation. Alternatively, the cam block may be configured with four or more flat regions, each corresponding to a different raised height.

Figure 22:
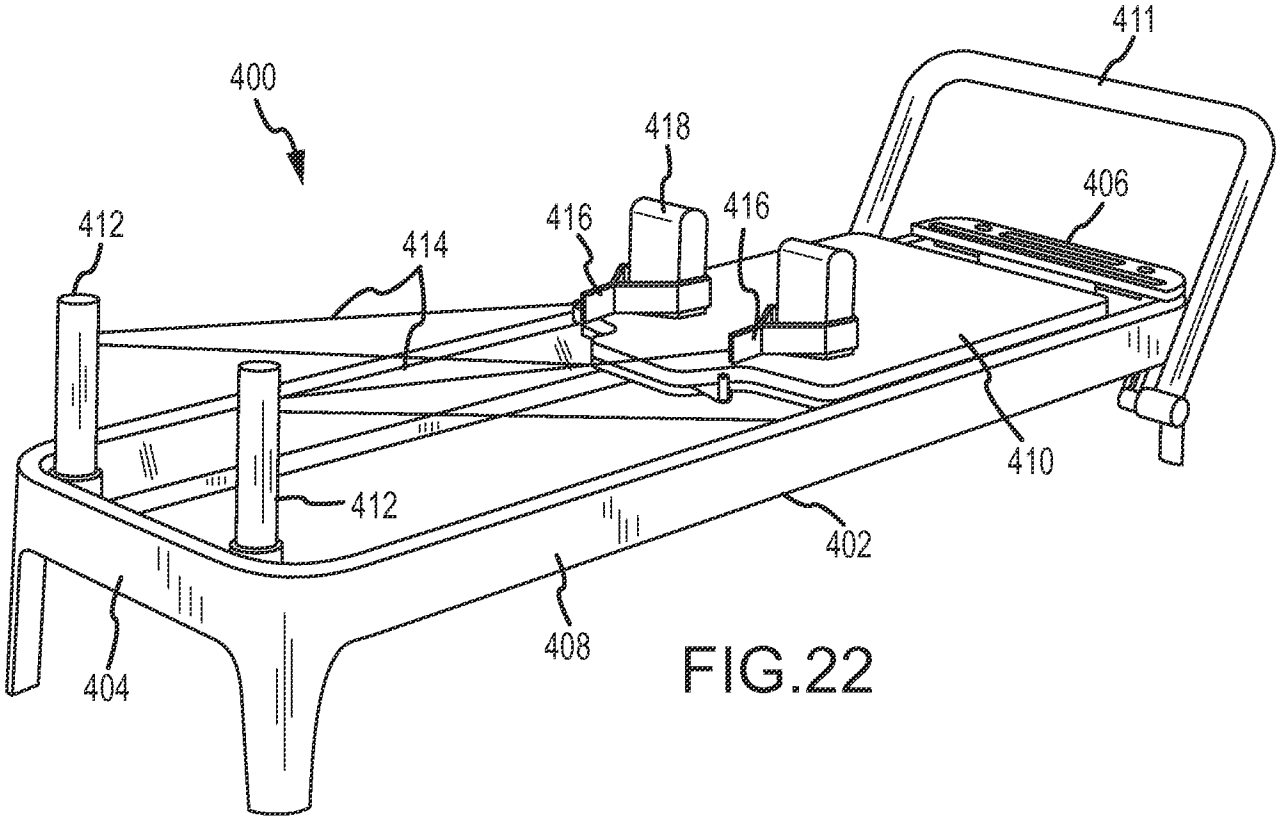
FIG. 22 is head end perspective view of an alternative reformer in accordance with the present disclosure.

A perspective view of another embodiment of a reformer exercise apparatus 400 in accordance with the present disclosure is shown in FIG. 22. The apparatus 400 has a generally rectangular frame 402 with a head end 404 and a foot end 406. The ends 404 and 406 are spaced apart by a pair of rail members 408. A carriage 410 is movably supported on the rail members 408 for movement back and forth between the ends 404 and 406 of the frame 402.

A foot bar 411 is positioned near the foot end 406 of the frame 402. This foot bar 411 is carried by the rail members 408 as will be described in detail below. The head end 404 of the frame 402 preferably supports a removable pair of spaced upright arm cord support risers 412. These risers 412 direct arm cords 414 from the carriage 110 to cord end loops 416 or grips for a user's hands for use in various exercises. When not in use, the end loops 416 may be conveniently positioned on the shoulder stops 418 as shown in FIG. 22. The carriage 410 is resiliently biased toward the foot end 416 of the frame 402 by one or more elastic members such as springs 420 (see FIG. 35).

The exterior of the frame 402 has the same shape as frame 102 shown in FIG. 2. Each of the head end 404, the foot end 406 and the side rail members 408 has a similar outer surface shape that smoothly merge together.

Figure 23:
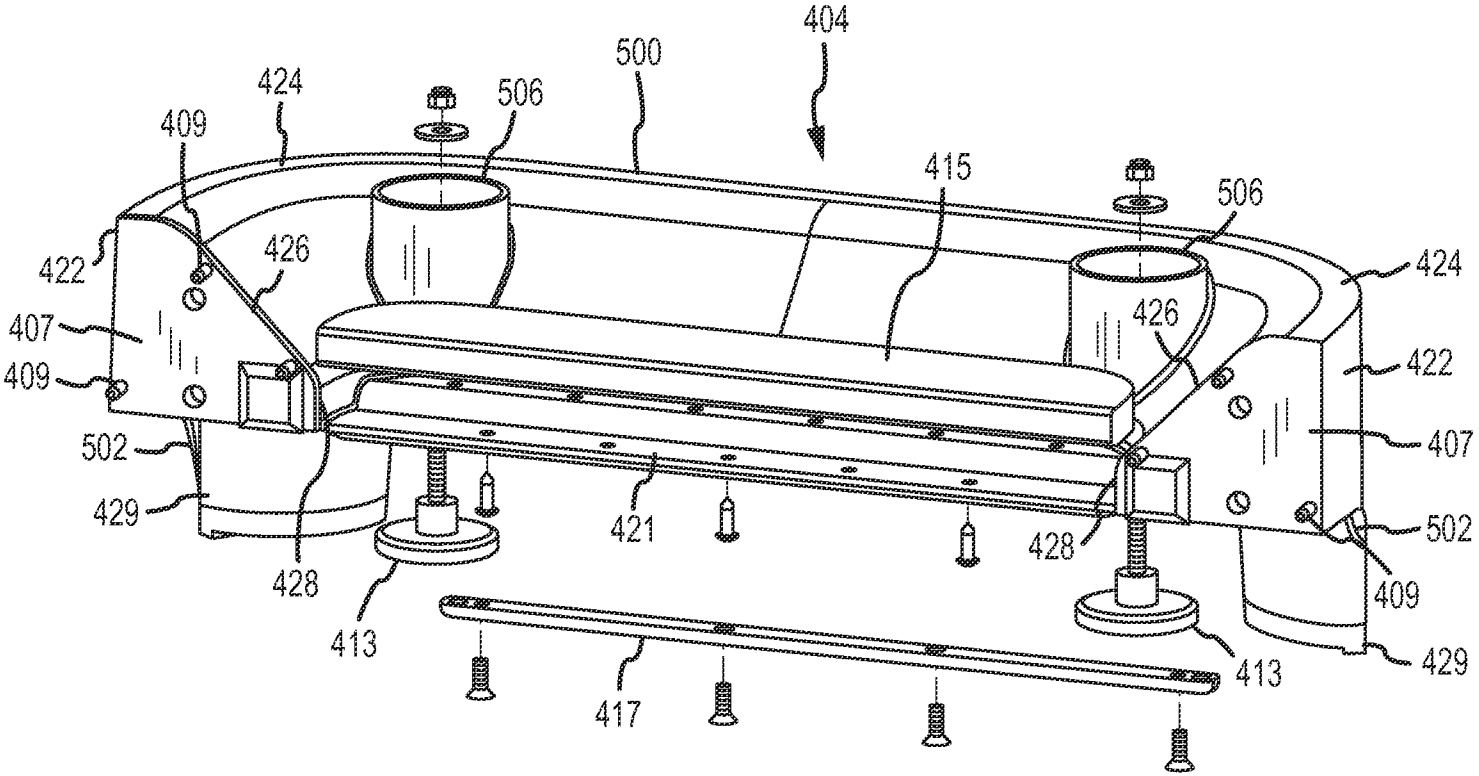
FIG. 23 is an inside separate exploded view of the head end assembly of the alternative reformer shown in FIG. 22.

A separate inside perspective view of the head end assembly 404 is shown in FIG. 23. The head end assembly includes an end extrusion 500 that has leg portions 502 and a horizontal stepped support plate 421. The external shape of the extrusion 500, as in the first embodiment, includes an outer upright wall 422 merging with a horizontal top wall 424 which merges with a downwardly and inwardly slanted inner wall 426. The inner wall 426 merges into a vertical skirt portion 428. The vertical skirt portion 428 joins with the horizontal stepped support plate 421.

Both the head and foot ends 404 and 406 have outer end plates 407 that mate with and are attached to the side rail members 408 via alignment pins 409 and threaded connections (not shown). The head end 404 extrusion 500 further includes vertical tubular bosses 506 adjacent the curved corners for receiving the risers 412. A pair of threaded hand bolts 413 inserted from beneath secure the risers 412 into the bosses 506. A standing platform 415 is fastened over and onto the stepped support plate 421.

Extending downward from each curved end of the extrusion 500 is a complementary shaped upright support leg 429. These support legs 429 are used to place the ends 404 and 406 of the frame 402 on a planar surface such as a floor. The support legs 429 may be interchanged with longer or shorter support legs to change the height of the apparatus 400 above a floor support surface. A grip strip 417 is fastened to the outer lower edge of the outer wall 407 of the extrusion 500 to provide a rounded hand gripping edge for ease of carrying the head end of the reformer 400.

Figure 24:
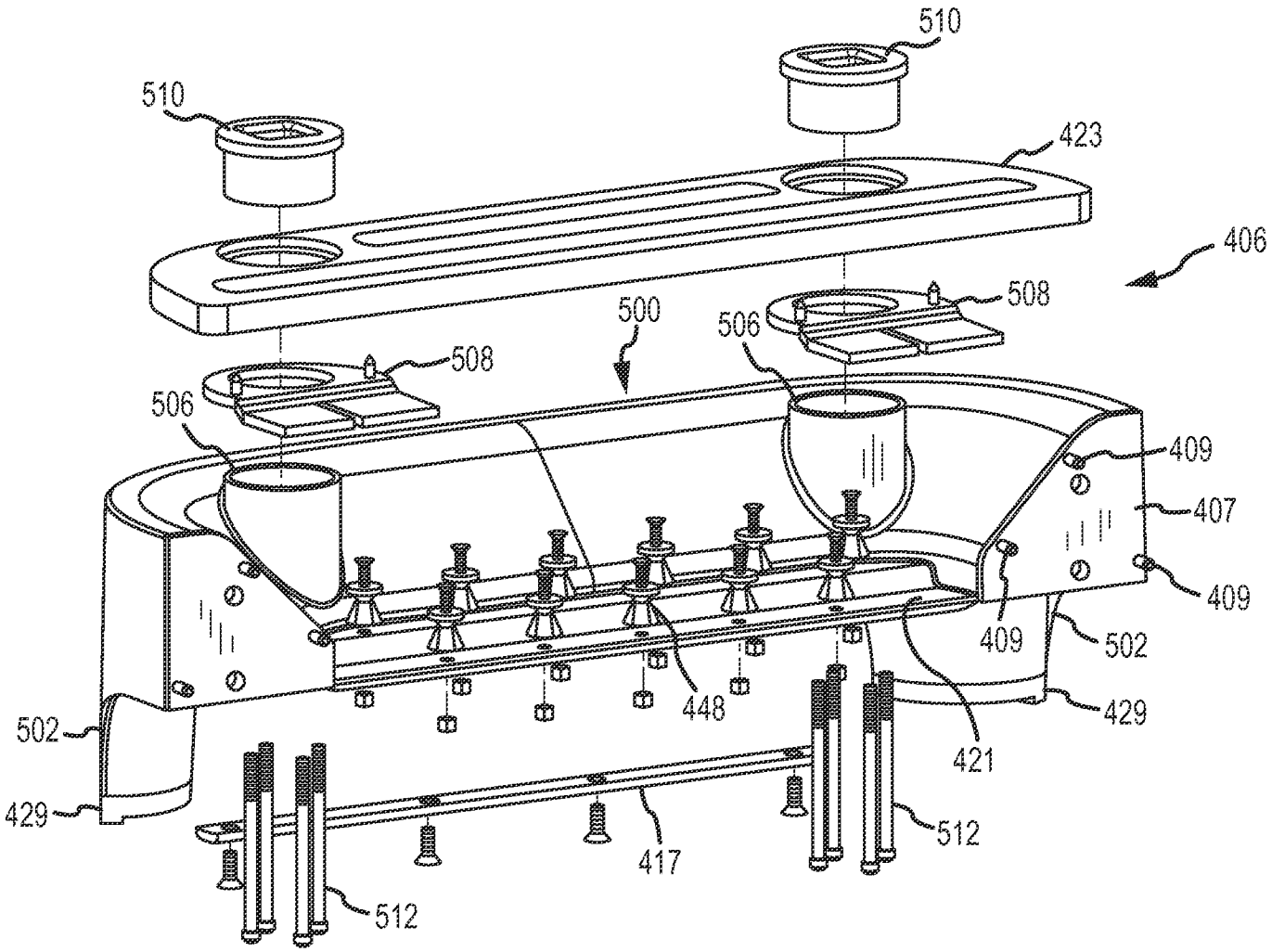
FIG. 24 is an inside separate exploded perspective view of the foot end assembly of the alternative reformer shown in FIG. 22.

FIG. 24 is a perspective view of a foot end assembly 406 of the frame 402. The foot end assembly 406 is another extrusion 500 that has leg portions 502, bosses 506 and a horizontal stepped support plate 421. Two rows of spool shaped anchor pins 448 are fastened to the plate 421. These pins 448 each can receive and hold a loop on one end of a spring 420 in order to fasten the spring 420 to the foot end 406 of the frame 402 while the other end of the spring 420 is fastened to the carriage 410. Each of these pins 448 preferably tapers upward and inward from its base to a waist at a first angle from the pin's central axis and then outward at a second angle greater than the first angle so that the free end of a spring placed on the pin 448, when under tension, is securely held at the waist of the pin 448. This second angle is preferably at least twice that of the first angle.

The foot support bosses 506 are vertical tubes formed in the extrusion 500. Each boss 506 receives a yoke 508 that fits on the top of the boss 506. A rectangular standing platform plate 423 is pinned onto the yokes 508. Finally a tubular receiver 510 fits through holes in the plate 423 and fits into the bosses 506 to secure the plate 423 to the extrusion 500. A set of bolts 512 fasten each receiver 510, plate 423, and yoke 508 to the boss 506. The receivers 510 receive legs of a removable flat jump board platform (not shown).

Figure 25:
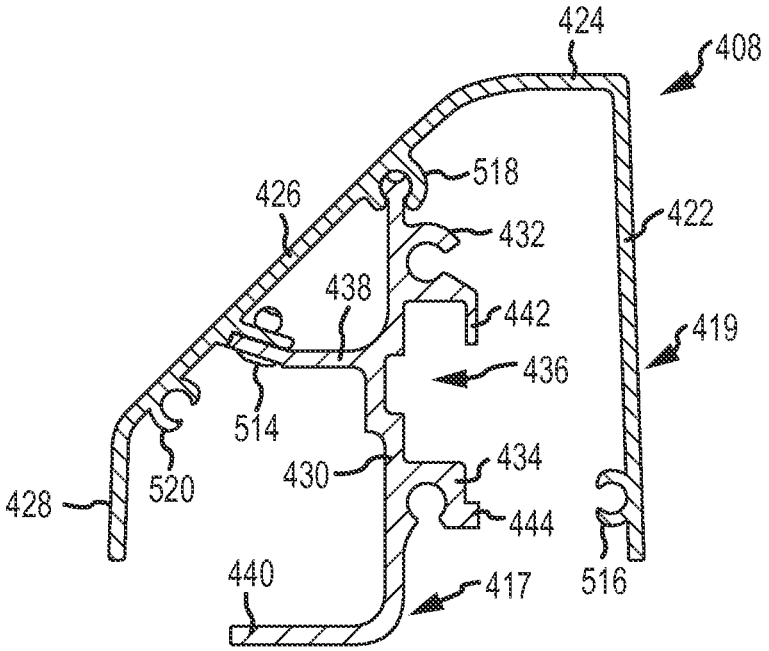
FIG. 25 is a cross sectional view of one of the two frame side rails in the alternative reformer shown in FIG. 22.

A sectional view of a side rail member 408 is shown in FIG. 25. Each rail member 408 is preferably an aluminum extrusion assembly having an identical cross sectional shape. In this particular reformer embodiment 400 the rail member 408 is a composite extrusion formed by two separate extrusion portions: inner portion 417 and outer portion 419 that are joined together by rivets 514. This construction of the side rail member 408 is particularly advantageous for at least two reasons. First, such a configuration is easier to extrude as two separate extrusions that are later joined. Second, the outer portion 419 may be finished differently than the inner portion 417. Thus one version of the outer portion 419 may be either powder coated for durability and/or painted in selectable colors while the inner portion 417 is powder coated or otherwise finished for durability, since it is not in view. Furthermore, the inner portion 417 since it also contains the rolling surfaces and index rail feature for the foot bar 411, may be separated and replaced if required due to wear. The rail member 408, as mentioned above, has an outer upright wall 422 that merges into a horizontal top wall 424 and then into a downwardly slanted inner wall 426 and then into a vertical skirt portion 428. The end members 404 and 406 have the same exterior shape, but differ internally from the side rail members 408.

As is shown in FIG. 25, each side rail member 408 has a vertical mid wall 430 between the slanted inner wall 426 and the upright outer wall 422. The mid wall 430 has an outwardly facing upper longitudinally extending boss 432 and a lower outwardly facing longitudinally extending boss 434 parallel to the upper boss 432. Together the mid wall 430, the upper boss 432 and lower boss 434 form an outwardly open slot 436 therebetween. This slot 436 receives and carries one of the foot bar support assemblies therein as will be described in detail below. Between the mid wall 430 and the slanted inner wall 426 is an upper horizontal support wall 438. The support wall 438 extends the length of the rail member 408 and provides tortional rigidity to the structure of the rail member 408. Furthermore, this support wall 438 facilitates joinder between the inner and outer extrusion portions 417 and 419. A horizontal bottom portion 440 of the mid wall 430 acts as a support for one set of wheels supporting the carriage 410. The upper wall 438 serves also as an upper guide for the carriage support wheels on the rail members 408. Furthermore, the mid wall 430 between upper and lower walls 438 and 440 and the skirt portion 428 serves as a lateral guide for the carriage 410.

The upper boss 432 preferably has a vertical portion 442 that extends downward parallel to the mid wall 430. This vertical portion 442 is used to provide lateral support for the foot support assembly described more fully below. Furthermore, the lower boss 434 may include a downwardly extending index rail 444. Alternatively, the indexing rail 444 may be installed along the length of the rail member 408 by a separate, replaceable metal indexing rail carried in the boss 434.

Finally, the inside of the outer portion 419 of the rail 408 includes three locating bosses 516, 518 and 520. These three locating bosses align with and receive the locating pins 409 projecting from the head and foot end assemblies 406 and 408, shown in FIGS. 23 and 24. These bosses help to ensure exact alignment between the rails 408 and ends 406 and 406 such that a smooth exterior frame surface is presented to a user of the apparatus 400.

Figure 5:
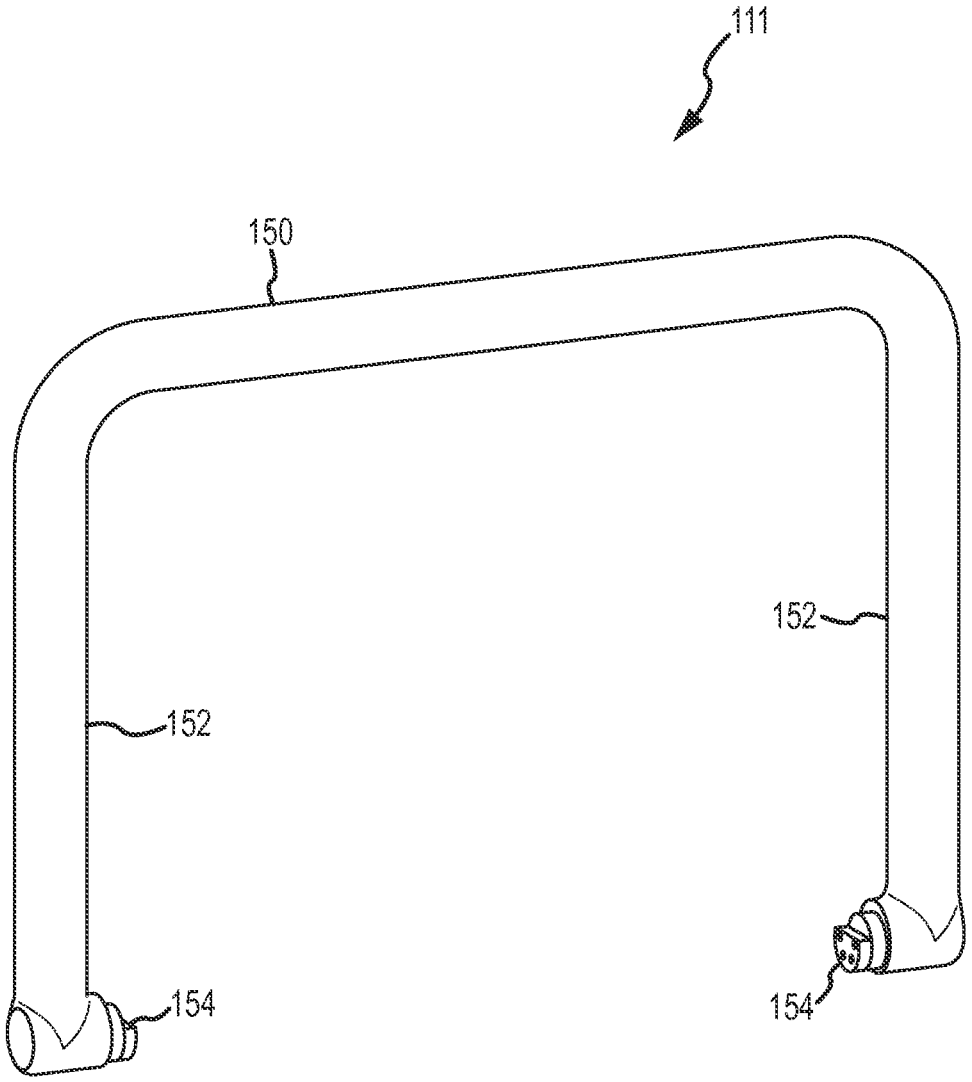
FIG. 5 is a separate perspective view of a foot bar utilized in the reformer exercise apparatus shown in FIG. 1.
Figure 29:
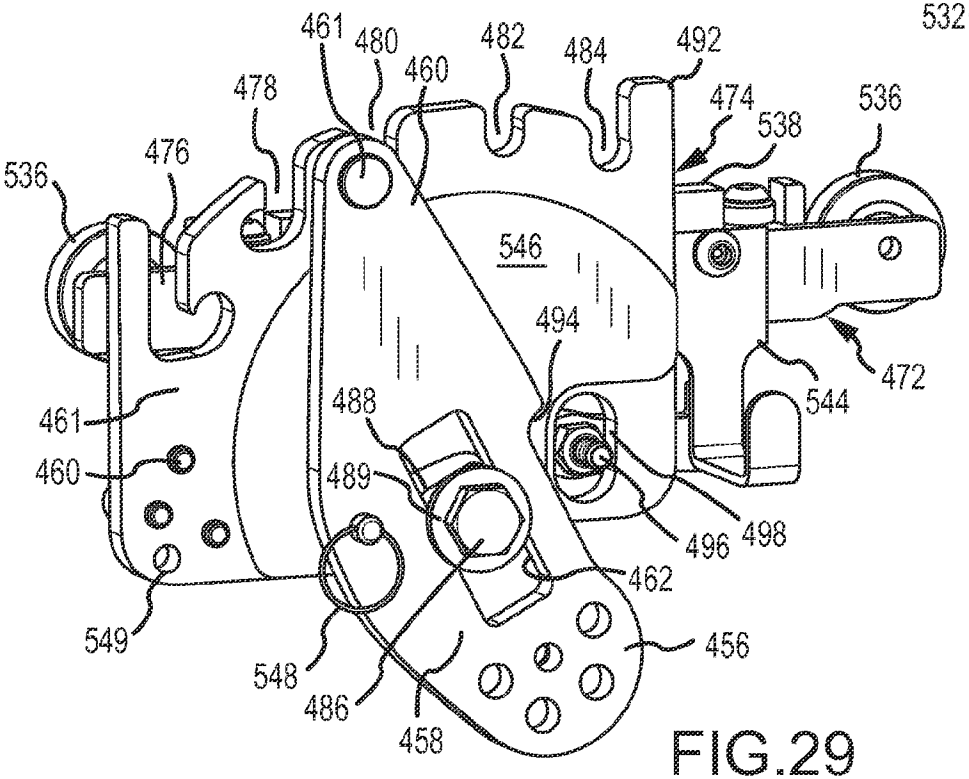
FIG. 29 is a separate inside perspective view of the foot bar support assembly utilized in the reformer shown in FIG. 22.

The foot bar 411 shown in FIG. 22 is the same as that shown in FIG. 5. The foot bar support assembly 470 is similar to but differs slightly from that shown and described above specifically with reference to FIGS. 6, 7, 8, and 9. The foot bar 411 is part of a foot support assembly 470 that cannot be seen in FIG. 22. Referring now to inner and outer views of the foot support assembly 470 shown in FIGS. 29 and 30, the connection portion 154 of the foot bar 411 is bolted or otherwise fastened to a bottom end 456 of an elongated foot bar support arm 458. The arm 458, best shown in FIG. 29, is an elongated flat plate member that has an engaging pin 461 projecting outward from the upper end 460 of the arm 458. The arm 458 further has a closed pivot slot 462 radially extending parallel to the leg portion 152 of the foot bar 411 and spaced from where the connection portion 154 of the foot bar 411 is attached to the arm 458.

Figure 30:
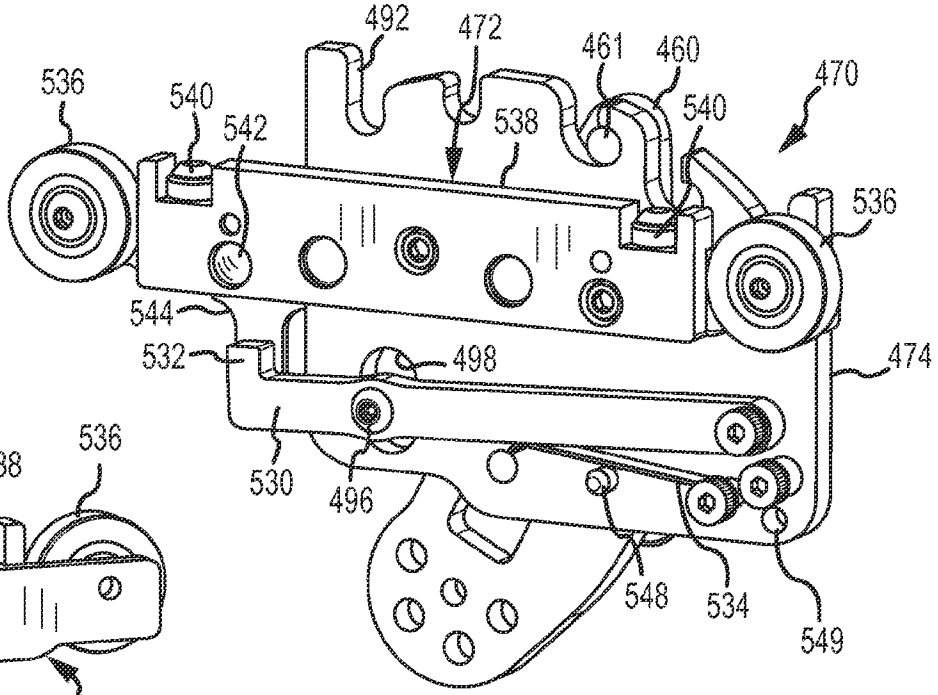
FIG. 30 is an outside perspective view of the foot bar support assembly shown in FIG. 29.

The foot support assembly of reformer 400 shown in FIG. 22 includes a left foot bar support assembly 470, the foot bar 411, and a right foot bar support assembly 470. FIGS. 29 and 30 are reverse perspective views of a right one of the foot bar support assemblies 470 in accordance with one embodiment of the present disclosure. Each leg 152 of the foot bar 411 is supported by one of the foot bar support assemblies 470. As is best shown in FIG. 29, the assembly 470 includes the foot bar support arm 458 to which the foot bar 411 (not shown in FIGS. 29 and 30) is attached, a slide portion 472 that rides in the slot 436 in the side rail member 408, and a hook plate 474 which is rigidly fastened to the slide portion 472. This hook plate 474 has a series of features, preferably slots or notches 476, 478, 480, 482 and 484 spaced along the upper edge of the hook plate 474. The pin 461 projecting outward from the upper end 460 of the foot bar support arm 458 fits within one of these notches 476-484 to position the foot bar 411 at a particular desired angular position with respect to the frame 402 of the reformer 400.

The foot bar support arm 458 is slidably and pivotally attached to the hook plate 474 by a bolt 486 and square bushing 488. A flat washer 489 on the bolt 486 holds the support arm 458 on the bushing 488. The bushing 488 rides in the pivot slot 462. Since the foot bar 411 is fastened to the arm 458, when a user lifts the foot bar 411, the support arm 458 rides up or down along the slot 462. In turn, the pin 461 projecting outward from the upper end 460 of the support arm 458 is raised out of one of the slots along the upper edge of the hook plate 474. When lifted out of its slot in this manner, a user can then rotate the foot bar 411 about the pivot bolt 486 to a different one of the slots 476, 478, 480, 482 or 484 to reposition the foot bar 411. When the foot bar 411 is lowered into a slot, the pin 461 slides down within one of the slots to fix the foot bar 411 in position.

Figure 39:
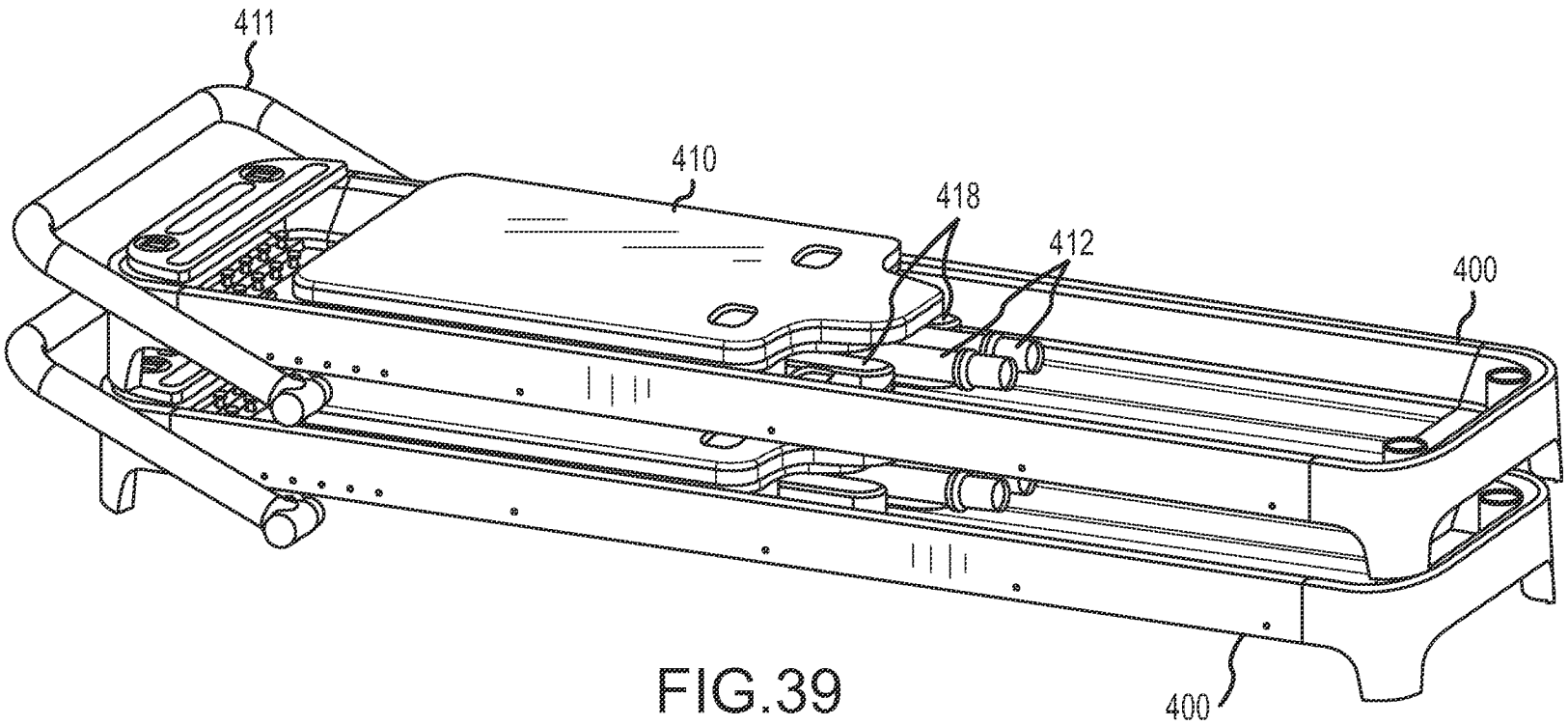
FIG. 39 is a perspective view a pair of reformers shown in FIG. 22 in a stacked configuration for storage.

The end slots or notches 476 and 484 have special significance in this embodiment 400 as in the first embodiment 100. When the foot bar 411 has both its pins 461 positioned in slots 476, the foot bar 411 is rotationally positioned slightly above, the upper surface of the frame 402 and beyond the foot end of the frame 402 as is shown in FIG. 39. In this position, the foot bar 411 may be used as a handle to lift the foot end of the reformer 400. To ensure that the foot bar 411 does not disengage from this slot 476, the terminal end of the slot 476 is hooked upward, as can be seen in FIG. 29, so as to firmly engage with the pin 461 at the closed end of the slot 476. To disengage the foot bar 411 from this slot 476, the foot bar 411 must be pushed down and pulled rearward (away from the foot end) to align the pin 461 with the widened slot entrance. The foot bar 411 may then be rotated up and lifted out of the slot 476 and repositioned in a different one of the slots 478, 480, 482 and 484.

The forward most slot 484 in the hook plate 474 is used to position the foot support assembly comprising each of the assemblies 470 and the foot bar 411 together for translation along the rail members 408. As the foot bar 411 is raised and is rotated clockwise, as seen in FIG. 29, the arm 458 is rotated about the bolt 486 clockwise until the pin 461 engages a protruding surface 492 at the forward end (toward head end 404) of the hook plate 474. In this position, a shoulder 494 on the support arm 458 engages with a latch pin 496 that projects through a slot 498 in the hook plate 474. The latch pin 496 projects through the hook plate 474 from a latch arm 530 best seen in FIG. 30. When the foot bar 411 is then lowered, the shoulder 494 of the arm 458 pushes the latch pin 496 down.

Latch arm 530 is an elongated bar that has one end rotatably fastened to the inside face of the hook plate 474. The latch arm 530 can rotate in a plane parallel to the inside surface of the hook plate 474. The other end of the latch arm 530 has an upwardly hooked latch portion 532 that engages a complementary shaped indexing feature in the rail member 408 in order to latch the assembly 470 at a selected position along the rail member 408. The latch arm 530 is spring biased upward via flat spring member 534 to maintain the latch portion 532 of the latch arm 530 engaged with the indexing feature of the index rail 444 in the rail member 408.

When the foot bar 411 is positioned with pins 461 in the slots 484, and the foot bar 411 is pushed downward to fully seat the pins 461 at the bottom of slots 484, the latch pins 496 are also pushed downward, rotating the latch arm 530 and moving latch portion 532 out of engagement with the indexing feature of the index rail 444 in the rail member 408. With the latch portions 532 disengaged with the rail members 408, the foot bar 411 may be moved toward or away from the foot end 406 of the frame 402 via the rollers 536. In fact, the foot bar 411 may be moved fully to the opposite end of the rail members 408 if desired.

The slide assembly 472 is best seen in the view of FIG. 30 which is an opposite perspective view of the foot bar support assembly 470 shown in FIG. 29 that is carried in the right side rail member 408. The slide assembly 472 includes an elongated slide plate 538 that is preferably bolted or otherwise fixed to the hook plate 474. This slide plate 538 rides in the slot 436 in the rail member 408 with the hook plate 474 and adjacent foot bar support arm 458 disposed within the free/open space between the outer wall 422 and mid wall 430 of the rail member 408. It is to be understood that another, mirror image foot support assembly 470 is disposed in the other (left) rail member 408.

Turning back now to FIG. 30, the slide plate 538 is supported in the slot 436 by front and rear support rollers 536 that roll along the bottom surface of the slot 436. A guide roller 540 that rotates about a vertical axis through the slide plate 538 is mounted preferably adjacent to each support roller 536. The guide rollers 540 roll along inner side surfaces of the slot 436 in the rail member 408 to guide the support assembly 470, and thus the foot bar 411, as it is translated (i.e., rolled) fore and aft along the rail members 408.

The support rollers 536 are preferably bearing supported polymer wheels rotatably supported on horizontal axles. The polymer wheels are sized to fit and smoothly roll within the slot 436. The guide rollers 540 may be nylon or other polymer rollers supported by a vertical axle in the slide plate 538. In this embodiment 400, the guide rollers 540 may be roller bearings mounted in recesses along the upper edge of the slide plate 538.

The slide plate 538 also has a spring loaded locating ball 542 mounted in a recess behind the j shaped indexing member 544 utilized as described above with reference to the first embodiment. The spring loaded locating ball 542 provides a user with tactile feedback when moving the foot bar 411 back and forth along the rails 408 between various predetermined positions, by projecting into corresponding depressions that optionally may be provided along the rail 408.

A low friction layer 546 of polymer sheet material (shown in FIG. 29) is affixed to the outer surface of the hook plate 474 between the hook plate 474 and the support arm 458. This layer, as in the first embodiment 100, reduces any friction between the arm 458 and the plate during rotation of the foot bar 411 between the notches 476, 478, 480 482 and 484. Alternatively, the low friction layer 546 may be applied to the facing surface of the arm 458. To further reduce friction, a low friction layer 546 may optionally be applied to both of these facing surfaces.

A removable pull pin 548 may optionally be inserted through aligned bores in the arm 458 and the plate 474 when the foot bar 411 is in the high position, i.e., slot 480. Insertion of pull pin 548 will lock the foot bar 411 in place and prevent it from being repositioned. The purpose of this is so that the foot bar 411 can act as a support brace when the reformer 400 is vertically positioned on its foot end 406. This facilitates vertical storage of a number of reformers 400 in a relatively confined space.

When the foot bar 411 is securely positioned with pins 461 seated in slots 484, the whole foot bar assembly 411 can slide/roll back and forth along the side rails 408. The plate 474 is preferably also provided with a hole 549. This hole 549 can be used to store the pull pin 548 when not being used. In addition, this hole 549 may be used to attach an elastic or spring resistance member (not shown) between the carriage 410 and the foot bar 411 support plate 474 or between the foot end 404 and the support plate 474. Such a resistance member can provide a resistance to translational movement of the foot bar 411 support assembly 470 by a user when the foot support arm 458 is engaged in slot 484. In this configuration the foot bar 411 may be used to provide additional resistances experienced by a user during performance of various movements while being supported on the carriage 410. Such a spring or other resistance member, such as an elastic cord, may be attached for this purpose between the carriage 410 and a suitable feature at a different location on the assembly 470 or to the foot bar 411 itself. For example, such a resistance member may be attached to the connection portion 154 of the foot bar leg portion 152.

Figure 26:
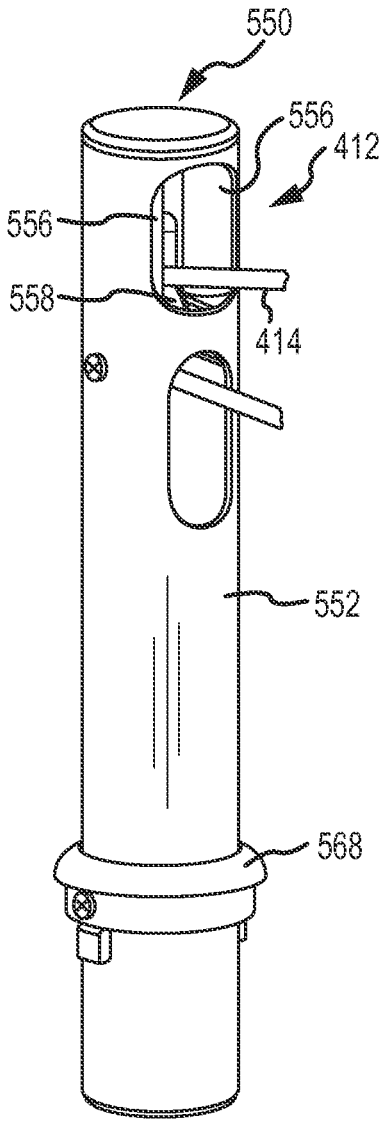
FIG. 26 is a separate assembled perspective view of a riser utilized in the reformer shown in FIG. 22.
Figure 27:
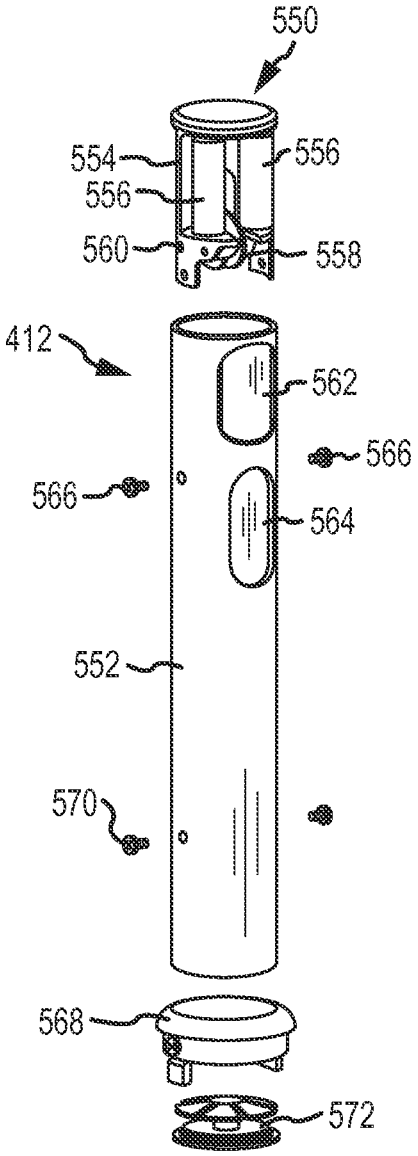
FIG. 27 is an exploded perspective view of the riser shown in FIG. 26.

Referring back to FIG. 22, at the head end 404 of the reformer apparatus 400 there are two spaced apart arm cord risers 412 for directing arm cords 414 from the carriage 410 to the head end 404 and then to the arm cord end loops 416. A separate perspective view of a riser 412 is shown in FIG. 26 and an exploded assembly view is shown in FIG. 27. In this embodiment 400, the riser 412 has no bottom pulley configuration as is utilized in riser 112. Instead, preferably a pulley and roller assembly 550 is inserted into the upper end of the riser tube 552. This pulley and roller assembly includes a support housing 554 that supports laterally spaced apart vertical rollers 556 that rotate about parallel vertical axles fastened into the housing 554, and a pulley 558 mounted between and below the rollers 556 on a horizontal axle 560. Each of the rollers and the pulley 558 is supported on its respective axle between pairs of ball bearings mounted in the support housing 554.

Each of these riser tubes 552, preferably includes two vertically aligned elongated openings 562 and 564 adjacent its upper end through which the arm cord 414 is passed. The pulley and roller assembly 550 slides into upper end of the riser tube 552 and is fastened in place with two screws 566. When properly positioned in the tube 552, the vertical rollers 556 are alongside the upper opening 562. The pulley wheel 558 is centered between the two openings. The arm cord 414 is threaded through the upper opening and down around the pulley wheel 558, and out through the lower opening 564 to the carriage 410 as is shown in FIG. 26.

Figure 28:
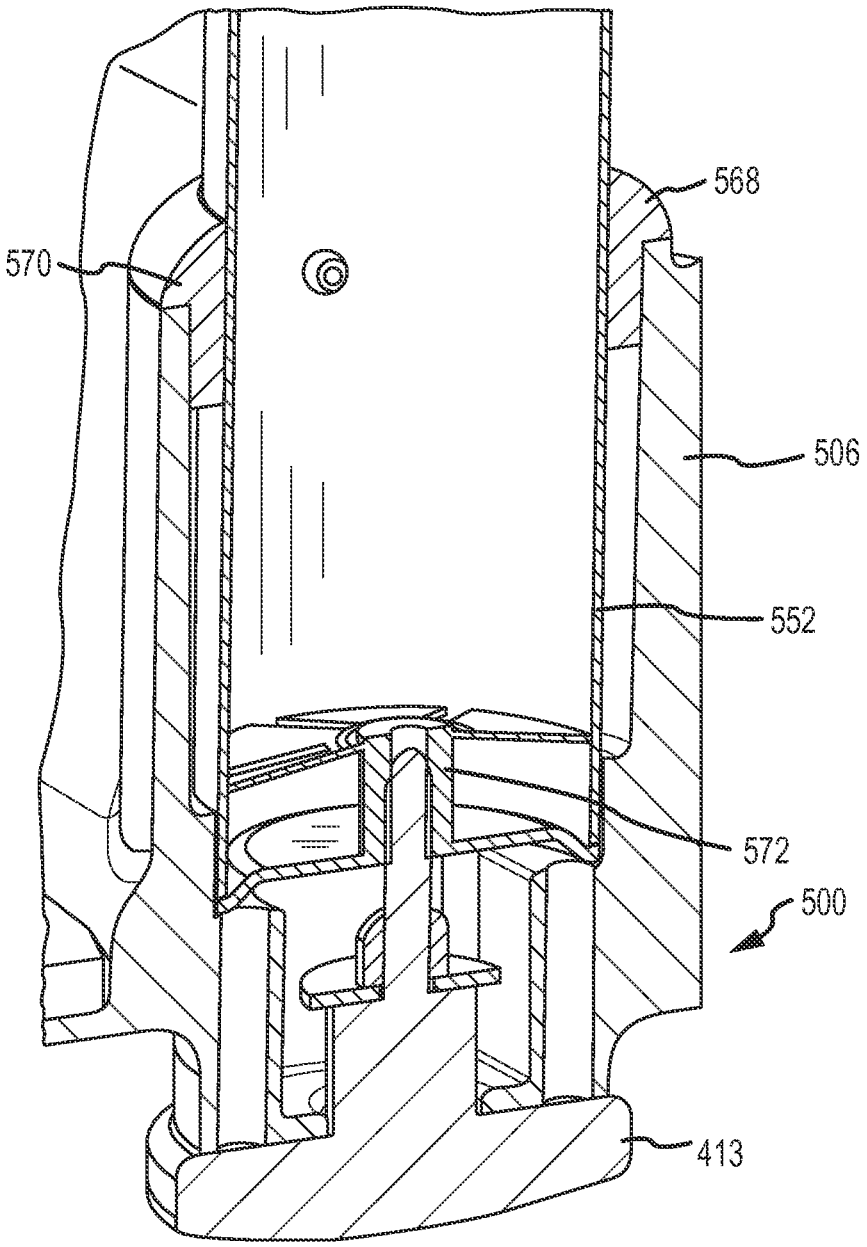
FIG. 28 is a partial sectional view of the riser shown in FIG. 26 installed in the head end socket of the reformer shown in FIG. 22.

An annular collar 568 is fastened around the lower end portion of the tube 552 via screws 570. This collar 568 is sized to snugly fit within the open upper end of the boss 506 of the head end extrusion 500 as is shown in the cutaway view in FIG. 28. A threaded expansion plug 572 is press fit into the bottom end of the riser tube 552. This threaded expansion plug 572 engages with the threaded hand bolt 413 (FIGS. 23, 28). When the hand bolt 413 is tightened, the riser 412 is pulled down into the boss 506 to secure the riser 412 in place. The riser tube 552 may alternately be made of different lengths such that different length risers 412 may be selected for different users. Finally, the lower opening 564 in the riser tube 552, besides passing the cord 414 therethrough, is used to receive part of a bracket 700 (an example of which is shown in FIG. 31) to removably hold the riser 412 beneath the head end of the carriage 410 during storage as is shown in FIG. 39.

Figure 31:
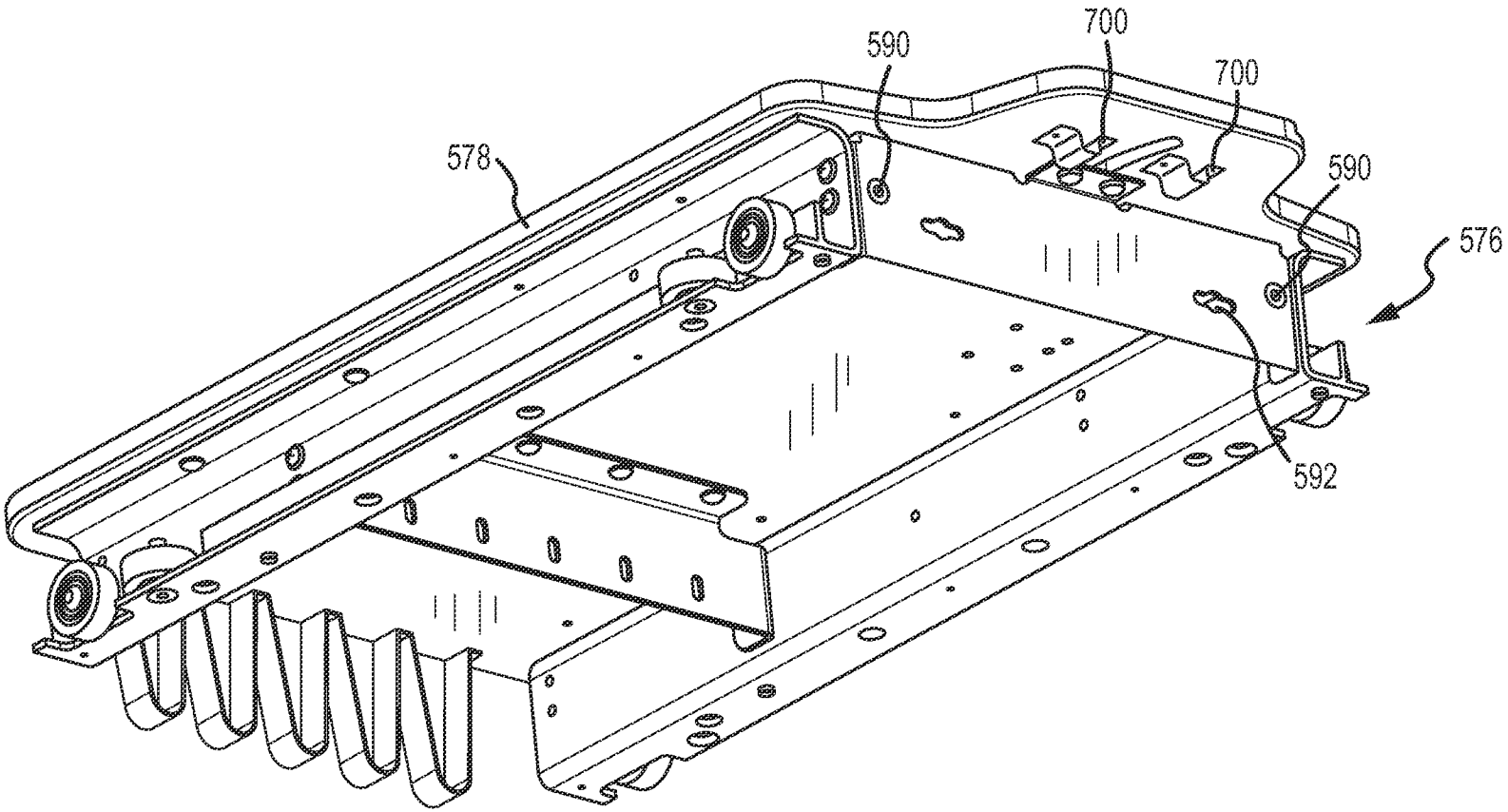
FIG. 31 is a separate underside perspective view of the carriage frame assembly of the carriage shown in FIG. 22.
Figure 32:
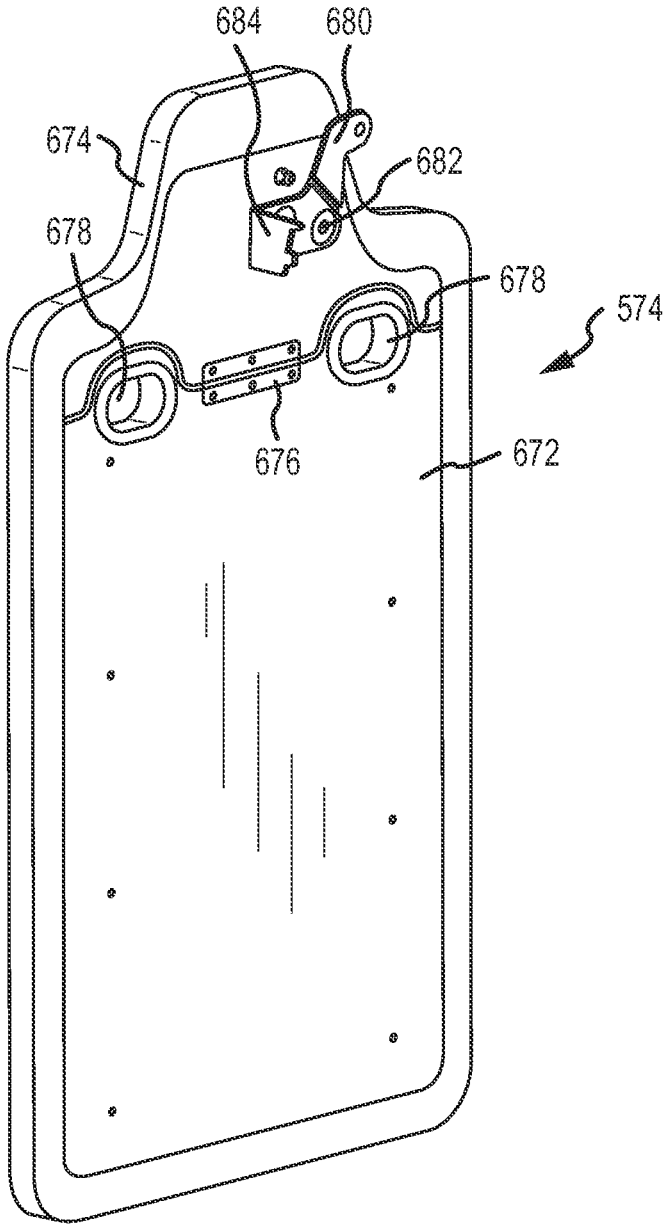
FIG. 32 is an underside perspective view of the support pad removed from the carriage shown in FIG. 22.

The carriage 410 is separately shown in FIGS. 31 and 32. An underside separate perspective view of part of the carriage 410 is separately shown in FIG. 31. An underside view of the upholstered upper platform 574 is separately shown in FIG. 32. The carriage 410 includes a generally rectangular frame 576, a rectangular support platform 578, the upholstered upper platform 574, and a pair of shoulder stops 418. The frame 576 has upright side support plates 580, a vertical head end plate 582 and a vertical spring support plate 584, both of which are fastened to the side support plates 580. All of these plates 580, 582 and 584 are also fastened to the underside of the support platform 578 to provide a rigid carriage structure. The upper side of the platform 578 includes shoulder stop supports 594 (See FIG. 34) as in the first embodiment of the carriage 110 shown in FIG. 12.

The spring support plate 584 carries one end of each of the biasing springs 420. The other end of each spring 420 may be removably fastened to the anchor pins 448 in order to vary the resilient bias, i.e. spring tension between the carriage 410 and the foot end 406 of the frame 402. The side support plates 580 support the platforms 574 and 578 and provide mounting flanges for support wheels 586 and guide wheels 588. The head end plate 582 has a pair of spaced openings 590 therethrough which act as guides for the arm cords 414 (not shown in FIG. 31). A pair of elongated slots 592 are also formed in the head end plate 582. These slots 592 are shaped to receive the stems of the shoulder stops 418 when the shoulder stops 418 are removed and attached to the carriage 410 for storage as is shown in FIG. 39.

Figure 34:
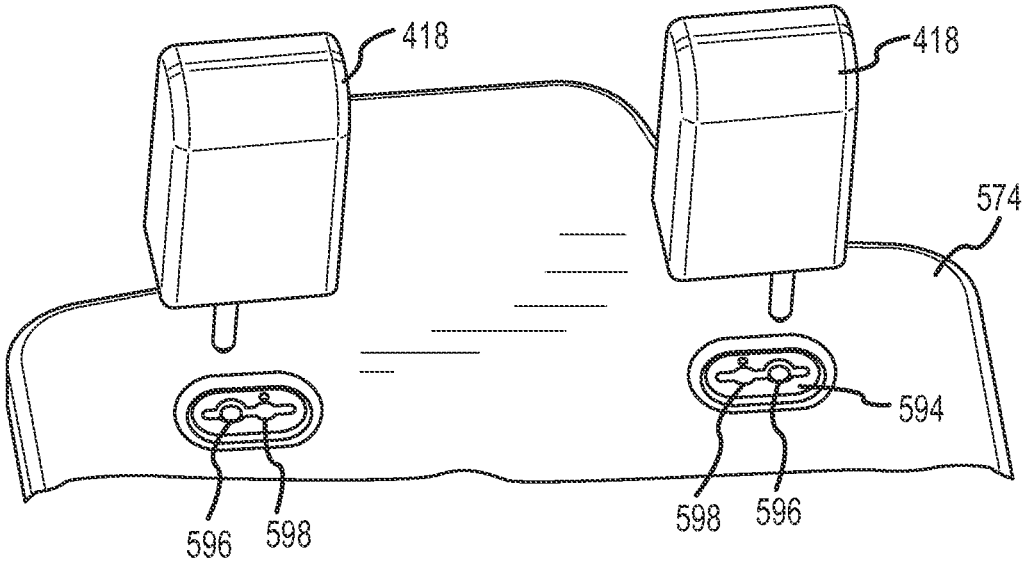
FIG. 34 is an upper partial exploded view of the carriage of the reformer shown in FIG. 22.

The support platform 578 has a pair of shoulder stop supports 594 fastened to its upper surface (as is shown in FIG. 34). Each of these supports 594 has a pair of vertical bores 596 and 598 therethrough. Vertical bore 596 has an oval cross section supports a cross pin 602 on the stem 600 of the shoulder stop 418. Operation of the shoulder stop 418 is identical to that of the shoulder stop 118 of the first embodiment 100, as shown in FIG. 15.

Figure 33:
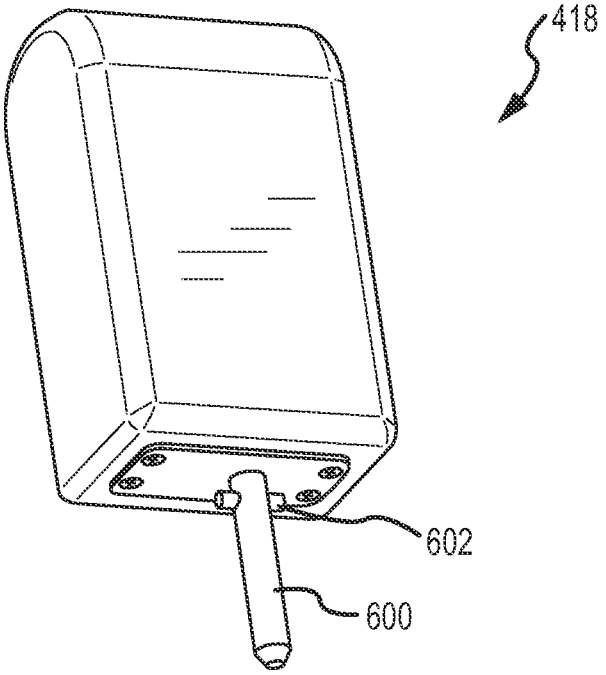
FIG. 33 is a separate perspective view of a shoulder rest utilized in the reformer shown in FIG. 22.

FIG. 33 is a perspective view of the shoulder stop 418. Note that the stem 600 is offset from the axial centerline through the shoulder stop 418. Referring now to FIG. 34, a partial upper view of the upper platform of the carriage 410 is shown. Each of the shoulder stop supports projects through and is flush with the top of the upper platform 574. The inboard bores 598 are circular in cross section. Thus, when the stems 600 of the shoulder stops 418 are placed in these bores 598 the shoulder stops 418 cannot rotate as was the case in the first embodiment 100 described above and shown with reference to FIG. 15. However, when one, or both, shoulder stops 418 are located in the outboard bores 596, they can be tilted toward the foot end 406 just as described with reference to FIG. 15 in the first embodiment 100.

In this embodiment of the reformer 400, not only does a user have an option of rotating the shoulder stops 418 when inserting them into the bores 596 to accommodate different shoulder widths, one or both shoulder stops 418 may be inserted in the inner bores 598 to provide further width adjustment. If both shoulder stops 418 are located in the inner bores 598, then no adjustment of the arm cords 414 can be made. This is called the lockout position. However, if either one or both shoulder stops 418 are placed in the outer bores 596, then adjustment of the arm cords 414 may be made with that shoulder stop in an outer bore 596.

Figure 35:
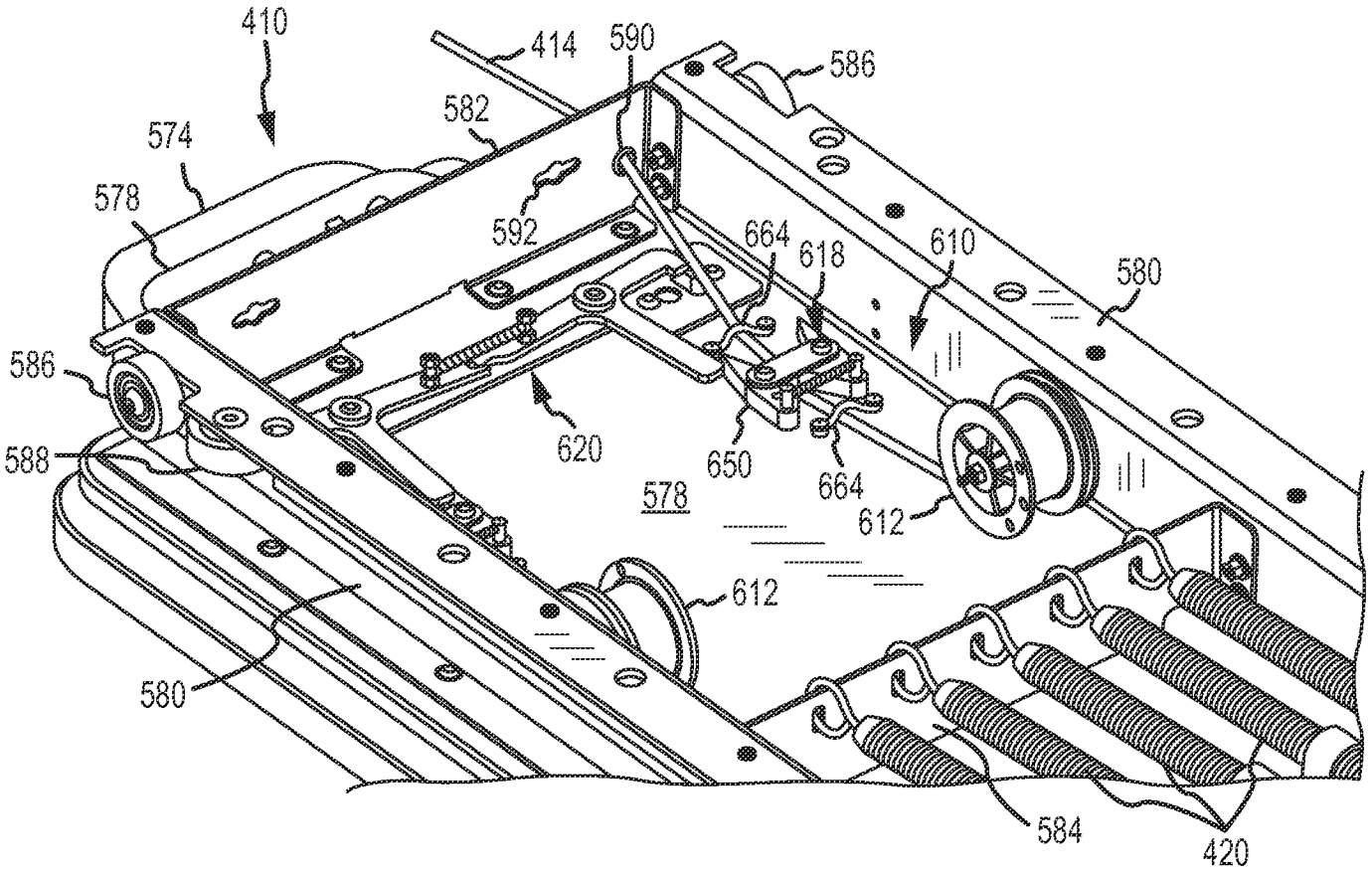
FIG. 35 is an inverted view of the carriage removed from the reformer shown in FIG. 22 showing the cord retraction system in accordance with this alternative embodiment.

A partial perspective view of the bottom of the carriage 410, removed from the reformer 400, is shown in FIG. 35. In this view the springs 420 are shown attached to the spring support plate 584. An exemplary arm cord 414 is shown threaded through the guide hole 590 and into the cord retraction mechanism 610.

Figure 36:
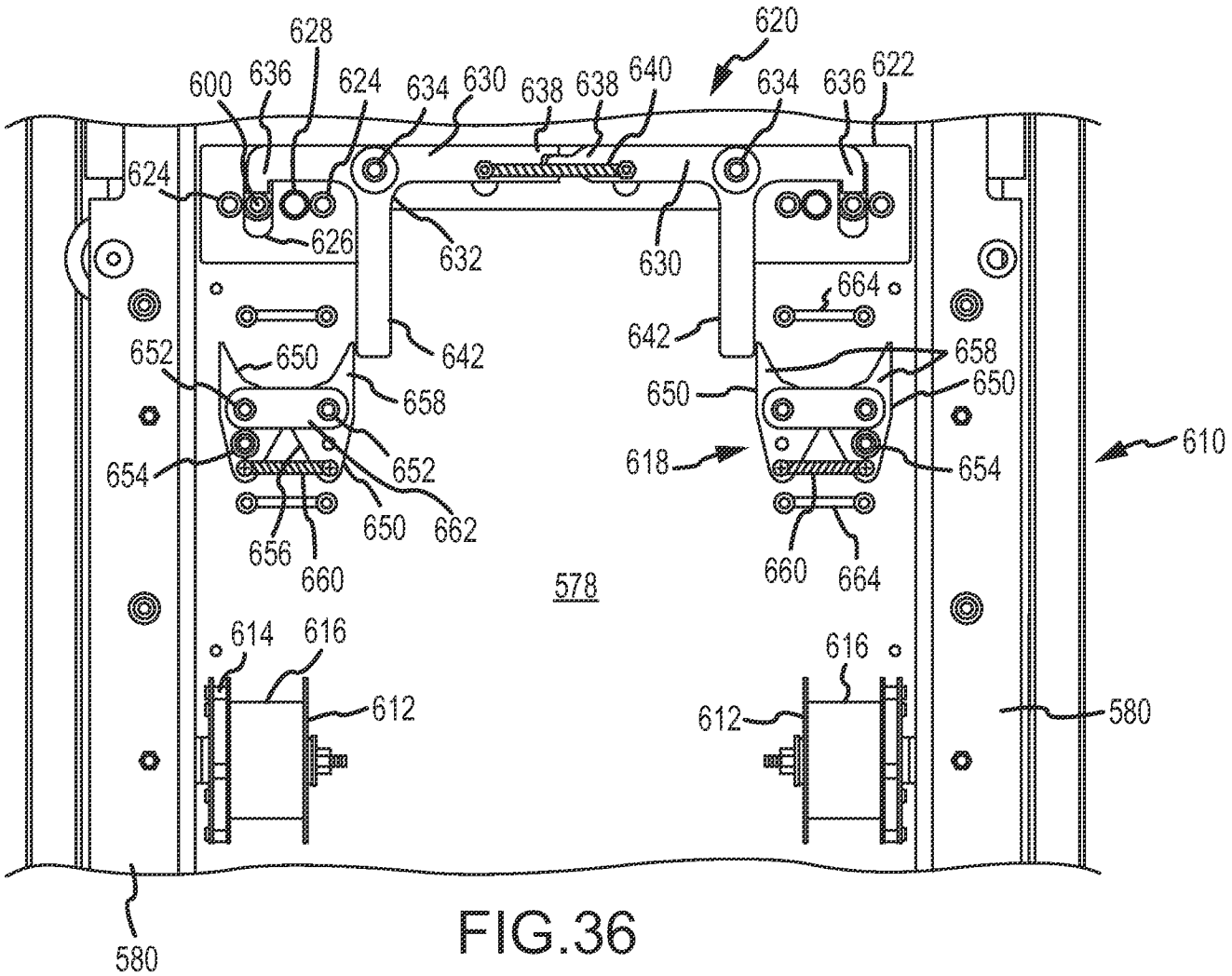
FIG. 36 is an underside plan view of the head end of the carriage shown in FIG. 35 with the cord retraction system in a cord locked position.
Figure 37:
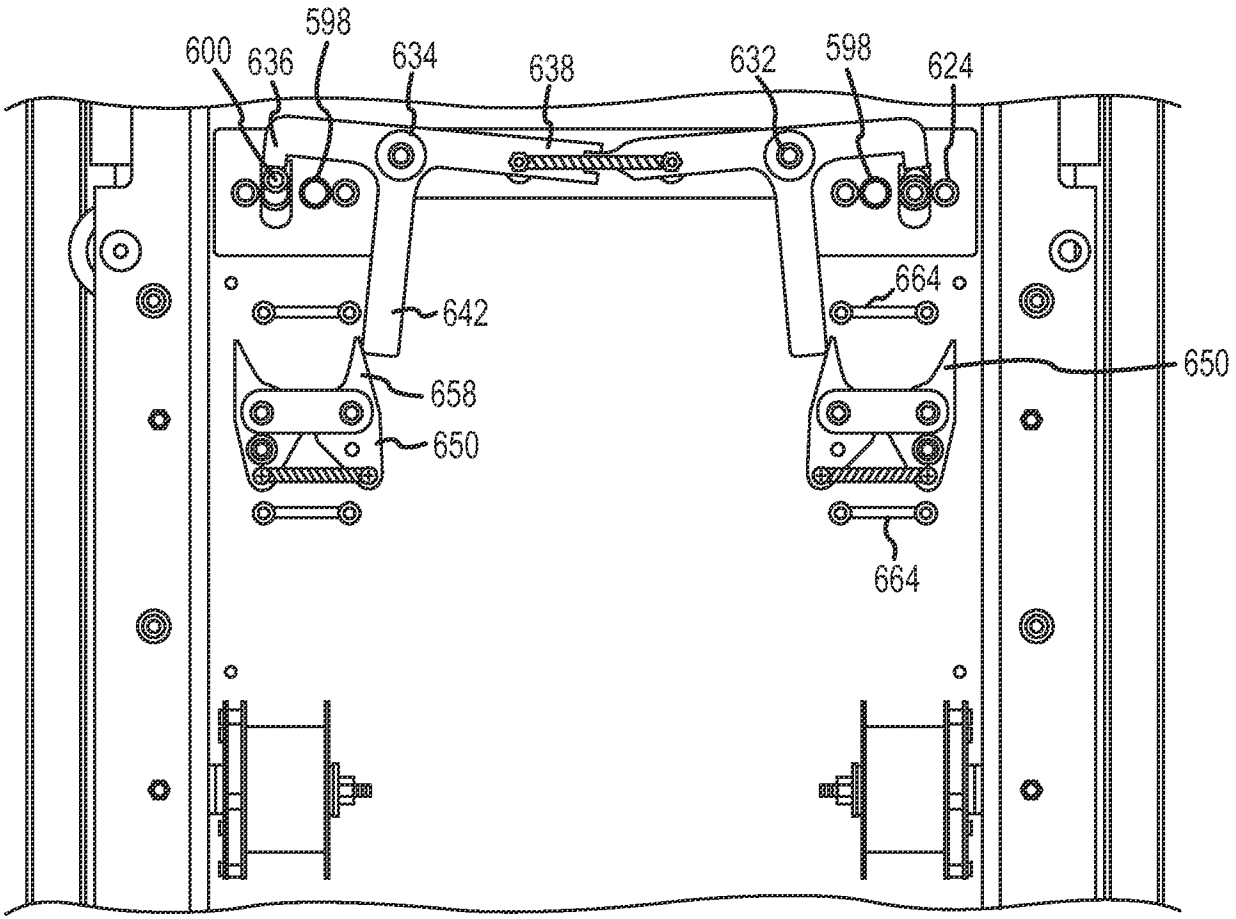
FIG. 37 is a view as in FIG. 36 with the cord retraction system in a cord unlocked position.

A bottom plan view of a head end portion of the carriage 410 is shown in FIGS. 36 and 37. These two views illustrate the configuration and operation of the cord retraction mechanism 610 in accordance with this embodiment of the present disclosure. The arm cords 414 are not shown in this view for clarity. The cord retraction mechanism 610 includes, for each cord 414, a spring biased cord reel 612 that is mounted beneath the support plate 578 for rotation about a horizontal axis and is supported from the carriage frame side support plate 580. The cord reel 612 has a coil spring portion 614 and a cord support portion 616. One end of the cord 414 (not shown) is fastened to and wrapped around the cord support portion 616 of the reel 612. As is shown in FIGS. 35, 36 and 37, the two reels 612 of the cord retraction mechanism 610 are rotatably mounted side by side beneath the underside surface of the platform 578.

The coil spring portion 614 is bolted to or integral with the cord support portion 616 and preferably carries within it a coil spring (not shown) that provides a takeup preload tension on the cord 414 when its end is fastened to the cord support portion 616 of the reel 612. The retraction assembly 610 also includes a unique spring loaded cord clamp assembly 618 fastened to the support platform 578 that is operably coupled to an actuator linkage 620, which is, in turn, actuated by either one of the shoulder stops 418 when installed in the appropriate bore 596.

The actuator linkage 620 is carried on an elongated flat plate 622 that is fastened to the support plate 578 via fasteners 624 and spans between the two side support plates 580 directly beneath the shoulder stops 418 and over the bores 596 and 598. Each end of the flat plate 622 has an elongated opening 626 aligned with a bore 596 and a circular opening 628 aligned with the bore 598. Pivotally carried side by side on the linkage plate 622 are a pair of T shaped links 630. Each T shaped link 630 pivots in the plane of the support plate 578 about the center of the head 632 of the link 630 on a pin 634 fastening the link 630 to the plate 622. One end 636 of the head 632 of each of the links 630 is positioned to engage a stem 600 of the shoulder stop 418 inserted into bore 596. The other end 638 of the head 632 of the T shaped link 630 couples with a corresponding end 638 of the other link 630. The ends 638 of the two links 630 are preferably also coupled together by a coil spring 640. Each T shaped link 630 includes an elongated leg 642. The end of this elongated leg 642 resides adjacent one of the clamp assemblies 618.

The clamp assembly 618 comprises a pair of clamp members 650, the outer one of which is fixed to the support plate 578 by two fasteners 652 and 654. The inner clamp member 650 is rotatably fixed to the support plate 578 by a fastener 652 in a laterally spaced relation to the fixed member 650. Each clamp member has a cord grip portion 656 and an opposite elongated arm portion 658. The arm portion 658 of the inner clamp member 650 is positioned adjacent the leg 642 of the link 630. A coil spring 660 fastens the grip portion 656 of the inner clamp member 650 to the fixed outer clamp member 650 such that the grip portion of the inner clamp member 650 is biased toward the grip portion of the fixed outer clamp member. A flat plate 662 is optionally fastened over the clamp members 650 in each assembly 618 between the fastener 652 and the clamp member 650. Finally, a pair of cord guides 664 is preferably fastened to the support plate 578 and positioned between the link assembly 620 and the reel 612 such that the cord 414 must pass through the hole 590 in the head end plate 582, through a cord guide 664, between the clamp members 650, through another cord guide 664, to the cord retraction reel 612 as is shown in FIG. 35.

The retraction assembly 610 is shown in a cord locked condition in FIG. 36. In FIG. 37, the assembly 610 is shown in an unlocked condition wherein one of the shoulder stops 418, (the left one in FIG. 37) has been tilted toward the foot end of the reformer frame 402. In this view of FIG. 37, the stem 600 of the left shoulder stop 418 pushes up on the end 636 of the link 630. This movement causes the opposite end 638 of the link 630 to rotate downward clockwise. At the same time, the leg 642 must also rotate clockwise, rotating the arm portion 658 of the inner clamp member 650 counterclockwise. This action releases the arm cord 414 from the clamp members 650 and permits the tension in the left cord reel to be felt on the cord 414.

At the same time, the other link 630 is caused to rotate counterclockwise about its pin 632, which, in turn, causes its leg 642 to push against the arm portion 658 of the inner clamp member 650 of the other clamp assembly 618, thus rotating the inner clamp member 650 clockwise. This clockwise rotation of the inner clamp member 650 disengages the clamp member 650 from the other arm cord 414 such that the tension in the right cord reel 612 pulls on the other cord 414. It can readily be seen, therefore, that tilting either one of the shoulder stops 418 that is in an outside bore 596 will cause the same result, a release of both clamp assemblies 618 on both of the arm cords 414, allowing a user to independently adjust the length of each cord.

Again, a retrofit arm cord retraction mechanism kit for a conventional reformer is also envisioned in accordance with the present disclosure for this alternative retraction system 610. Such a kit would include two retraction reels 612 and mounting hardware, two clamp assemblies 618, link assembly 630, replacement shoulder stops 418, two shoulder stop supports 594, and appropriate installation instructions.

Figure 38:
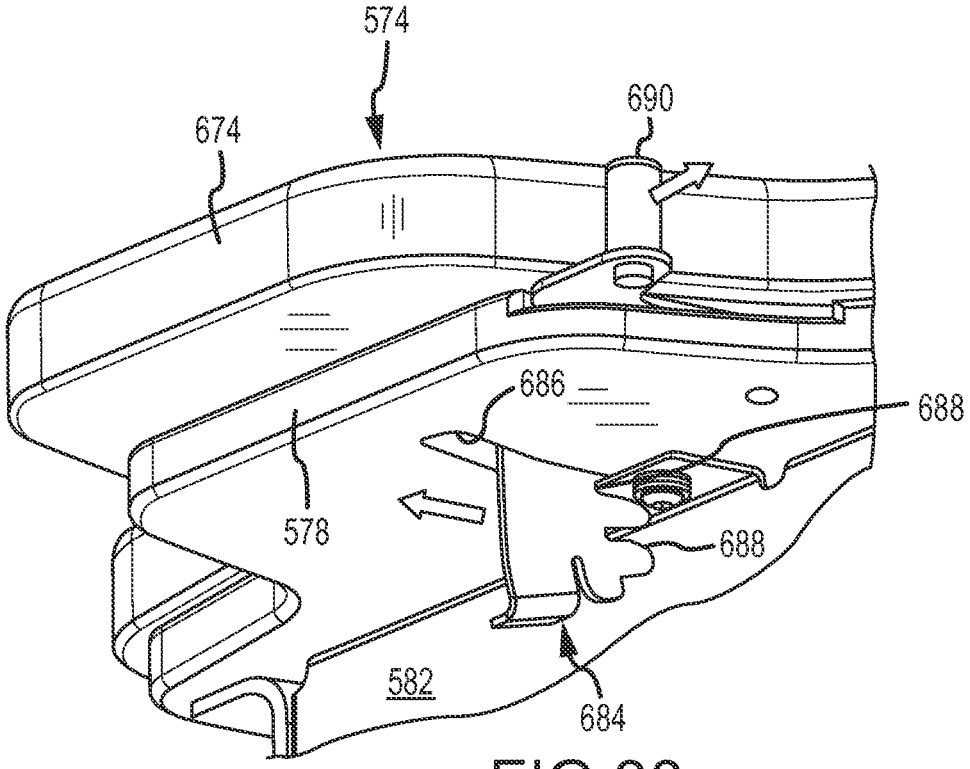
FIG. 38 is a perspective view of the head end of the carriage with the headrest in a lowered position.

In the reformer carriage 410 in accordance with the present disclosure, an adjustable headrest may be integrated into the structure. A bottom view of the upholstered upper support platform 574 is shown in FIG. 32. The rigid base of the upper support plate has two separate sections 672 and 674 spaced apart and joined by a hinge 676. Each section 672 and 674 may be made of plastic, composite material or wood. The section 672 also has apertures 678 for receiving the shoulder stop supports 594 therethrough as above described. The sections 672 and 674 are spaced apart by about ¼ inch so as to give clearance for bending the head end portion of the upholstered platform 574 as is shown with reference to the first embodiment in FIGS. 19-21. However, in this reformer 400, there is no cam block 364. Instead, as shown in FIG. 32, an elongated adjustment lever 680 is fastened to the underside of the head end section 674. This lever 680 rotates about a fastener 682 secured to the underside of the head end section 674. The lever 680 has one end 684 bent at 90 degrees from the plane of the platform 574. This bent end 684 projects through a slot 686 in the support plate 578 as shown in FIG. 38. The bent end 684 has a series of notches 688 for adjusting the height of the head end section 674. The opposite end of the lever 680 may have a knob 690 fastened thereto for rotating the lever 680 out of and into engagement of the notches 688 with a corresponding flange of the head end support plate 582.

The reformer 400 of this present disclosure may be configured so as to be easily stacked for stacked storage. Each of the feet 429 include recessed portions designed to fit onto the outer corner rim of an underlying reformer 400. The bottom of each foot 429 that facilitates stacking of one apparatus on top of another has a recessed portion. Stacking is facilitated through engagement of the outer corners of the head end of the reformer and outer corners of the standing platform at the foot end of the reformer into the recessed portions in each foot as is shown in FIG. 39. When two or more reformers 400 are so stacked they are securely held laterally in place by these feet 429.

Furthermore, the risers 412 are removed from the head end 404 and fastened to one of the brackets 700 (see FIG. 31 and FIG. 40 below). Each of the shoulder stops 418 is removed and the stems 600 passed through the shoulder stop slot openings 592, turned 90 degrees so that the pins 602 engage the head end support plate 582.

Figure 40:
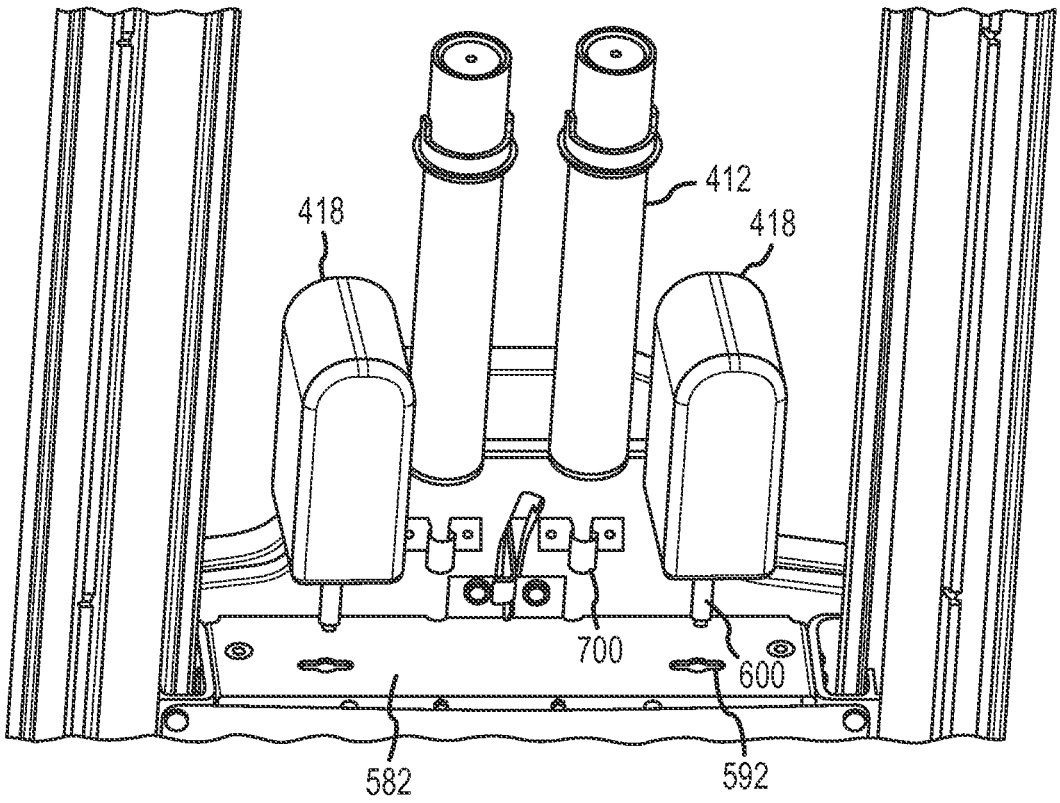
FIG. 40 is a perspective view of the underside of the head end of the carriage showing the risers and shoulder stops ready for installation in the storage position as shown in FIG. 39.

An underside perspective view of the head end of the carriage 410 is shown in FIG. 40 showing the risers 412 and shoulder stops 418 spaced from these holding features. These holding features are slots 592 in the head end plate 582 and spring brackets 700 The spring brackets 700 resiliently snap within the lower openings 564 to hold and retain the riser 412 in place without marring or otherwise damaging the exterior finish of the riser 412.

When the risers 412 and shoulder stops 418 are mounted beneath the carriage 410 as shown in FIGS. 39 and 40, the carriage 410 may be positioned fully at the head end of the frame 402, and an optional mat conversion pad 702 may be placed between the carriage 410 and the standing platform 423 to provide a fully flat mat surface. This mat conversion places the carriage 410 in a stationary position at the head end 404, and presents to the user a full flat surface.

Figure 41:
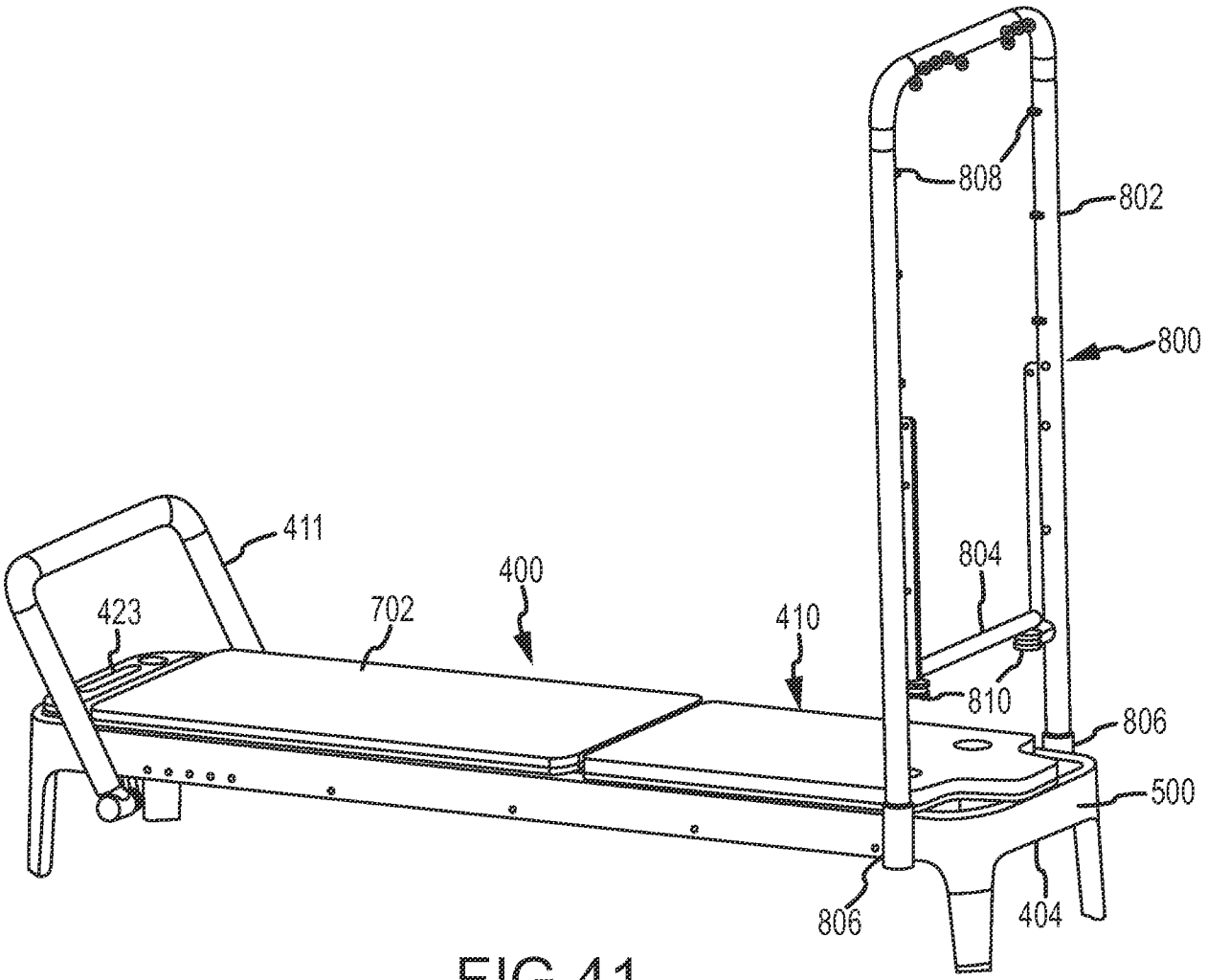
FIG. 41 is a perspective view of the reformer shown in FIG. 22 including an optional vertical trapeze tower and mat conversion in accordance with the present disclosure.

The reformer 400 may optionally also be configured with a trapeze tower assembly 800 as is shown in FIG. 41. The tower assembly 800 basically comprises a U shaped tower 802, a trapeze swing 804, and a pair of tower sockets 806. The tower sockets 806 are fastened between the rail members 408 and the head end extrusion 500 of the head end 404 and become an integral part of the frame 402. The bottom ends of the tower 802 fit within the sockets 806 and are drawn into the sockets 806 as is shown in more detail in FIG. 43.

The tower 802 is preferably a tubular metal body such as aluminum or steel and may either be bent to the shape as shown in FIG. 41, or may be formed from straight sections joined by conventional 90 degree elbows. The tower 802 has a plurality of spaced eyebolts 808 for attaching springs, straps, or pulleys 810 as may be needed for particular exercises. Alternatively the vertical legs of the tower 802 may have a vertical slot and adjustable clamp fittings provided therein for anchoring the springs, pulleys 810, or eyebolts 808 thereto.

Figure 44:
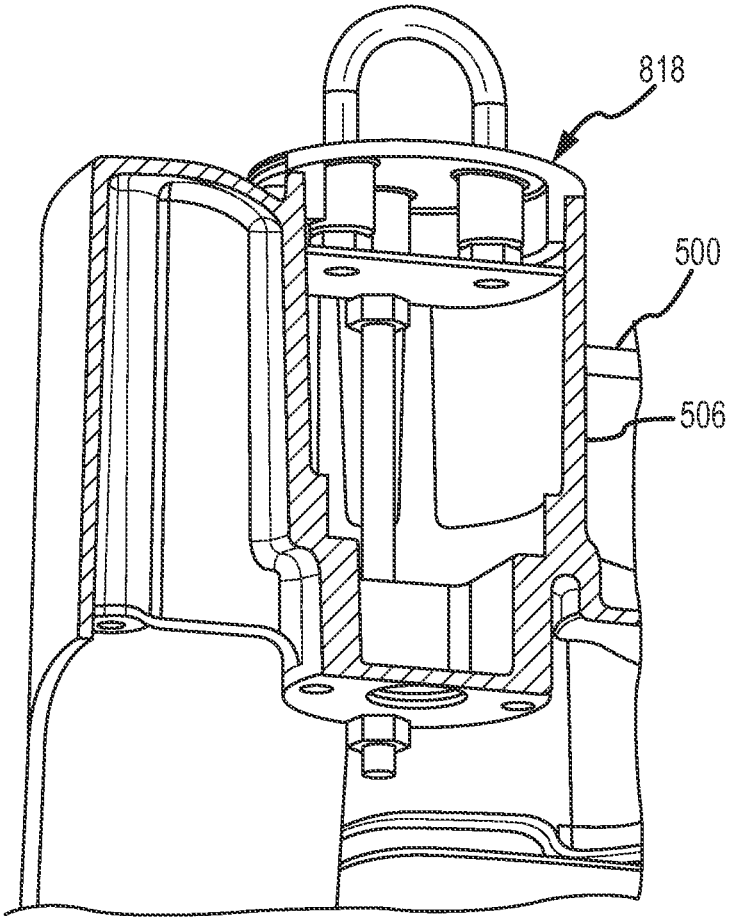
FIG. 44 is a partial cutaway view through one of the riser bosses at the head end of the reformer shown in FIG. 41 showing an alternative lower pulley mount installed therein.

In addition, the risers 412 may be utilized or replaced with a U shaped connector assembly 818 so that a pulley 810 may be fastened thereto. This U shaped connector assembly 818 fits within the boss 506 in the head end extrusion 500, and is bolted in place as shown in FIG. 44, or alternatively may be configured to be fastened with the same hand bolt 413 as is used to secure the riser 412 in place as is shown in FIG. 28. When the connector assembly 818 is utilized in place of the riser 412, then a second pulley 810 (not shown) could be fastened to the assembly 818 and used as a lower arm cord guide directing the arm cord from the carriage 410 to the lower pulley and through the upper pulley 810 to the hand loop as in the embodiments 100 and 400 shown in FIGS. 1 and 22.

Figure 42:
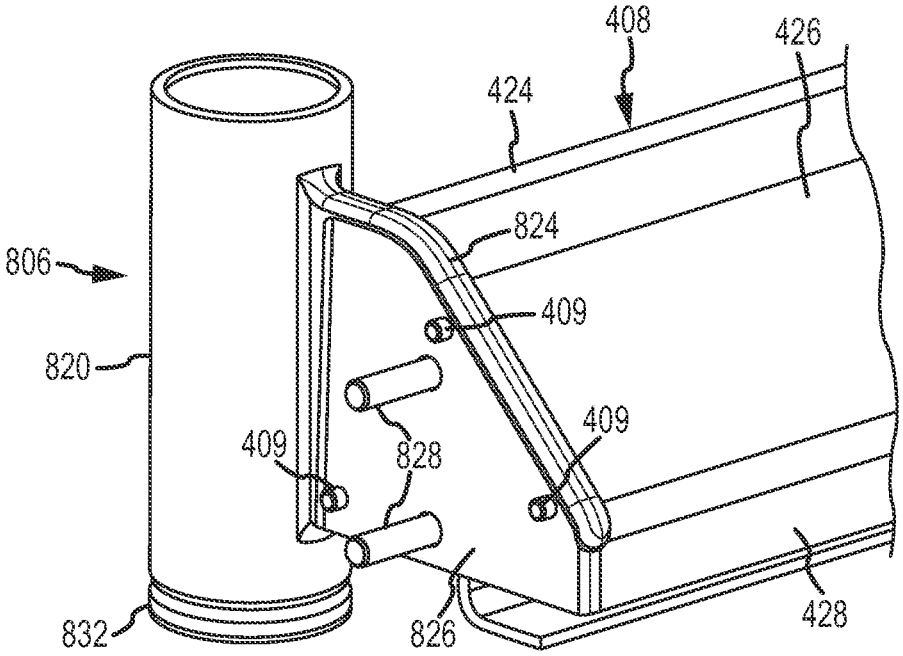
FIG. 42 is a perspective view of a trapeze tower socket aligned against the end of one side rail of the reformer shown in FIG. 41 for connection to the head end extrusion.

A tower socket 806 is shown mounted on the head end of one of the side rail members 408 in FIG. 42. The tower socket 806 is a metal extrusion, preferably aluminum, that has a tube portion 820 and an axially extending radial flange portion 822. The flange portion 822 has a thickened edge 824 and a plate portion 826 that is identically shaped to fit against end plate 407 of the head end extrusion 500 and against the end of the side rail member 408. Locating pins 409 orient the flange portion 822 with respect to the rail member 408 and the end plate 407, and nuts (not shown) are used on bolts 828 to fasten the head end 404 and the socket 806 securely to the side rail member 408.

Figure 43:
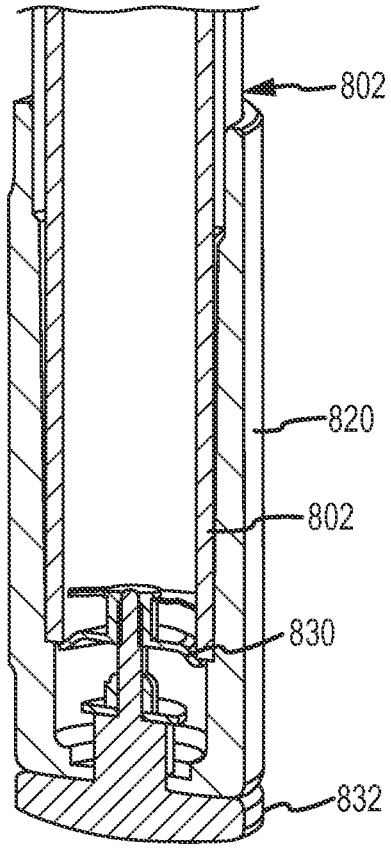
FIG. 43 is a sectional view through the trapeze tower socket of the tower shown in FIG. 41.

FIG. 43 is a cutaway view of an assembled tower 802 fastened in a socket 806. In a fashion similar to that described above with reference to risers 412 being fastened into the bosses 506, the bottom end of the tower 802 is fitted with a threaded expansion plug 830. A hand bolt 832 extending into the bottom of the tube portion 820 threads into the plug 830. When tightened, the expansion plug 830 draws the bottom end of the tower 802 down tightly into the socket 806 to complete the assembly of the tower 800 to the frame 402.

Figure 45:
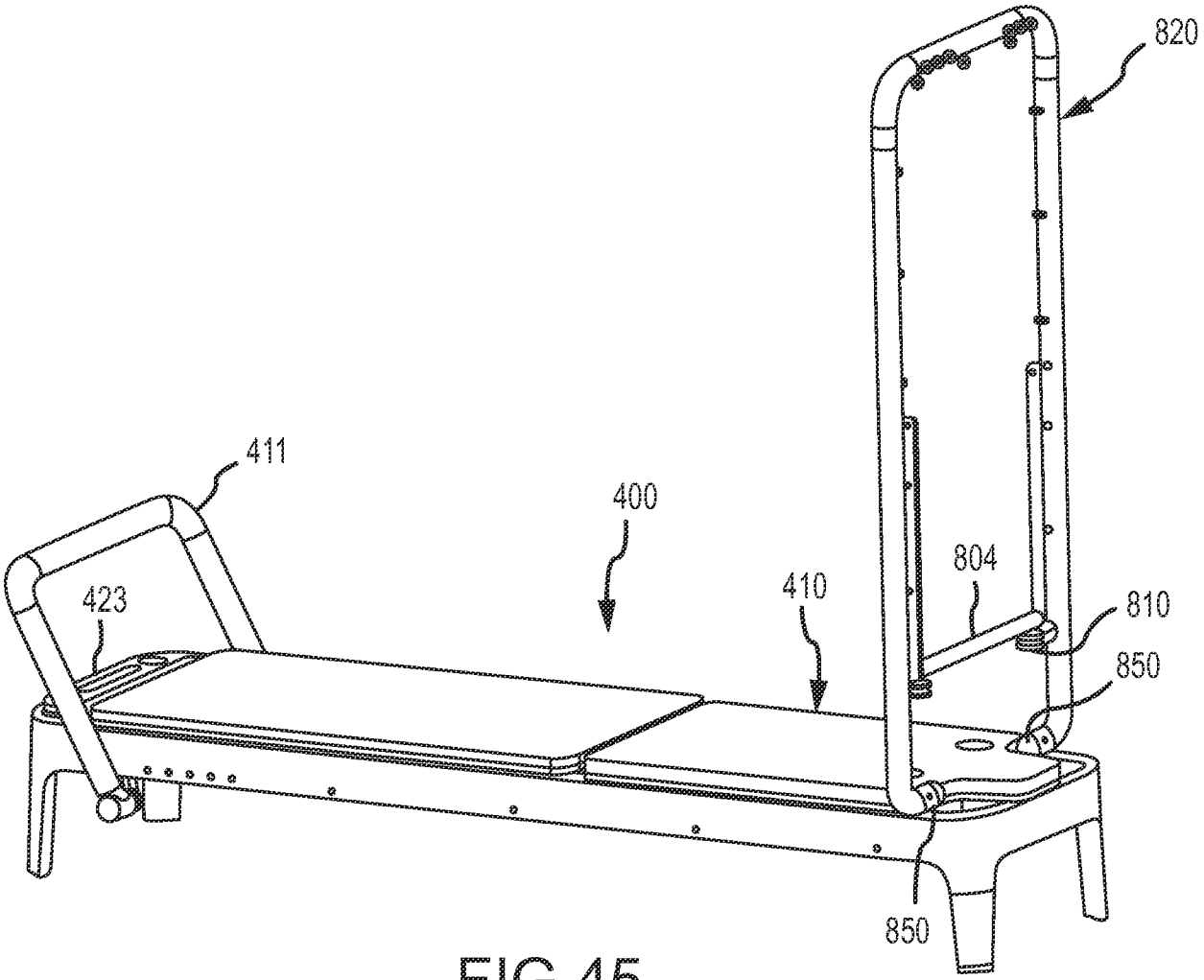
FIG. 45 is a perspective view of a reformer as in FIG. 22 with an alternative vertical trapeze tower and matt conversion in accordance with the present disclosure.

Alternatively, the bottom ends 850 of a tower 820 may be narrowed and shaped so as to telescopically fit within the bosses 506 in the head end extrusion 500 as is shown in the perspective view of this alternative in FIG. 45. This construction would preclude the need for tower sockets 806. In such an alternative, shown in FIG. 45, a hand bolt 832 would be again used to draw the bottom ends 850 of the tower 820 tightly into the bosses 506 just as the risers 412 would be fastened into the bosses 506 above described. In such an alternative configuration, of course, the risers 412 are not used. Instead, the arm cords 414 would each be attached to a pulley 810.

Figure 46:
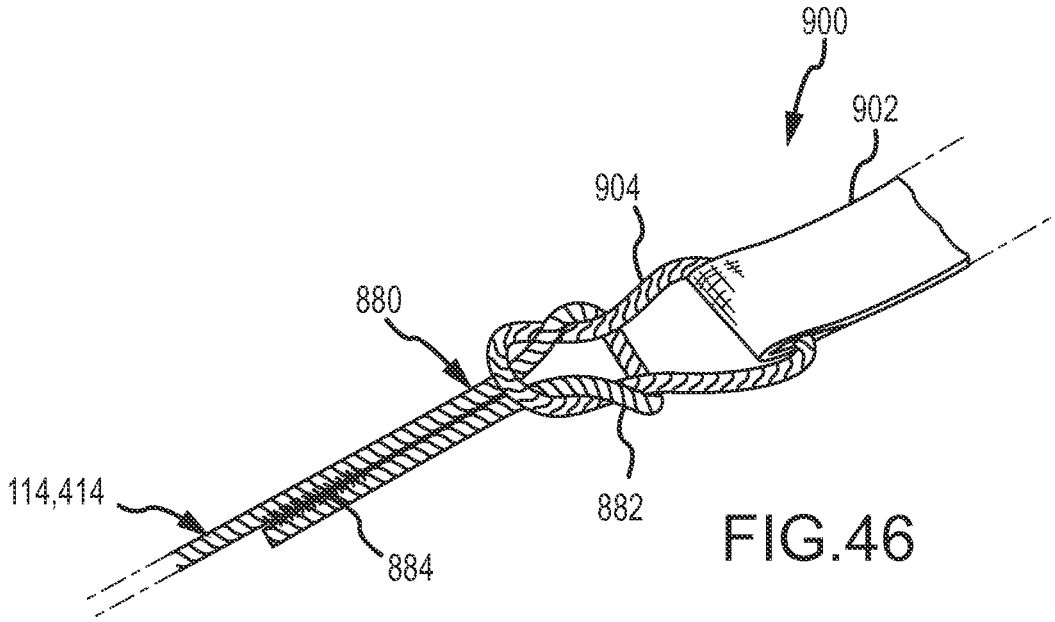
FIG. 46 is a perspective view of the hand grip end portion of an arm cord for use with a reformer in accordance with the present disclosure.

Turning now to FIG. 46, an exemplary handle end portion 880 of an arm cord 114, 414 is shown attached to a hand strap 900. End portion 880 is turned back on itself to form a flexible eye 882. The free end 884 of the end portion 880 is sewn or otherwise permanently secured to the end portion 880 to form the eye 882. This eye 882 replaces the need for a conventional metal or plastic snap clip for connection to a conventional hand grip.

The hand strap 900 has a looped strap portion 902 sewn to ends of a short length of arm cord material to form a flexible cord ring 904 attached to the strap portion 902. The flexible cord ring 904 is attached to the eye 882 by passing the ring 904 over the eye 882 and then threading the strap portion 902 through the ring 904. The result is the hand strap 900 fastened to the arm cord 114, 414 essentially in a square not configuration as is shown in FIG. 46. The arm cords 114, 414 with hand strap 900 attached in this manner can be utilized with any conventional reformer or other exercise apparatus utilizing arm/foot cords as well as with the reformer 100, 400 of the present disclosure.

Figure 47:
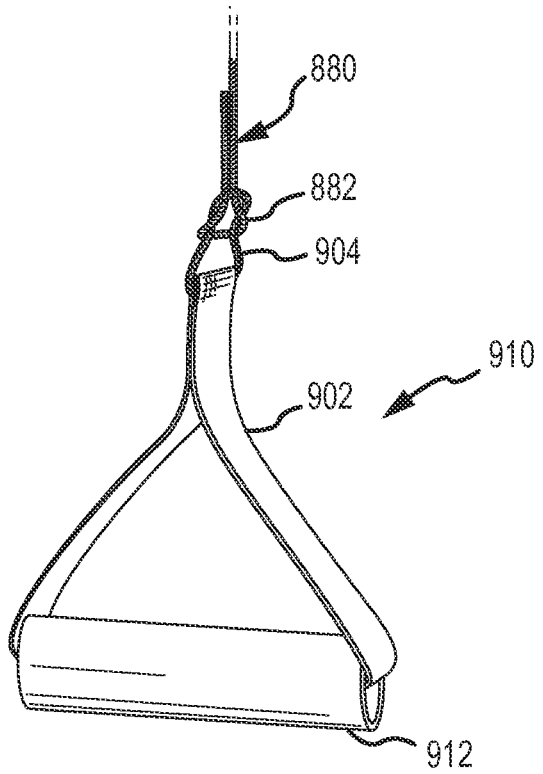
FIG. 47 is a perspective view as in FIG. 46 with a handle attached to the arm cord in accordance with the present disclosure.

A hand grip 910 is shown in FIG. 47 that has a tubular handle 912. This grip 910 may be utilized in place of hand strap 900. Again, the hand grip 910 preferably has a flexible cord ring 904 as described above to fasten the hand grip 910 to the end portion 880. Alternatively, a standard hand grip may be used that includes a metal D ring fastened to the hand grip 910 in place of the cord ring 904.

Figure 48:
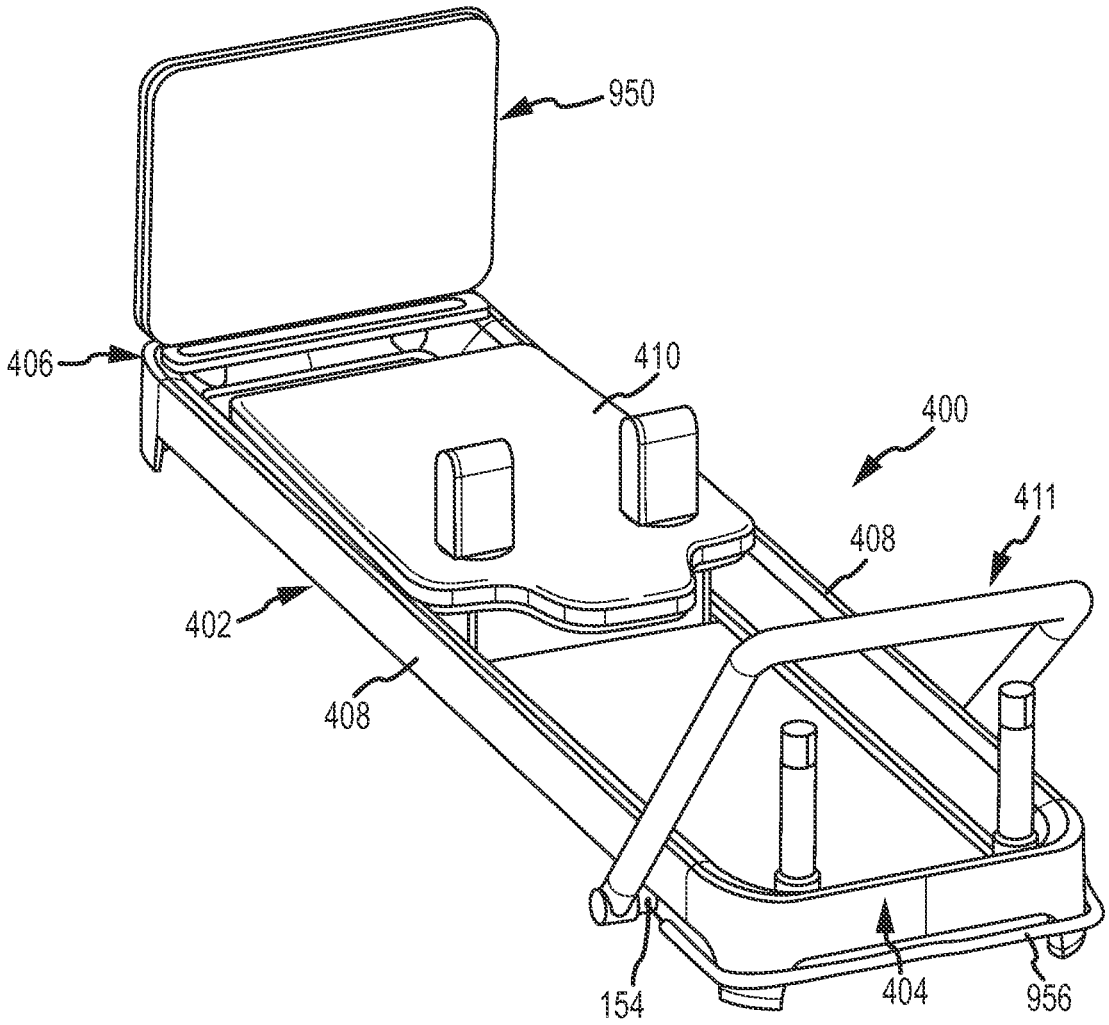
FIG. 48 is a perspective view of the reformer shown in FIG. 22 with a jump board installed at the foot end of the reformer frame.
Figure 49:
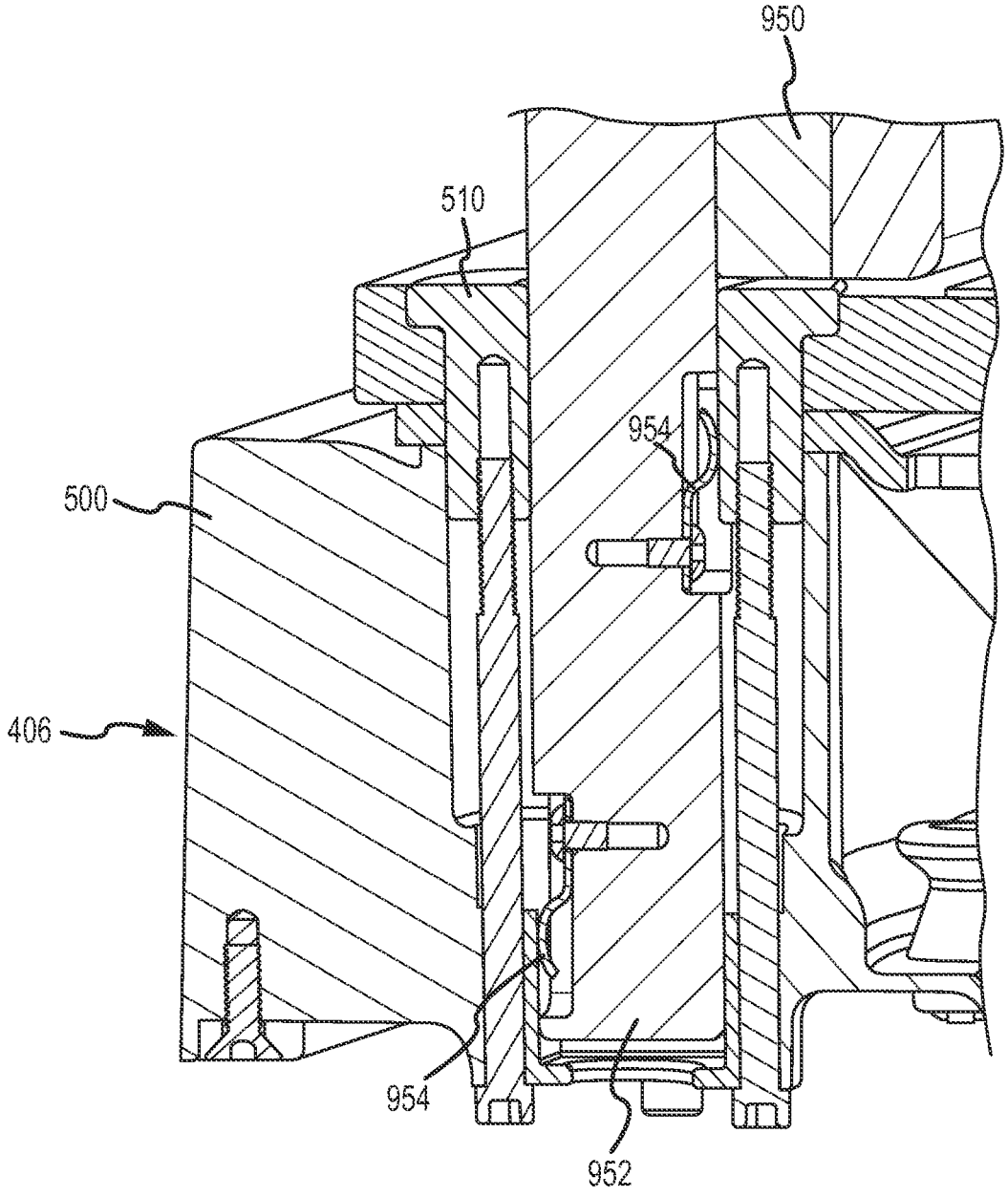
FIG. 49 is an enlarged vertical partial sectional view through one of two posts supporting the jump board installed at the foot end of the reformer frame.

The reformer 100 or 400 may be configured with a jump board 950 as is shown in FIG. 48. This jump board 950 is a generally rectangular plate structure with two parallel posts 952 that fit down into the inserts 510 in the bosses 506 in the foot end 106, 406. These posts 952 each have a rectangular or square cross sectional shape as is shown in the sectional partial view of FIG. 49.

Each post 952 includes a pair of spaced leaf springs 954 that bias the post 952 counterclockwise in the insert 510 so that there is a preload on the jump board 950 effectively away from the carriage 110, 410. This preload prevents rattle and rotational movement of the jump board in response to a user's applied force on the jump board during an exercise. This configuration presents a firm, solid feel to the user of the jump board as it is installed and used.

In FIG. 48, note that the foot bar 411 is shown positioned adjacent the head end 404 of the frame 402. Furthermore the foot bar 411 support assemblies 470 are shown in the free rotational position in which pins 461 are engaged in slots 484 as described with reference to FIGS. 29 and 30. When the foot bar 411 is thus positioned to be movable between the head and foot ends 404 and 406 of the frame 402, an elastic resistance member 956 may be fastened to the connection portions 154 of the leg portions 156 of foot bar 411 and stretched around the head end 404 of the frame 402 as is shown in FIG. 48. With the foot bar 411 configured in this manner, a user can sit or lay on the carriage 410, grasp the leg portions 156 of the foot bar 411 and pull the foot bar 411 toward the carriage 410 against the resistance provided by resistance member 956.

Alternatively, the user can rotate the foot bar 411 to the vertical position, lower the foot bar 411 to engage pins 461 in notches 482, which locks each support assembly 470 in place on the rail members 408. Then the user can pull the carriage 410 toward the head end 404 with his or her arms. It is to be understood that the resistance member 956 may be two separate members each separately connected to the head end 404, or may be a single resistance member as is illustrated in FIG. 48. Furthermore, the above description applies equally well to the first embodiment, reformer apparatus 100 described above with reference to FIGS. 1-21.

These are only exemplary embodiments and variations. A reformer exercise apparatus in accordance with the present disclosure may incorporate one or more or any of the features described herein. Other modifications will be readily apparent to one skilled in the art. For a simple example, any of the coil springs shown in the drawing figures may be replaced by stretchable elastic members and vice versa. For another, the holding features for accommodating the risers 412 and shoulder stops in storage positions beneath the upper surface of the reformer carriage 410 may differ from clips 700 and slots 592. The risers 412 may fit within corresponding openings (not shown) in plate 582 or on pins projecting from plate 582. The reformers 100, 400 may be configured with short legs as shown in FIG. 48, or longer legs as shown in at least FIGS. 1 and 22. Accordingly, all such alternatives, variations and modifications are intended to be encompassed within the scope of and as defined by the following claims.

What is claimed is:

1. An arm cord retraction assembly for use on a reformer exercise apparatus having a generally rectangular frame supporting a carriage for reciprocal movement between a head end and a foot end of the frame, and a pair of arm cords extending between the carriage, the head end of the frame, and handles for a user on the carriage to grasp during exercise, the arm cord retraction assembly comprising:

a pair of cord retraction devices configured to be fastened to an underside of the carriage, each cord retraction device having a frame carrying a rotatable spring biased reel therein adapted to be connected to a free end of one of the arm cords; and a pair of latch assemblies configured to be mounted to the underside of the carriage, each latch assembly associated with one of the cord retraction devices, wherein each latch assembly is operable to hold and release the free end of the arm cord from its cord retraction device, and wherein the latch assemblies are operably connected mechanically together such that operation of one latch assembly to hold or release its arm cord causes the other of the latch assemblies to operate to hold and/or release the other arm cord.

2. The arm cord retraction assembly according to claim 1 wherein each of the latch assemblies includes a toothed latch member pivotally mounted to the underside of the carriage operable to engage a toothed rim of the rotatable spring biased reel.

3. The arm cord retraction assembly according to claim 2 wherein each toothed latch member is linked to the other latch member via a linkage end of the latch member.

4. The arm cord retraction assembly according to claim 2 further comprising an actuator connected to one of the latch members for rotating the latch members into and out of engagement with the toothed rims of the rotatable spring biased reels.

5. The arm cord retraction assembly according to claim 4 wherein the actuator is a portion of a shoulder stop pivotally mounted to the carriage.

6. The arm cord retraction assembly according to claim 1 wherein the rotatable spring biased reels each rotate about a vertical axis through the carriage.

7. The arm cord retraction assembly according to claim 6 wherein the rotatable spring biased reels are mounted side-by-side on the underside of the carriage and each rotatable spring biased reel and latch member each rotate about a different vertical axis.

8. The arm cord retraction assembly according to claim 1 wherein each latch assembly is a clamp assembly having a fixed clamp member fastened to the underside of the carriage and a movable clamp member pivotally mounted adjacent the fixed clamp member with the arm cord passing therebetween to and from the rotatable spring biased.

9. The arm cord retraction assembly according to claim 8 wherein the movable clamp member is spring biased toward the fixed clamp member.

10. The arm cord retraction assembly according to claim 8 wherein the latch assemblies are operably connected together by an actuator linkage pivotally fastened to the underside of the carriage between the latch assemblies.

11. The arm cord retraction assembly according to claim 10 wherein the movable clamp member has an elongated end engaging the actuator linkage.

12. The arm cord retraction assembly according to claim 8 wherein each rotatable spring biased reel is rotatable about a horizontal axis parallel to a plane of the carriage.

13. The arm cord retraction assembly according to claim 12 wherein the movable clamp member is spring biased toward the fixed clamp member.

14. The arm cord retraction assembly according to claim 12 wherein the latch assemblies are operably connected together by an actuator linkage pivotally fastened to the underside of the carriage between the latch assemblies.

15. The arm cord retraction assembly according to claim 14 wherein the movable clamp member has an elongated end engaging the actuator linkage.

16. The arm cord retraction assembly according to claim 14 wherein the actuator linkage is operated by one of a pair of shoulder stops pivotally mounted to the carriage.

17. A reformer exercise apparatus comprising:

a generally rectangular frame supporting a carriage for reciprocal movement between a head end and a foot end of the frame, and a pair of arm cords extending between the carriage, the head end of the frame, and handles for a user on the carriage to grasp during exercise, the carriage having a pair of spaced shoulder stops extending from an upper surface of the carriage; and an arm cord retraction assembly mounted to an underside surface of the carriage, the assembly comprising:

a pair of cord retraction devices, each cord retraction device having a stationary frame carrying a rotatable spring biased reel therein connected to a free end of one of the arm cords;

a pair of clamp assemblies mounted to the underside of the carriage, wherein each clamp assembly has a fixed clamp member and a movable clamp member engaging the one of the arm cords passing therebetween, wherein the movable clamp members are coupled mechanically together such that rotation of one of the movable clamp members out of engagement with one of the cords causes the other of the movable clamp members to rotate out of engagement with the other one of the arm cords such that each arm cord may be retracted onto or extended from its spring biased reel.

18. The apparatus according to claim 17 further comprising an actuator connected to at least one of the movable clamp members for rotating the movable clamp members into and out of engagement with the arm cords.

19. The apparatus according to claim 17 wherein at least one of the shoulder stops is pivotably mounted to the carriage and has an actuator extending from the shoulder stop through the carriage, wherein the actuator that operates one of the movable clamp members.

20. An arm cord retraction kit for retrofitting a reformer exercise apparatus carriage, the kit comprising:

a pair of cord retraction devices, each cord retraction device having a stationary frame for mounting to an underside surface of a reformer carriage, each stationary frame carrying a rotatable spring biased reel therein connectable to a free end of one of a pair of arm cords;

a pair of latch assemblies each having a movable latch member for pivotal mounting to the underside surface of the carriage and engaging one of the pair of arm cords; and a linkage, wherein when the cord retraction devices, latch assemblies and linkage are fastened to an underside of a reformer carriage, the latch assemblies are interconnected such that rotation of one of the movable latch members via an actuator out of engagement with the one of the pair of arm cords causes the other of the latch members to rotate out of engagement with the other of the pair of arm cords.

* * * * *